US009600955B2

(12) United States Patent
Kitamura et al.

(10) Patent No.: US 9,600,955 B2
(45) Date of Patent: Mar. 21, 2017

(54) GAMING MACHINE AND GAMING METHOD

(71) Applicants: Universal Entertainment Corporation, Tokyo (JP); Aruze Gaming America, Inc., Las Vegas, NV (US)

(72) Inventors: Kenta Kitamura, Tokyo (JP); Masumi Fujisawa, Tokyo (JP); Tatsuya Teranishi, Tokyo (JP); Takeshi Kada, Tokyo (JP); Kazuo Okada, Tokyo (JP)

(73) Assignees: UNIVERSAL ENTERTAINMENT CORPORATION, Tokyo (JP); ARUZE GAMING AMERICA, INC., Las Vegas, NV (US)

( * ) Notice: Subject to any disclaimer, the term of this patent is extended or adjusted under 35 U.S.C. 154(b) by 868 days.

(21) Appl. No.: 13/624,261

(22) Filed: Sep. 21, 2012

(65) Prior Publication Data

US 2014/0087816 A1 Mar. 27, 2014

(51) Int. Cl.
*A63F 9/24* (2006.01)
*G07F 17/32* (2006.01)

(52) U.S. Cl.
CPC ..... *G07F 17/3213* (2013.01); *G07F 17/32* (2013.01); *G07F 17/3267* (2013.01)

(58) Field of Classification Search
CPC ..... G07F 17/3206; G07F 17/3209; G07F 17/3267
USPC ..... 463/16, 22, 25
See application file for complete search history.

(56) References Cited

U.S. PATENT DOCUMENTS

2004/0053661 A1* 3/2004 Jones et al. ..... 463/16
2009/0227314 A1* 9/2009 Bennett ..... 463/16

* cited by examiner

*Primary Examiner* — David L Lewis
*Assistant Examiner* — Robert Mosser
(74) *Attorney, Agent, or Firm* — Lex IP Meister, PLLC

(57) ABSTRACT

A controller of a gaming machine executes a normal round of a game to spin reels of a first display, and triggers a chance round of the game when a result of the normal round satisfies a predetermined condition. The controller displays a wheel and a plurality of touch areas on a second display, and the wheel includes a plurality of areas, each of the plurality of areas corresponding to a number of free rounds. When any one of the touch areas is touched and slid by a player, the controller spinning the wheel in a direction corresponding to the slid touch area, and randomly determines a number of free rounds. The controller stops the wheel at a position of an area that corresponds to the determined number of free rounds among the plurality of areas, and provides free rounds having the determined number.

16 Claims, 47 Drawing Sheets

FIG.6

| | 1st REEL | 2nd REEL | 3rd REEL | 4th REEL | 5th REEL |
|---|---|---|---|---|---|
| CODE | SYMBOL | SYMBOL | SYMBOL | SYMBOL | SYMBOL |
| 00 | BAR | 2BAR | BAR | 2BAR | BAR |
| 01 | BLANK | BLANK | BLANK | BLANK | BLANK |
| 02 | 7 | 7 | 7 | 7 | 7 |
| 03 | BLANK | BLANK | BLANK | BLANK | BLANK |
| 04 | 3BAR | 3BAR | 3BAR | 3BAR | 3BAR |
| 05 | BLANK | BLANK | BLANK | BLANK | BLANK |
| 06 | BAR | 2BAR | BAR | 2BAR | BAR |
| 07 | BLANK | BLANK | BLANK | BLANK | BLANK |
| 08 | 2BAR | BAR | 2BAR | BAR | 2BAR |
| 09 | BLANK | BLANK | BLANK | BLANK | BLANK |
| 10 | 3BAR | 3BAR | CHANCE | 3BAR | 3BAR |
| 11 | BLANK | BLANK | BLANK | BLANK | BLANK |
| 12 | 2BAR | BAR | 2BAR | BAR | 2BAR |
| 13 | BLANK | BLANK | BLANK | BLANK | BLANK |
| 14 | 7 | 7 | 7 | 7 | 7 |
| 15 | BLANK | BLANK | BLANK | BLANK | BLANK |
| 16 | 2BAR | BAR | 2BAR | BAR | 2BAR |
| 17 | BLANK | BLANK | BLANK | BLANK | BLANK |
| 18 | BAR | 2BAR | BAR | 2BAR | BAR |
| 19 | BLANK | BLANK | BLANK | BLANK | BLANK |
| 20 | 7 | 7 | 7 | 7 | 7 |
| 21 | BLANK | BLANK | BLANK | BLANK | BLANK |

FIG.7

| | 1st REEL | 2nd REEL | 3rd REEL | 4th REEL | 5th REEL |
|---|---|---|---|---|---|
| CODE | SYMBOL | SYMBOL | SYMBOL | SYMBOL | SYMBOL |
| 00 | BAR | 2BAR | BAR | 2BAR | BAR |
| 01 | BLANK | BLANK | BLANK | BLANK | BLANK |
| 02 | 7 | 7 | 7 | 7 | 7 |
| 03 | BLANK | BLANK | BLANK | BLANK | BLANK |
| 04 | 3BAR | 3BAR | 3BAR | 3BAR | 3BAR |
| 05 | BLANK | BLANK | BLANK | BLANK | BLANK |
| 06 | BONUS | BONUS | BONUS | BONUS | BONUS |
| 07 | BLANK | BLANK | BLANK | BLANK | BLANK |
| 08 | 2BAR | BAR | 2BAR | BAR | 2BAR |
| 09 | BLANK | BLANK | BLANK | BLANK | BLANK |
| 10 | 3BAR | 3BAR | CHANCE | 3BAR | 3BAR |
| 11 | BLANK | BLANK | BLANK | BLANK | BLANK |
| 12 | 2BAR | BAR | 2BAR | BAR | 2BAR |
| 13 | WILD | WILD | WILD | WILD | WILD |
| 14 | WILD | WILD | WILD | WILD | WILD |
| 15 | WILD | WILD | WILD | WILD | WILD |
| 16 | 2BAR | BAR | 2BAR | BAR | 2BAR |
| 17 | BLANK | BLANK | BLANK | BLANK | BLANK |
| 18 | BAR | 2BAR | BAR | 2BAR | BAR |
| 19 | BLANK | BLANK | BLANK | BLANK | BLANK |
| 20 | 7 | 7 | 7 | 7 | 7 |
| 21 | BLANK | BLANK | BLANK | BLANK | BLANK |

FIG.15

| | 1st REEL | 2nd REEL | 3rd REEL | 4th REEL | 5th REEL |
|---|---|---|---|---|---|
| CODE | RANDOM NO. | RANDOM NO. | RANDOM NO. | RANDOM NO. | RANDOM NO. |
| 00 | 0~NU1A | 0~NU2A | 0~NU3A | 0~NU4A | 0~NU5A |
| 01 | NL1A~NU1B | NL2A~NU2B | NL3A~NU3B | NL4A~NU4B | NL5A~NU5B |
| 02 | NL1B~NU1C | NL2B~NU2C | NL3B~NU3C | NL4B~NU4C | NL5B~NU5C |
| 03 | NL1C~NU1D | NL2C~NU2D | NL3C~NU3D | NL4C~NU4D | NL5C~NU5D |
| 04 | NL1D~NU1E | NL2D~NU2E | NL3D~NU3E | NL4D~NU4E | NL5D~NU5E |
| 05 | NL1E~NU1F | NL2E~NU2F | NL3E~NU3F | NL4E~NU4F | NL5E~NU5F |
| 06 | NL1F~NU1G | NL2F~NU2G | NL3F~NU3G | NL4F~NU4G | NL5F~NU5G |
| 07 | NL1G~NU1H | NL2G~NU2H | NL3G~NU3H | NL4G~NU4H | NL5G~NU5H |
| 08 | NL1H~NU1I | NL2H~NU2I | NL3H~NU3I | NL4H~NU4I | NL5H~NU5I |
| 09 | NL1I~NU1J | NL2I~NU2J | NL3I~NU3J | NL4I~NU4J | NL5I~NU5J |
| 10 | NL1J~NU1K | NL2J~NU2K | NL3J~NU3K | NL4J~NU4K | NL5J~NU5K |
| 11 | NL1K~NU1L | NL2K~NU2L | NL3K~NU3L | NL4K~NU4L | NL5K~NU5L |
| 12 | NL1L~NU1M | NL2L~NU2M | NL3L~NU3M | NL4L~NU4M | NL5L~NU5M |
| 13 | NL1M~NU1N | NL2M~NU2N | NL3M~NU3N | NL4M~NU4N | NL5M~NU5N |
| 14 | NL1N~NU1O | NL2N~NU2O | NL3N~NU3O | NL4N~NU4O | NL5N~NU5O |
| 15 | NL1O~NU1P | NL2O~NU2P | NL3O~NU3P | NL4O~NU4P | NL5O~NU5P |
| 16 | NL1P~NU1Q | NL2P~NU2Q | NL3P~NU3Q | NL4P~NU4Q | NL5P~NU5Q |
| 17 | NL1Q~NU1R | NL2Q~NU2R | NL3Q~NU3R | NL4Q~NU4R | NL5Q~NU5R |
| 18 | NL1R~NU1S | NL2R~NU2S | NL3R~NU3S | NL4R~NU4S | NL5R~NU5S |
| 19 | NL1S~NU1T | NL2S~NU2T | NL3S~NU3T | NL4S~NU4T | NL5S~NU5T |
| 20 | NL1T~NU1U | NL2T~NU2U | NL3T~NU3U | NL4T~NU4U | NL5T~NU5U |
| 21 | NL1U~NU1V | NL2U~NU2V | NL3U~NU3V | NL4U~NU4V | NL5U~NU5V |
| 22 | NL1V~LAST | NL2V~LAST | NL3V~LAST | NL4V~LAST | NL5V~LAST |

FIG.26

| | 1st REEL | 2nd REEL | 3rd REEL | 4th REEL | 5th REEL |
|---|---|---|---|---|---|
| CODE | RANDOM NO. | RANDOM NO. | RANDOM NO. | RANDOM NO. | RANDOM NO. |
| 00 | 0~CU1A | 0~CU2A | 0~CU3A | 0~CU4A | 0~CU5A |
| 01 | CL1A~CU1B | CL2A~CU2B | CL3A~CU3B | CL4A~CU4B | CL5A~CU5B |
| 02 | CL1B~CU1C | CL2B~CU2C | CL3B~CU3C | CL4B~CU4C | CL5B~CU5C |
| 03 | CL1C~CU1D | CL2C~CU2D | CL3C~CU3D | CL4C~CU4D | CL5C~CU5D |
| 04 | CL1D~CU1E | CL2D~CU2E | CL3D~CU3E | CL4D~CU4E | CL5D~CU5E |
| 05 | CL1E~CU1F | CL2E~CU2F | CL3E~CU3F | CL4E~CU4F | CL5E~CU5F |
| 06 | CL1F~CU1G | CL2F~CU2G | CL3F~CU3G | CL4F~CU4G | CL5F~CU5G |
| 07 | CL1G~CU1H | CL2G~CU2H | CL3G~CU3H | CL4G~CU4H | CL5G~CU5H |
| 08 | CL1H~CU1I | CL2H~CU2I | CL3H~CU3I | CL4H~CU4I | CL5H~CU5I |
| 09 | CL1I~CU1J | CL2I~CU2J | CL3I~CU3J | CL4I~CU4J | CL5I~CU5J |
| 10 | CL1J~CU1K | CL2J~CU2K | CL3J~CU3K | CL4J~CU4K | CL5J~CU5K |
| 11 | CL1K~CU1L | CL2K~CU2L | CL3K~CU3L | CL4K~CU4L | CL5K~CU5L |
| 12 | CL1L~CU1M | CL2L~CU2M | CL3L~CU3M | CL4L~CU4M | CL5L~CU5M |
| 13 | CL1M~CU1N | CL2M~CU2N | CL3M~CU3N | CL4M~CU4N | CL5M~CU5N |
| 14 | CL1N~CU1O | CL2N~CU2O | CL3N~CU3O | CL4N~CU4O | CL5N~CU5O |
| 15 | CL1O~CU1P | CL2O~CU2P | CL3O~CU3P | CL4O~CU4P | CL5O~CU5P |
| 16 | CL1P~CU1Q | CL2P~CU2Q | CL3P~CU3Q | CL4P~CU4Q | CL5P~CU5Q |
| 17 | CL1Q~CU1R | CL2Q~CU2R | CL3Q~CU3R | CL4Q~CU4R | CL5Q~CU5R |
| 18 | CL1R~CU1S | CL2R~CU2S | CL3R~CU3S | CL4R~CU4S | CL5R~CU5S |
| 19 | CL1S~CU1T | CL2S~CU2T | CL3S~CU3T | CL4S~CU4T | CL5S~CU5T |
| 20 | CL1T~CU1U | CL2T~CU2U | CL3T~CU3U | CL4T~CU4U | CL5T~CU5U |
| 21 | CL1U~CU1V | CL2U~CU2V | CL3U~CU3V | CL4U~CU4V | CL5U~CU5V |
| 22 | CL1V~LAST | CL2V~LAST | CL3V~LAST | CL4V~LAST | CL5V~LAST |

FIG.27

| | 1st REEL | 2nd REEL | 3rd REEL | 4th REEL | 5th REEL |
|---|---|---|---|---|---|
| CODE | SYMBOL | SYMBOL | SYMBOL | SYMBOL | SYMBOL |
| 00 | BAR | 2BAR | BAR | 2BAR | BAR |
| 01 | BLANK | BLANK | BLANK | BLANK | BLANK |
| 02 | 7 | 7 | 7 | 7 | 7 |
| 03 | BLANK | BLANK | BLANK | BLANK | BLANK |
| 04 | 3BAR | 3BAR | 3BAR | 3BAR | 3BAR |
| 05 | BLANK | BLANK | BLANK | BLANK | BLANK |
| 06 | 7 | 7 | 7 | 7 | 7 |
| 07 | BLANK | BLANK | BLANK | BLANK | BLANK |
| 08 | 2BAR | BAR | 2BAR | BAR | 2BAR |
| 09 | BLANK | BLANK | BLANK | BLANK | BLANK |
| 10 | 7 | 7 | 7 | 7 | 7 |
| 11 | BLANK | BLANK | BLANK | BLANK | BLANK |
| 12 | 2BAR | BAR | 2BAR | BAR | 2BAR |
| 13 | BLANK | BLANK | BLANK | BLANK | BLANK |
| 14 | 7 | 7 | 7 | 7 | 7 |
| 15 | BLANK | BLANK | BLANK | BLANK | BLANK |
| 16 | 2BAR | BAR | 2BAR | BAR | 2BAR |
| 17 | BLANK | BLANK | BLANK | BLANK | BLANK |
| 18 | 7 | 7 | 7 | 7 | 7 |
| 19 | BLANK | BLANK | BLANK | BLANK | BLANK |
| 20 | 7 | 7 | 7 | 7 | 7 |
| 21 | BLANK | BLANK | BLANK | BLANK | BLANK |

FIG.42

| SPINNING SPEED | SPIN TABLE |
|---|---|
| LOW SPEED (~1) | SPIN TABLE 1 |
| | SPIN TABLE 2 |
| | SPIN TABLE 3 |
| MIDDLE SPEED (1~5) | SPIN TABLE 4 |
| | SPIN TABLE 5 |
| | SPIN TABLE 6 |
| HIGH SPEED (5~) | SPIN TABLE 7 |
| | SPIN TABLE 8 |
| | SPIN TABLE 9 |

FIG.43

| NO. OF FREE ROUNDS | WEIGHT |
|---|---|
| 6 | 40 |
| 8 | 30 |
| 12 | 20 |
| 15 | 10 |

FIG.44

| STOP POSITION | WEIGHT |
|---|---|
| P1 | 40 |
| P2 | 10 |
| P3 | 10 |
| P4 | 40 |

GAMING MACHINE AND GAMING METHOD

BACKGROUND (a) Field

The present invention generally relates to a gaming machine and a gaming method.

(b) Description of the Related Art

A gaming machine executes a game to rearrange symbols, and awards a benefit to the player according to a result of the rearranged symbols. Free rounds where no coin needs to be inserted are provided as the benefic when the result satisfies a predetermined condition. The player can receive additional benefic by playing the free rounds.

However, because the fixed number of free rounds is provided to the player and the player cannot determine the number of free rounds, it is difficult for the gaming machine to attract the player's attention during a period between the trigger of the free round and the start of the free round.

SUMMARY

Aspects of the present invention provide a gaming machine and a gaming method for continuously attracting the players' attention.

According to an aspect of the present invention, a gaming machine is provided. The gamine machine includes a first display including a plurality of reels, a second display including a touch screen panel, and a controller. Each of the plurality of reels includes a plurality of symbols. The controller executes a normal round of a game to spin the reels, and triggers a chance round of the game when a result of the normal round satisfies a predetermined condition. The controller further displays a wheel and a plurality of touch areas on the second display, and the wheel includes a plurality of areas and each of the plurality of areas corresponding to a predetermined number of free rounds. When any one of the touch areas is touched and slid by a player, the controller further spin the wheel in a direction corresponding to the slid touch area, and randomly determines a number of free rounds. The controller further stops the wheel at a position of an area that corresponds to the determined number of free rounds among the plurality of areas, and provides free rounds having the determined number.

The controller may further spin the wheel at a spinning speed that corresponds to a speed that is slid by the player among a plurality of spinning speeds.

The gaming machine may further include a memory configured to store a plurality of spin table. Each of the plurality of spin table may correspond to any one of the plurality of spinning speeds and may include a plurality of numbers for the free rounds. The controller may further select a spin table that corresponds to the spinning speed of the wheel among the plurality of spinning speeds, and may randomly determine any one number from among the plurality of numbers included in the selected spin table.

Each of the plurality of areas may include a plurality of positions. The controller may further randomly determine any one position from among the plurality of positions included in the area that corresponds to the determined number of free rounds, and may stop the wheel for an indicator to indicate the determined position.

Two adjacent areas among the plurality of areas may have different numbers for free rounds. The controller may further determine a position that is nearest to a boundary of the two adjacent areas with a highest probability.

The controller may further automatically spin the wheel when a spin button is pressed by the player or an input of the player is not input.

The controller may further configured to randomly determine a direction in which the wheel spins and a spinning speed of the wheel when automatically spinning the wheel.

The controller may further start to spin the wheel when a period during which the wheel is touched and slid by the player exceeds a predetermined time.

The controller may further start to spin the wheel when the touch of the player is taken off from the second display.

The controller may further execute each free round of the game, and may end the chance round and return to the normal round when a result of the free round includes a combination of specific symbols whose number being greater than or equal to a predetermined number or a number of executed free rounds is the determined number.

According to another aspect of the present invention, a gaming method by a controller of a gaming machine is provided. The gaming machine includes a first display including a plurality of reels and a second display including a touch screen panel, and each of the plurality of reels includes a plurality of symbols. The method includes executing a normal round of a game to spin the reels, and triggering a chance round of the game when a result of the normal round satisfies a predetermined condition. The method further includes displaying a wheel and a plurality of touch areas on the second display, and the wheel includes a plurality of areas and each of the plurality of areas corresponding to a predetermined number of free rounds. The method further includes, when any one of the touch areas is touched and slid by a player, spinning the wheel in a direction corresponding to the slid touch area, and randomly determining a number of free rounds. The method further includes stopping the wheel at a position of an area that corresponds to the determined number of free rounds among the plurality of areas, and providing free rounds having the determined number.

Spinning the wheel may include spinning the wheel at a spinning speed that corresponds to a speed that is slid by the player among a plurality of spinning speeds.

The gaming machine may further include a memory configured to store a plurality of spin table. Each of the plurality of spin table may correspond to any one of the plurality of spinning speeds and includes a plurality of numbers for the free rounds. Determining the number of free rounds may include selecting a spin table that corresponds to the spinning speed of the wheel among the plurality of spinning speeds, and randomly determining any one number from among the plurality of numbers included in the selected spin table.

Each of the plurality of areas may include a plurality of positions. Stopping the wheel may include randomly determining any one position from among the plurality of positions included in the area that corresponds to the determined number of free rounds, and stopping the wheel for an indicator to indicate the determined position.

Two adjacent areas among the plurality of areas may have different numbers for free rounds. Determining the any one position may include determining a position that is nearest to a boundary of the two adjacent areas with a highest probability.

The method may further include automatically spinning the wheel when a spin button is pressed by the player or an input of the player is not input.

The method may further include randomly determining a direction in which the wheel spins and a spinning speed of the wheel when automatically spinning the wheel.

Spinning the wheel may include starting to spin the wheel when a period during which the wheel is touched and slid by the player exceeds a predetermined time.

Spinning the wheel may include starting to spin the wheel when the touch of the player is taken off from the second display.

The method may further include executing each free round of the game, and ending the chance round and returning to the normal round when a result of the free round includes a combination of specific symbols whose number being greater than or equal to a predetermined number or a number of executed free rounds is the determined number.

BRIEF DESCRIPTION OF THE DRAWINGS

FIG. 6 is an exemplary symbol code table according to an embodiment of the present invention.

FIG. 7 is another exemplary symbol code table according to an embodiment of the present invention.

FIG. 15 is an exemplary symbol code determination table according to an embodiment of the present invention.

FIG. 26 is an exemplary symbol code determination table for a chance round according to an embodiment of the present invention.

FIG. 27 is an exemplary symbol code table for a chance round according to another embodiment of the present invention.

FIG. 42 is an exemplary spinning speed table according to an embodiment of the present invention.

FIG. 43 is an exemplary spin table according to an embodiment of the present invention.

FIG. 44 is an exemplary position determination table according to an embodiment of the present invention.

DETAILED DESCRIPTION

Figure 1:
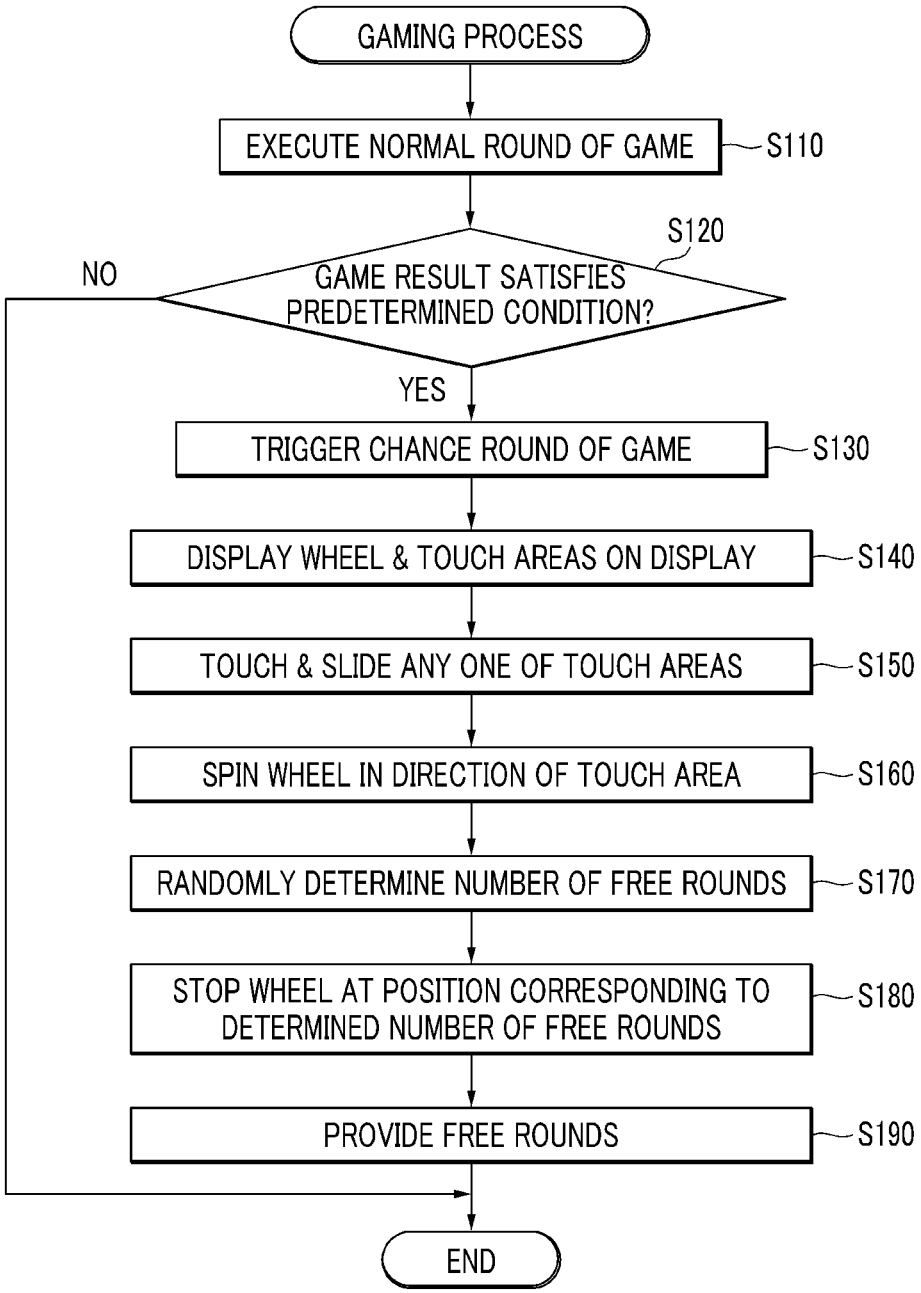
FIG. 1 is a flowchart of a gaming method according to an embodiment of the present invention.

In the following detailed description, only certain embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

A gaming machine, and a gaming method thereof according to embodiments of the present invention are described in detail with reference to the accompanying drawings.

Outline for Gaming Method

FIG. 1 is a flowchart of a gaming method according to an embodiment of the present invention.

Referring to FIG. 1, a controller of a gaming machine executes a normal round of a game to spin a plurality of reels of a primary display (S110). When a result of the normal round satisfies a predetermined condition (S120: YES), the controller triggers a chance round of the game (S130). The result of the normal round may be a combination of symbols rearranged on the primary display, and the predetermined condition may be an appearance of predetermined symbol. If the chance round is triggered, the controller displays a wheel and a plurality of touch areas on the secondary display (S140). The wheel includes a plurality of areas, and each of the plurality of areas corresponds to a number of free rounds. When a player touches and slides any one of the touch areas (S150), the controller spins the wheel in a direction corresponding to the slid touch area (S160). The direction may be either a clockwise direction or counterclockwise direction. Further, the controller may spin the wheel at a spinning speed that corresponds to a speed that is slid by the player among a plurality of spinning speeds. The controller randomly determines a number of free rounds when the wheel starts to spin (S170), and stops the wheel at a position of an area that corresponds to the determined number of free rounds among the plurality of areas (S180). The controller may randomly determine any one position from among a plurality of positions included in the area that corresponds to the determined number of free rounds, and may stop the wheel for an indicator to indicate the determined position of the area that corresponds to the determined number of free rounds. Next, the controller provides free rounds having the determined number (S190).

Overall Configuration of Gaming Machine

A gaming machine according to embodiments of the present invention is described in detail.

First, a mechanical structure of a gaming machine according to embodiments of the present invention is described in detail with reference to FIG. 2 to FIG. 8.

Figure 2:
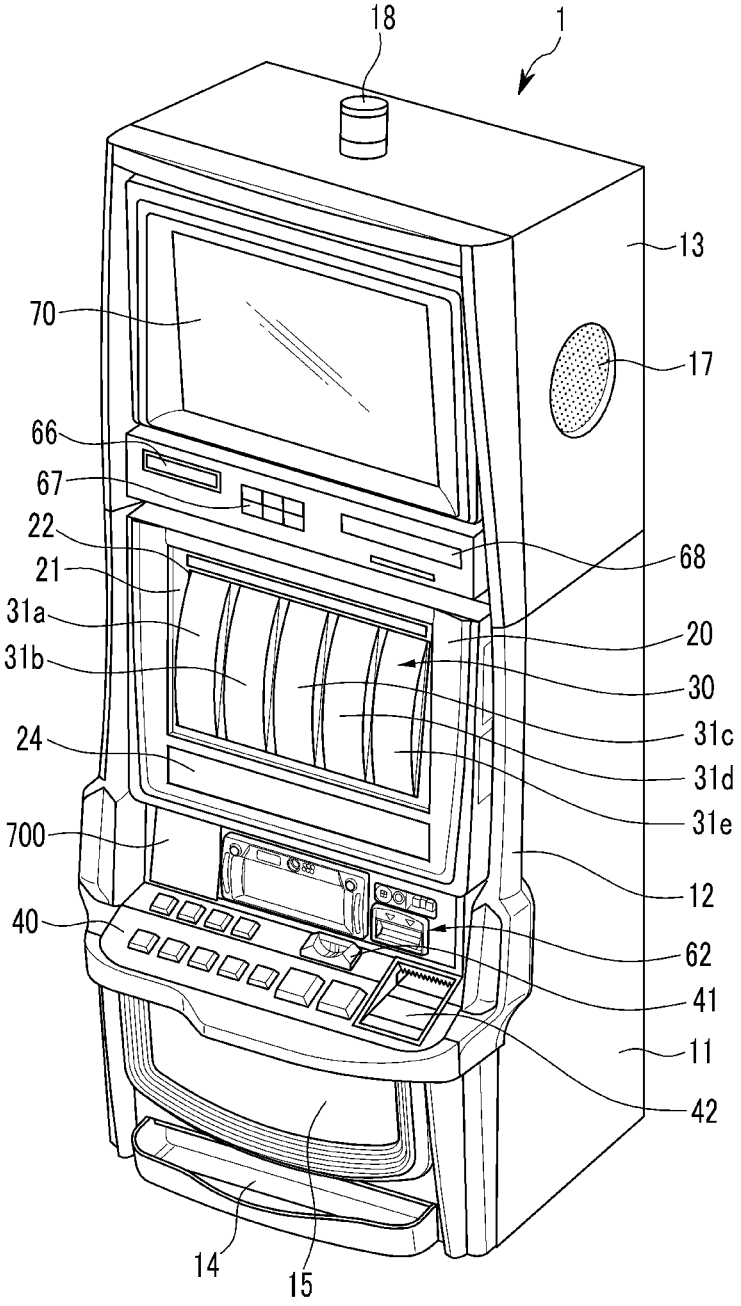
FIG. 2 is a schematic perspective view of a slot machine according to an embodiment of the present invention.
Figure 3:
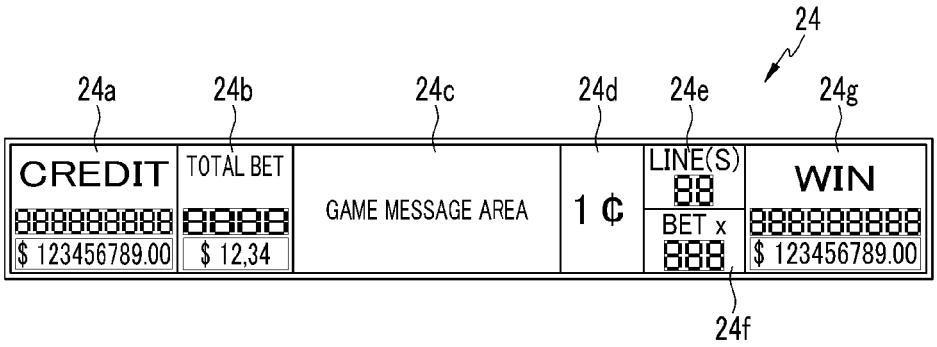
FIG. 3 is a schematic front view of a display panel of a primary display in the gaming machine shown in FIG. 2 according to an embodiment of the present invention.
Figure 4:
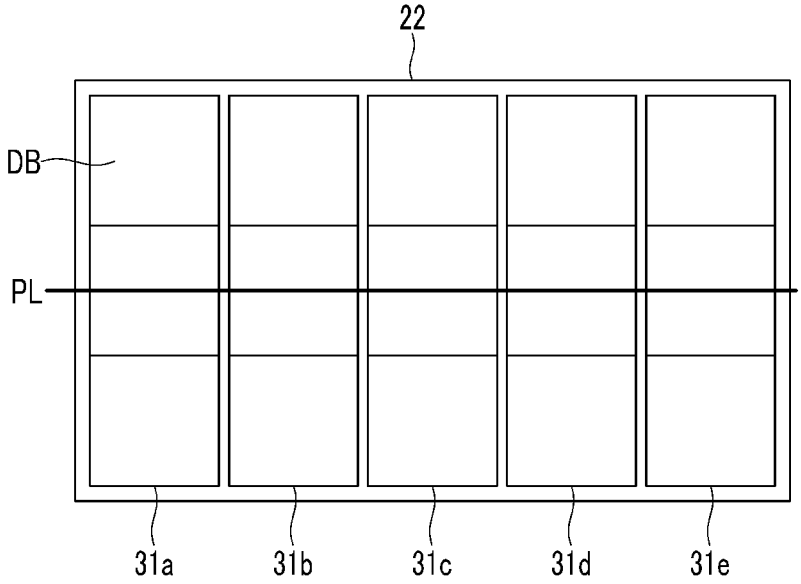
FIG. 4 is a schematic front view of a display window of a primary display in the gaming machine shown in FIG. 2 according to an embodiment of the present invention.
Figure 5:
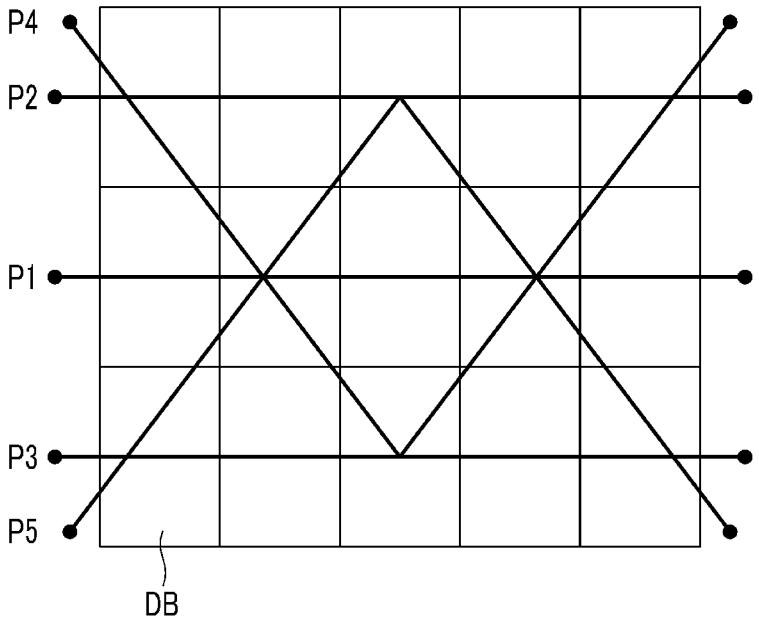
FIG. 5 is a schematic diagram showing exemplary pay-lines according to an embodiment of the present invention.
Figure 8:
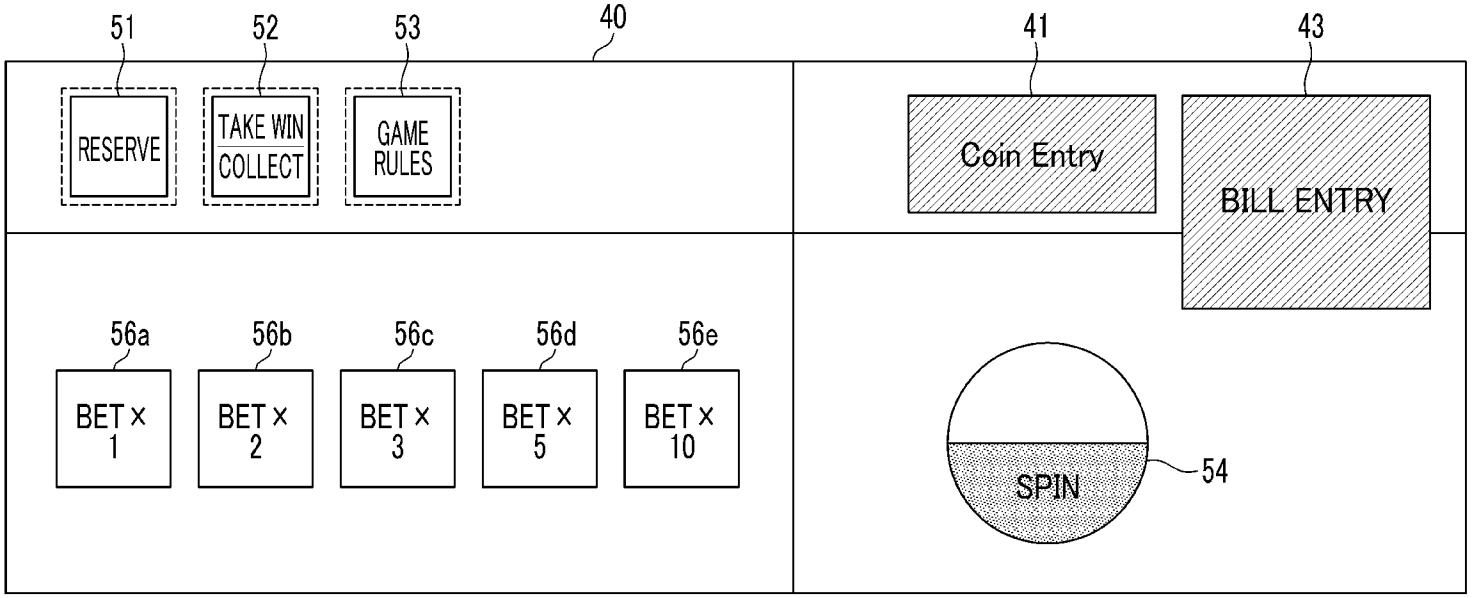
FIG. 8 is a layout view of a control panel in the gaming machine shown in FIG. 2 according to an embodiment of the present invention.

FIG. 2 is a schematic perspective view of a gaming machine according to an embodiment of the present invention, FIG. 3 is a schematic front view of a display panel of a primary display in the gaming machine shown in FIG. 2 according to an embodiment of the present invention, FIG. 4 is a schematic front view of a display window of a primary display in the gaming machine shown in FIG. 2 according to an embodiment of the present invention, FIG. 5 is a schematic diagram showing exemplary paylines according to an embodiment of the present invention, FIG. 6 and FIG. 7 are exemplary symbol code tables according to an embodiment of the present invention, and FIG. 8 is a layout view of a control panel in the gaming machine shown in FIG. 2 according to an embodiment of the present invention.

Referring to FIG. 2, a gaming machine, for example, a slot machine 1 may include a cabinet 11, a top box 13 disposed on the cabinet 11, and a main door 12 disposed in front of the cabinet 11.

A primary display 20 including a reel assembly 30 is provided in the main door 12. According to an embodiment of the present embodiment, the reel assembly 30 may include five reels 31*a* to 31*e*. Each of the reels 31*a* to 31*e* may include a drum (not shown) that has a peripheral surface bearing plural types of symbols. The primary display 20 further includes a reel cover 21 disposed in front of the reel assembly 30 and having a display window 22 that exposes a portion of the reels 31*a* to 31*e*. The reel cover 21 is provided with a display panel 24 that may include a transparent liquid crystal display panel (not shown).

The primary display 20 further includes a display panel 24 provided below the reel assembly 30. The display panel 24 notifies a player of information related to a game. Referring to FIG. 3, the display panel 24 includes a credit area 24*a*, a total bet area 24*b*, a game message area 24*c*, a denomination area 24*d*, a line area 24*e*, a bet area 24*f*, and a win area 24*g*. The credit area 24*a* operates as a credit meter and displays a credit amount of the player. The credit amount indicates the number of credits that are owned by the player and deposited inside the gaming machine 1. The total bet area 24*b* operates as a total bet meter and displays a betting amount that is wagered by the player in a current game. The game message area 24*c* displays various game messages related to the game, and the denomination area 24*d* displays a denomination, for example 1¢, of a minimum credit that can be wagered by the player. The line area 24*e* displays the number of paylines selected by the player in the current game, and the bet area 24*f* displays a multiplier (BET×N) determined by the total bet. The win area 24*g* operates as a win amount meter and displays a payout amount. The payout amount indicates the number of credits to be paid out to the player when a winning combination is established. The display panel 24 may include a flat panel display, for example, a vacuum fluorescent display (VFD), a liquid crystal display (LCD), an organic light emitting display (OLED), a plasma display panel (PDP), and so on.

Referring to FIG. 4, a given number of symbols, for example, three symbols on each of the reels 31*a* to 31*e* may be shown on the display window 22 when the reels 31*a* to 31*e* are at rest. Therefore, a symbol matrix including five columns and three rows is shown on the display window 22, where a pair of a column and a row define a symbol block DB.

FIG. 4 also shows an exemplary payline PL that may be defined on the display window 22 and may pass through a symbol block DB in each column. When a combination of the symbols on the payline PL in a game satisfies a predetermined condition, a player wins the game. For example, if all the symbols in a combination are the same, the gaming machine 1 awards a win (i.e., prize) to the player. Such a combination of the symbols that provides a win is referred to as a "winning combination." The payline PL shown in FIG. 4 is merely an example, and various paylines may be drawn and two or more paylines may be selected by a player.

FIG. 5 shows a variety of paylines PL1 to PL5. An exemplary play line P1, P2 or P3 shown in FIG. 5 connects five blocks in the second, first, or third row, respectively, and another exemplary payline P4 shown in FIG. 5 connects an upper block in the first column, a middle block in the second column, a lower block in the third column, a middle block in the fourth column, and an upper block in the fifth column. Another exemplary payline P5 shown in FIG. 5 connects a lower block in the first column, the middle block in the second column, an upper block in the third column, the middle block in the fourth column, and a lower block in the fifth column.

In addition to a win with the payline PL (referred to as a "line win"), there may be another type of win referred to as "scatter win" that is given when at least one scatter symbol among the plural types of the symbols is shown on the display window 22.

Referring to FIG. 6, a symbol sequence including a plurality of symbols is marked on each of the reels 31*a* to 31*e*. Each symbol in the symbol sequence may be assigned to a code, and may include a picture (hereinafter referred to as "a picture symbol") or may include no picture (hereinafter referred to as "a blank symbol"). The picture symbols may include symbols denoted by, for example, "7," "BAR," "DOUBLE BAR," or "TRIPLE BAR," a scatter symbol. The scatter symbol may include a "BONUS" symbol and a "CHANCE" symbol. For example, the symbol sequence may include eleven picture symbols and eleven blank symbols each being located between adjacent two picture symbols. Codes ranging from "00" to "21" may be assigned to the eleven picture symbols and the eleven blank symbols. In an example symbol code table shown in FIG. 6, the "BAR," blank, "7," blank, "TRIPLE BAR," blank, "BAR," blank, "DOUBLE BAR," blank, "TRIPLE BAR," blank, "DOUBLE BAR," blank, "7," blank, "DOUBLE BAR," blank, "BAR," blank, "7," and blank symbols to which the codes from "00" to "21 are respectively assigned are marked on the first reel 31*a* (reel 1). In an example symbol code table shown in FIG. 7, the "BAR," blank, "7," blank, "TRIPLE BAR," blank, "BONUS," blank, "DOUBLE BAR," blank, "TRIPLE BAR," blank, "DOUBLE BAR," blank, "7," blank, "DOUBLE BAR," blank, "BAR," blank, "7," and blank symbols to which the codes from "00" to "21 are respectively assigned are marked on the first reel 31*a* (reel 1). Further, as shown in FIG. 6 and FIG. 7, "CHANCE" symbol may be marked on only the third reel 31*c* (reel 3). A gaming machine spins the reels 31*a* to 31*e* according to a player's input, and randomly determines a code for each of the reels 31*a* to 31*e*. After a certain time period elapses, the gaming machine stops each of the reels 31*a* to 31*e* to locate the symbol corresponding to the determined code at one row (for example, the middle row) of the symbol matrix. Accordingly, the symbols are rearranged in the symbol matrix.

When three or more symbols of the same rank are continuously arranged on the payline starting from the first reel 31*a*, a winning combination may be established. The same symbols have the same rank, and "BAR," "DOUBLE BAR," and "TRIPLE BAR" symbols have the same rank. Accordingly, when three or more "7" symbols are continuously arranged on the payline starting from the first reel 31*a*, a winning combination for the "7" symbol is be established. When three or more "BAR," "DOUBLE BAR," and/or "TRIPLE BAR" symbols are continuously arranged on the payline starting from the first reel 31*a*, a winning combination for the "BAR," "DOUBLE BAR," or "TRIPLE BAR" symbols is established. Further, when two or more "BONUS" symbols are arranged on any two or more reels regardless of the payline, a winning combination for the "BOUNS" symbol may be established. Further, when the "CHANCE" symbol is arranged on the third reel 31*c* in a normal round of a game, a chance round of the game may be triggered. The chance round may include a plurality of free rounds. Each free round may be executed without actual betting of the player (i.e., without reducing credits of the player), and the betting amount used for determining a win of the free round may be that of the normal round that has triggered the chance round. A normal round of a game may be referred to as "a normal game," a chance round of a game may be referred to as "a chance game," and a free round of a game may be referred to as "a free game."

Although the gaming machine 1 employs the mechanical reels 31*a* to 31*e* in the present embodiment, video reels or a combination of the mechanical reels and the video reels may be used as well, alternatively.

An IC card reader 62 is disposed below the primary display 20. The IC card reader 62 receives an IC card which stores predetermined data such as player identification information and game log data related with the games previously played by the player. Also, the IC card may store data equivalent to coins, bills, or credits owned by the player. The IC card reader 62 reads and writes data from and to the inserted IC card. The IC card reader 62 includes an LCD for displaying the data read from the IC card.

In front of a lower end of the IC card reader 62 are provided a control panel 40, on which includes various buttons, a coin entry 41, and a bill entry 43. For example, referring to FIG. 8, a RESERVE button 51, a COLLECT button 52, and a GAME RULES button 53 are disposed on an upper left area of the control panel 40. 1-BET button 56*a*, 2-BET button 56*b*, 3-BET button 56*c*, 5-BET button 56*d*, and 10-BET button 56*e* are disposed on a lower left area of the control panel 40. Also, a SPIN button 54 is disposed on the lower center area of the control panel 40. The coin entry 41 is disposed upper center area, and the bill entry 43 is disposed right area of the control panel 40.

The RESERVE button 51 is used when the player temporarily leaves the seat or when the player wants to ask a staff of the game facility to exchange money. Alternatively, the RESERVE button 51 may be used to store remaining credits into an IC card inserted into the IC card reader 62. The COLLECT button 52 is used to instruct the slot machine 1 to pay out credited coins to a coin tray 15. The GAME RULES button 53 is used when the player is not acquainted with game rules or manipulation method. When the GAME RULES button 33 is pressed, various types of help information are displayed on a secondary display 70.

The BET buttons 56*a* to 56*e* are used to set the betting amount. Each time the 1-BET button 56*a* is pressed, one credit is bet for each active pay line from the current credits owned by the player. When the 2-BET button 56*b* is pressed, the game is started on condition that two credits are bet for each active pay line. When the 3-BET button 56*c* is pressed, the game is started on condition that three credits are bet for each active pay line. When the 5-BET button 56*d* is pressed, the game is started on condition that five credits are bet for each active pay line. When the 10-BET button 56*e* is pressed, the game is started on condition that ten credits are bet for each active pay line. The SPIN button 54 is used to instruct the initiation of spinning the reels 31*a* to 31*e* under the previously set betting condition.

The coin entry 41 receives coins and guides the inserted coins into a hopper inside the cabinet 11. The bill entry 43 receives a bill and validates the legitimacy of the inserted bill to accept only a legitimate bill into the cabinet 11.

On a lower front face of the main door 13 and below the control panel 40, there are provided a belly glass 14 on which a character of the slot machine 1 or the like is drawn, and a coin tray 15 receiving coins paid out from the cabinet 11.

Referring back to FIG. 2, a secondary display 70 includes a display panel having a touch screen panel. The display panel may include a flat panel display, for example, an LCD, an OLED, a PDP, and so on. Further, the display panel may be a touch panel. However, embodiments are not limited thereto. The touch screen panel is a device that allows the gaming machine 1 to perform a desired command when the player's finger draws a picture or a line or touches an icon on a screen. The secondary display 70 determines when the player's finger touches the screen and determines touch position information thereof. A plurality of sensing units may be arranged in an approximate matrix form on the touch screen panel, and each sensing unit allows the secondary display 70 to determine when the player's finger touches the screen and the touch position by detecting the change in capacitance or pressure that is generated as the player's finger touches the touch screen panel. Further, the secondary display 70 may provide rendering effect for enhancing the amusement of the game, and displays information of game rules and manipulation methods. Also, a speaker 17 and a lamp 18 are provided on the side and top faces, respectively, of the top box 13. The slot machine 1 augments the amusement of the game by providing sound effect or flashing light through the speaker 17 or the lamp 18, respectively.

Below the secondary display 70, there are provided a ticket printer 66, a keypad 67, and a data display 68.

The ticket printer 66 prints, on a ticket, a bar code containing the credit data, date and time, and an ID number of the slot machine 1 to output the barcode imprinted ticket. The player can exchange the barcode imprinted ticket with bills or the like at a predetermined location of a gaming facility (e.g., from a cashier in a casino).

The keypad 67 includes a plurality of keys allowing the player to input instructions pertinent to the issuance of the ticket. The data display 68, which is implemented using a fluorescent display, LEDs, or the like, displays data input by the player through the keypad 67.

Configuration of Primary Display

A primary display 20 of the gaming machine 1 shown in FIG. 2 is described in detail with reference to FIG. 9 and FIG. 10.

Figure 9:
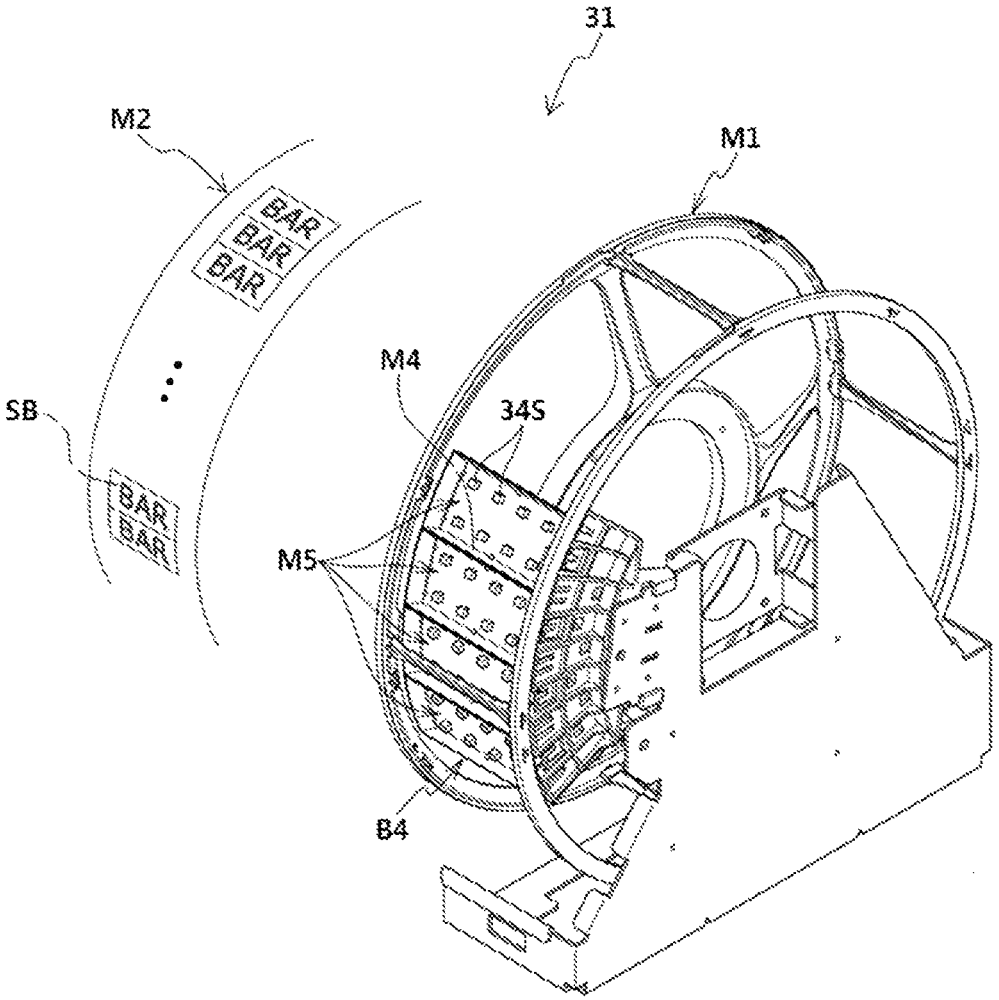
FIG. 9 is a schematic perspective view of an exemplary reel of a reel assembly shown in FIG. 2 according to an embodiment of the present invention.
Figure 10:
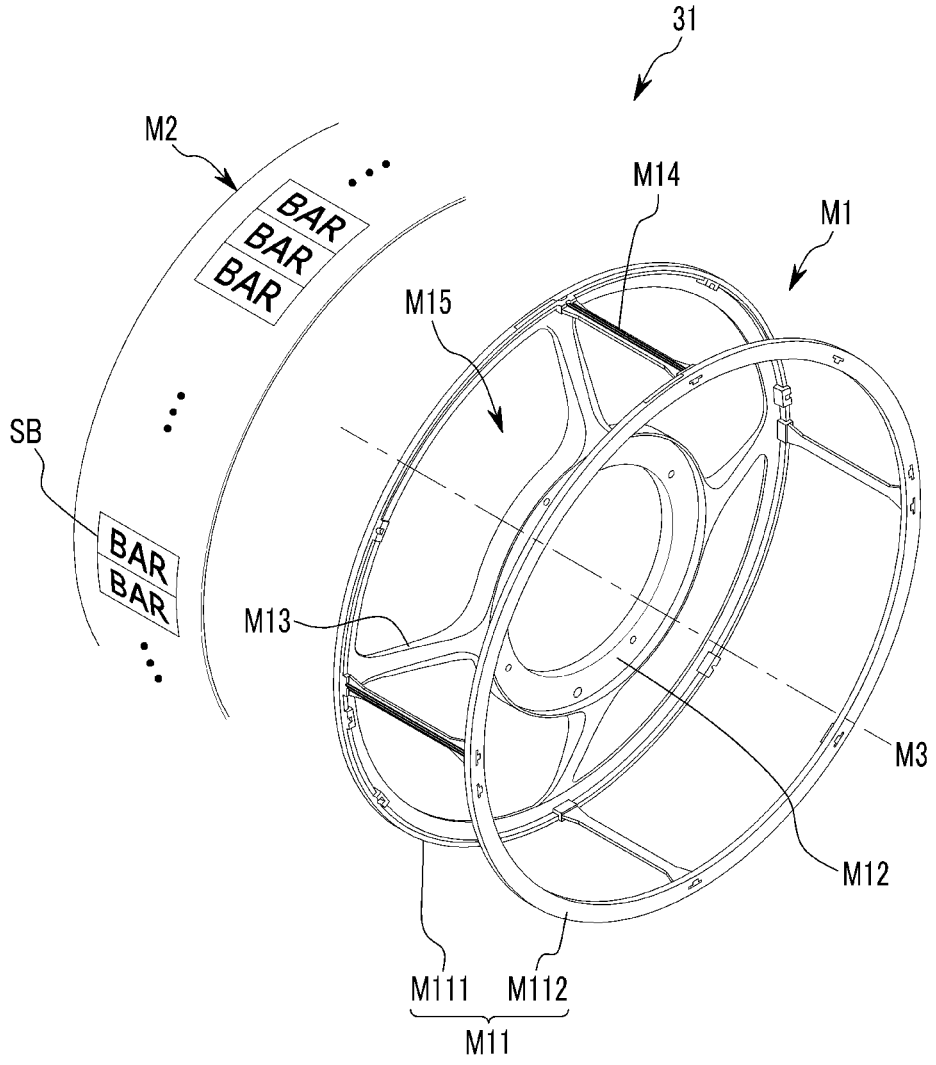
FIG. 10 is a schematic exploded perspective view of an exemplary reel of a reel assembly shown in FIG. 2 according to an embodiment of the present invention.

FIG. 9 is a schematic perspective view of an exemplary reel of a reel assembly shown in FIG. 2 according to an embodiment of the present invention, and FIG. 10 is a schematic exploded perspective view of an exemplary reel of a reel assembly shown in FIG. 2 according to an embodiment of the present invention.

Referring to FIG. 9, the reels 31*a* to 31*e* of a reel assembly 30 included in a primary display 20 have substantially equal diameters and are arranged in a coaxial manner such that they can rotate or spin around a common rotational axis. One reel 31 of the reels 31*a* to 31*e* is shown in FIG. 9 for easy description. The reels 31*a* to 31*e* may be configured to rotate individually. Although the number of the reels 31*a* to 31*e* is five in this embodiment, but it is not limited thereto.

A symbol sequence including a plurality of symbols SB is marked on each of the reels 31*a* to 31*e*. The symbol sequence may be determined by a symbol code table shown in FIG. 6. The reel assembly 30 further includes a backlight unit 34 that illuminate the symbols SB.

Referring to FIG. 9 and FIG. 10, each of the reels 31*a* to 31*e* includes a reel frame M1 and a reel stripe M2 disposed on an entire outer circumference of the reel frame M1. The plurality of symbols SB of the symbol sequence is marked on the reel stripe M2. The reel frame M1 may receive rotational force from a rotational axis of a motor (not shown) to rotate a central axis M3.

The reel frame M1 includes a rim M11, a herb M12, a plurality of spokes M13, and a plurality of connecting rods M14.

The rim M11 includes a pair of circular loops M111 and M112 that are arranged substantially parallel to each other along the central axis M3 and are spaced apart from each other by a substantially uniform distance.

The herb M12 has a shape of a ring, and is disposed at a center of one M111 of the two loops M111 and M112 in a coaxial manner. The herb M12 and the loop M111 are connected by the spokes M13. The herb M12 may transmit the rotational force from the motor to the rim M11.

The connecting rods M14 are connected between the pair of loops M111 and M112 such that they keep the distance between the pair of loops M111 and M112. The connecting rods M14 are arranged substantially in parallel along a circumference of the rim M11. The connecting rods M14 and the rim M11 form a plurality of rectangle-like openings M15.

The backlight unit 34 includes a plurality of light sources 34*s* such as light emitting diodes (LEDs), and the light sources 34*s* are partitioned by a plurality of partitions M4. Each of a plurality of lighting areas M5 defined by the partitions M4 corresponds to a symbol SB on a reel stripe M2.

Electrical Configuration of Slot Machine

Now, electrical structure of the slot machine 1 shown in FIG. 2 is described in detail with reference to FIG. 11 to FIG. 13.

Figure 11:
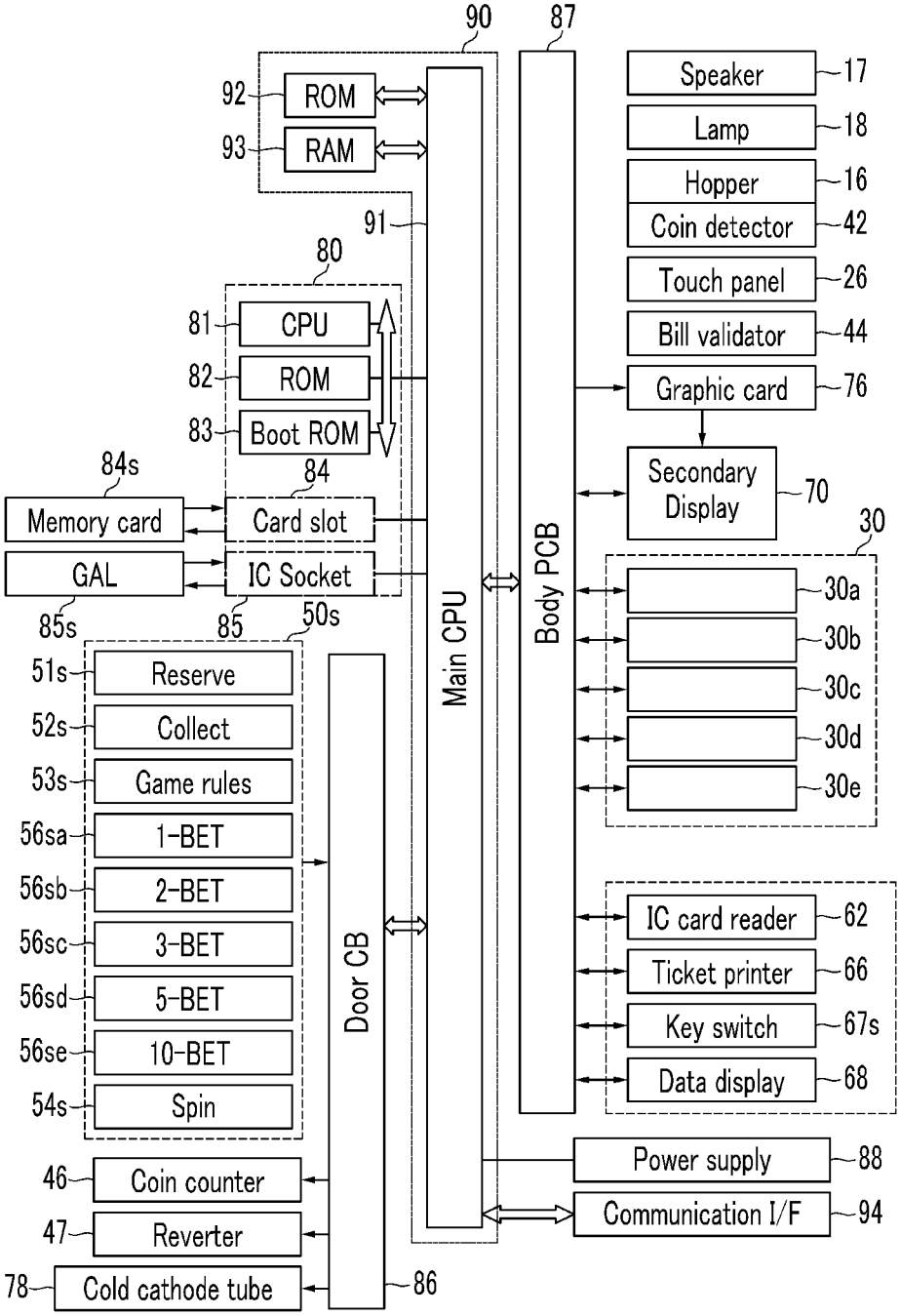
FIG. 11 is an electrical block diagram of the slot machine shown in FIG. 2 according to an embodiment of the present invention.
Figure 12:
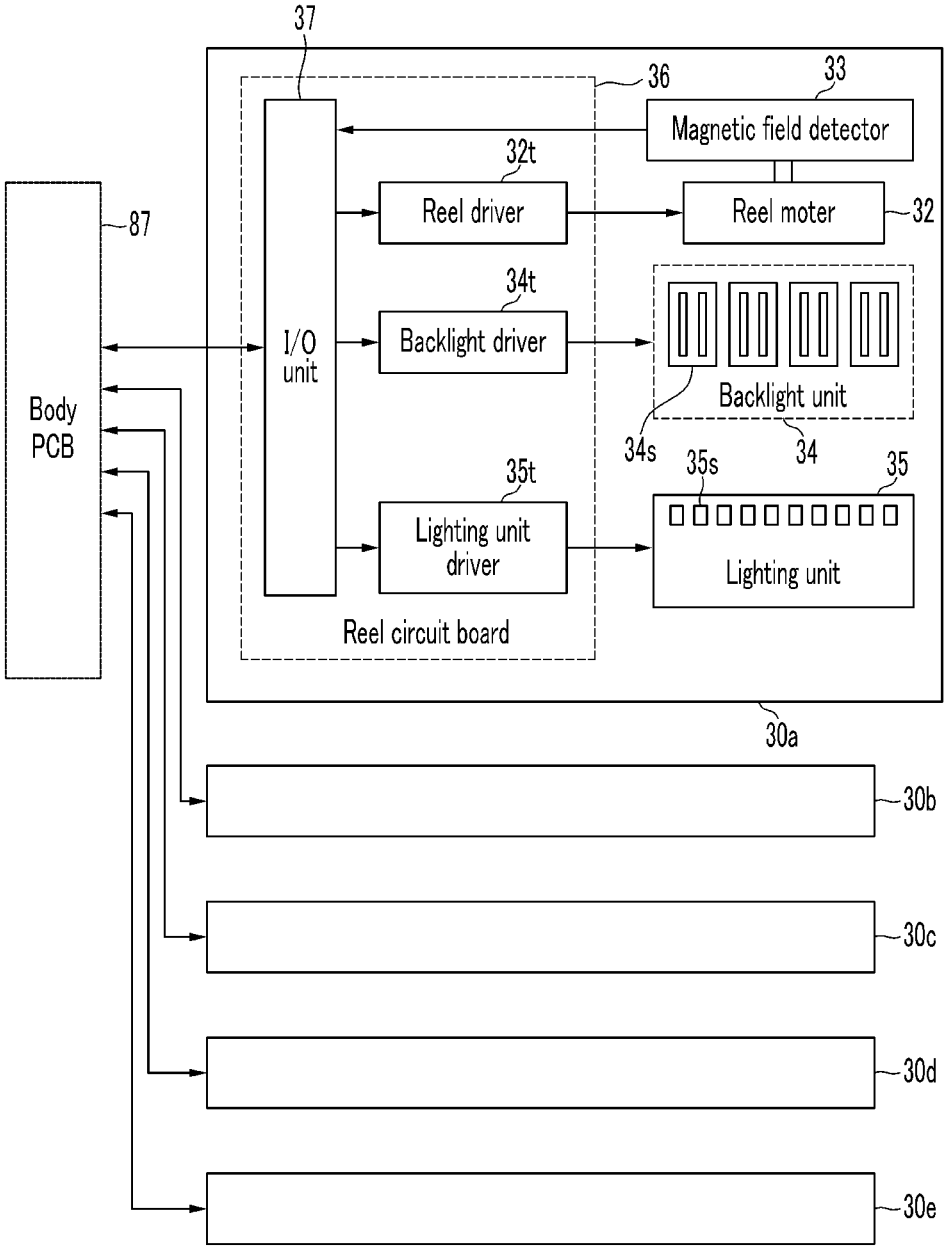
FIG. 12 is a block diagram of an electrical circuit of the reel assembly according to an embodiment of the present invention.
Figure 13:
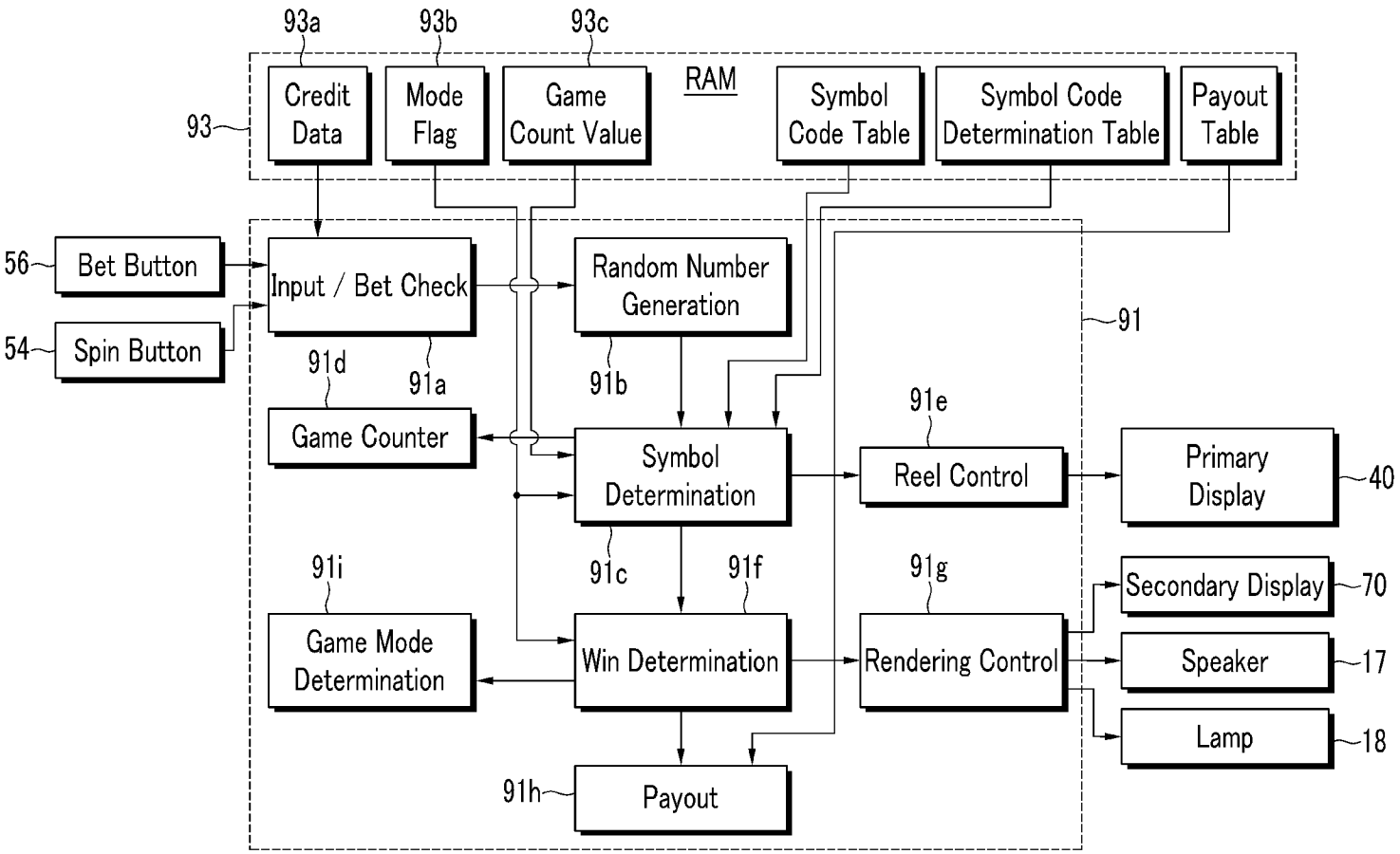
FIG. 13 is a functional block diagram of the game program executed by a main CPU of a motherboard in the slot machine shown in FIG. 2 according to an embodiment of the present invention.

FIG. 11 is an electrical block diagram of the slot machine shown in FIG. 2 according to an embodiment of the present invention, FIG. 12 is a block diagram of an electrical circuit of the reel assembly according to an embodiment of the present invention, and FIG. 13 is a functional block diagram of the game program executed by a main CPU of a motherboard in the slot machine shown in FIG. 2 according to an embodiment of the present invention.

Referring to FIG. 11, the gaming machine 1 includes a gaming board 80, a motherboard 90, and a door PCB 86, and a body PCB 87.

A gaming board 80 includes a CPU 81, a ROM 82 accessible by the CPU 81 through an internal bus, and a boot ROM 83 accessible by the CPU 81 by an internal bus. The gaming board 80 additionally includes a card slot 84 which can receive and communicate with a memory card 84*s*, and an IC socket 85 provided correspondingly to a Generic Array Logic (GAL) 85*s*.

The memory card 84*s* includes a non-volatile memory and stores a game program and a game system program.

The card slot 84 is configured to receive and eject the memory card 84*s*, and is connected to a motherboard 90 by an IDE bus. The details of the game performed in the slot machine 1 can be changed by replacing the memory card 84*s* with another one, or by withdrawing the memory card 84*s* from card slot 84, writing another program into the memory card 84*s*, and then inserting the memory card 84*s* into the card slot 84 again.

The GAL 85*s*, which is a type of a Programmable Logic Device (PLD) having a fixed OR array structure, has a plurality of input ports and output ports. When the GAL 85*s* receives certain data through the input ports, it outputs data corresponding to the input data through the output ports.

The IC socket 85 is configured in such a manner that the GAL 85*s* can be inserted into the IC socket 85 or detached from the IC socket 85, and connected to a motherboard 90 by a PCI bus.

The CPU 81, the ROM 82, and the boot ROM 83 interconnected by the internal bus are connected to the motherboard 90 by the PCI bus. The PCI bus enables signal transmission between the motherboard 90 and the gaming board 80, and supply of power from the motherboard 90 to the gaming board 80.

The ROM 82 stores an authentication program. The boot ROM 83 stores a preliminary authentication program, a boot code to be used by the CPU 81 for activating the preliminary authentication program, and the like. The authentication program is a tamper check program for authenticating the originality of the game program and the game system program. The preliminary authentication program is a program for authenticating the originality of the authentication program. The authentication program and the preliminary authentication program are written in a sequence of proving that the subject program has not been tampered.

The motherboard 90, which may be implemented using a commonly available general main board, executes the game program and the game system program. The motherboard 90 includes a main CPU 91, a ROM 92, a RAM 93, and a communication interface 94.

The ROM 92, which may be a flash memory, may be configured to store a program to be executed by the main CPU 91 such as BIOS, along with another data to be maintained permanently. When being executed by the main CPU 91, the BIOS performs initialization of peripheral devices. Also, the BIOS starts to load the game program and the game system program stored in the memory card 54 through the gaming board 80. The ROM 92 may be rewritable. However, write-protected one might be used as the ROM 92 as well.

The RAM 93 stores data and programs which are used during the operation of the main CPU 91. For example, when the game program, the game system program, or the authentication program is to be loaded, the RAM 93 can store such programs. Also, the RAM 93 is provided with working space for the execution of the programs. Examples of the space include a space for storing the number of bets, the payout amount, the credit amount, and the like can be maintained during the execution of the game. Also, plurality of tables defining symbols, symbol codes, winning combinations, and their probabilities are maintained during the execution of the game. Further, the RAM 93 stores symbol code determination tables which stores mapping information between symbol codes and random number which can used for determining symbols based on random numbers. In particular, the RAM 93 maintains a mode flag indicating the gaming mode, along with a game and a game counter of which count value indicates the number of executed chance games or the number of possibly remaining chance games.

Also, the RAM 93 stores count values of a plurality of counters, which include a bet counter, a payout amount counter, a credit amount counter, and a chance game counter which counts the number of chance games. Alternatively, however, some of the count values can be maintained in an internal register of the main CPU 91.

The communication interface 94 facilitates data communication of the main CPU 91 with an external controller of, for example, a server through a communication channel.

Besides, the motherboard 90 is connected to the door PCB 86 and the body PCB 87 by USB communications. The motherboard 90 is also connected to a power supply 88. The main CPU 91 of the motherboard 90 boots up and operates using the power supplied from the power supply 88, and passes over some of the power to the gaming board 80 through the PCI bus so as to boot up the CPU 81. The door PCB 86 and the body PCB 87 are connected to input devices such as a switch and a sensor, and peripheral devices of which operation are controlled by the main CPU 91. Also, the door PCB 86 is connected with a control panel 40, a coin counter 46, a reverter 47, and a cold cathode tube 78.

The control panel 40 has a reserve switch 51*s*, a collect switch 52*s*, a game rule switch 53*s*, a spin switch 54*s*, a 1-BET switch 56 as, a 2-BET switch 56*bs*, a 3-BET switch 56*cs*, a 5-BET switch 56*ds*, and a 10-BET switch 56*es*, each of which is provided correspondingly to respective buttons 51 to 54 and 56*a* to 56*e*. The switches 51*s* to 54*s* and 56*as* to 56*es* detects pressing of the respective buttons 51 to 54 and 56*a* to 56*e* to output signals to the main CPU 91.

The coin counter 46 and the reverter 47 are disposed in the coin entry 41. The coin counter 46 validates legitimacy of coins inserted into the coin entry 41 in terms of material, shape, or the like. The coin counter 46 outputs a signal to the main CPU 91 when detecting a legitimate coin. Meanwhile, illegitimate coins are discharged to the coin tray 15. The reverter 47, which operates based upon a control signal from the main CPU 91, distributes the legitimate coins validated by the coin counter 46 into either a hopper 16 or a cash box (not shown in the drawing). The coins are guided into the hopper 16 when the hopper 16 is not filled with coins. Contrarily, however, the coins are guided into the cash box when the hopper 16 is filled with coins.

The cold cathode tube 78, which is disposed on the rear face of the secondary display 70, functions as a backlight and illuminates based on a control signal from the main CPU 91.

The body PCB 87 is connected with the speaker 17, the lamp 18, the hopper 16, a coin detector 42, the touch panel 26, a bill validator 44, the reel assembly 30, the IC card reader 62, a graphic card 76, the ticket printer 66, a key switch 67*s*, and the data display 68.

The lamp 18 flashes based upon a control signal from the main CPU 91. The speaker 17 outputs a sound such as BGM based upon the control signal from the main CPU 91.

The hopper 16, which operates based upon a control signal from the main CPU 91, pays out coins of the designated payout amount to the coin tray 15 through a coin payout exit formed between the belly glass 14 and the coin tray 15. The coin detector 42 detects coins paid out from the hopper 16 to output a detection signal to the main CPU 91.

The touch panel 26 detects a position touched by the player to provide the main CPU 91 with a position sense signal corresponding to the detected position. The bill validator 44 in the bill entry 43 provides, upon detection of a legitimate bill, the main CPU 91 with a bill detection signal corresponding to the bill amount.

The graphic card 76 controls video display of the secondary display 70 and the display panel 24 of the primary display 20 in response to a control signal from the main CPU 91. The graphic card 76 includes a Video Display Processor (VDP) generating video data, and a video RAM temporarily storing the video data. The video data may be originated from the game program stored in the RAM 93.

The IC card reader 62 reads out data stored in the IC card inserted into the card slot 176 to provide the read-out data to the main CPU 91. Also, the IC card reader 62 writes data received the main CPU 91 into the ID card.

The ticket printer 66 prints on a ticket the barcode containing information of the credit amount stored in the RAM 93, date and time, the identification number of the slot machine 1, and the like, in response to the control signal from the main CPU 91 to output the barcode imprinted ticket.

The key switch 67*s*, which is disposed behind the keypad 67, outputs a key detection signal to the main CPU 91 when the keypad 67 is pressed by the player.

The data display 68 displays information related the input through the keypad 67 in response to a control signal from the main CPU 91.

The body PCB 87 is also electrically connected to the reel assembly 30, which includes first to fifth reel units 30*a* to 30*e*, each of the reel unit 30*a* to 30*e* including the reels 31*a* to 31*e*, respectively.

Referring to FIG. 12, each of the reel units 30*a* to 30*e* includes a reel circuit board 36. The reel circuit board 36 includes an input/output (I/O) unit 37 capable of communicating with the body PCB 87, a reel driver 32*t* connected to the I/O unit 37, a backlight driver 34*t*, and a lighting unit driver 35*t*.

To the I/O unit 37 is connected a magnetic field detector 33, which includes a magnetic sensor for sensing magnetic field intensity to output a magnetic detection signal proportional to the magnetic field intensity, and sensor fixation means for fixing the magnetic sensor to a predetermined position. The magnetic sensor detects the intensity of the magnetic field generated by a magnet which is connected to a rotating axis of a reel motor 32 to rotate with the reel 31*a*.

The reel driver 32*t* supplies electric power to the reel motor 32. The backlight driver 34*t* supplies electric power individually to each light source 34*s* in a backlight unit 34. The lighting unit driver 35*t* supplies electric power individually to each light source 35*t* of a lighting unit 35.

Since a second to a fifth reel units 30*b* to 30*e* have the same configuration as a first reel unit 30*a*, detailed description thereof will be omitted.

The body PCB 87, which is connected to the main CPU 92, may be also electrically connected to the secondary display 70.

When the power is supplied to the slot machine 1, the main CPU 91 reads the authenticated game program and game system program from the memory card 84*s* through the gaming board 80 and writes the programs into the RAM 93. The game program is executed in a state being loaded into the RAM 93 in such a manner.

According to an embodiment, as shown in FIG. 13, the game program includes a input/bet check 91*a*, a random number generation 91*b*, a symbol determination 91*c*, a game counter 91*d*, a reel control 91*e*, a win determination 91*f*, a rendering control 91*g*, a payout 91*h*, and a game mode determination 91*i* to execute respective processing.

The bet/input check 91*a*, in an idle state where the reels 31*a* to 31*e* stop, continuously checks whether any of the BET buttons 56*a* to 56*e* or the SPIN button 54 is pressed. After the BET buttons 56*a* to 56*e* or the SPIN button 54 is pressed, the bet/input check 91*a* checks whether there remains any credit for the player on the basis of credit data 93*a* stored in the RAM 93. If the player has at least one remaining credit, the bet/input check 91*a* call the random number generation 91*b*.

Subsequently, the random number generation 91*b* generates random numbers to be used for the symbol determination 91*c*. In the present embodiment, the random number generation 91*b* generates five random numbers, each of which is directed to respective one of the first though the fifth reel units 30*a* to 30*e*.

After five random numbers are completely extracted, the symbol determination 91*c* determines a to-be-stopped symbol for each of the reel units 30*a* to 30*e* with reference to the symbol code determination table stored in the RAM 93. The symbol determination 91*c* uses the five random numbers to determine five to-be-stopped symbols for the reel units 30*a* to 30*e* to be shown in the display window 22 of the primary display 20 for each of the reels 31*a* to 31*e*.

In particular, the symbol determination 91*c* checks the current gaming mode with reference to mode flag 93*b* stored in the RAM 93, and differentiates the symbol determination process between the normal mode and the chance mode. In the normal mode, the symbol determination 91*c* applies a fixed symbol code determination table to determine the symbol using the random number according to a fixed scheme. In the chance mode, the symbol determination 91*c* may apply a symbol code determination table that is different from the symbol code determination table applied to the normal mode. In particular, the symbol determination 91*c* may consecutively change the symbol code determination table for each free round (i.e., each unit game) to vary the symbol determination process. The consequence of varying the symbol code determination table is that winning combinations including at least one specific symbol (for example, "7" symbol) increases as the chance games continue. Possible number of chance games available in a single session is limited to a certain limit that is randomly determined. For example, the certain limit may be determined as any one of six, eight, twelve, and fifteen based on a random number generated by the random number generation 91*b*. In order to limit the number of chance games, a game counter 91*d* counts the number of chance games already performed or possibly remaining in the session, and a game count value 93*c* is stored in the RAM 93. The game counter 91*d* may reside in the symbol determination 91*c*, alternatively.

The reel control 91*e* provides controls the reel assembly 30 by providing stop position information corresponding to the determined symbols, so that the reels 31*a* to 31*e* spins and stops at position designated by the stop position information. Thus, the symbols scrolls along with the spinning of the reels 31*a* to 31*e* and then stops in such a manner that the determined symbols are arranged in central position vertically in the display window 22 of the primary display 20.

Meanwhile, the win determination 91*f* determines whether any winning combination is established in the rearranged symbols. In case that a winning combination is established in the rearranged symbols, the rendering control 91*g* controls the primary display 20 and the other devices such as the speaker 17, the lamp 18, the secondary display 70 to output production effect. The production effect includes video and audio effect, backlight change, and lighting effect. Also, the payout 91*h* determines payout amount depending on the established winning combination to payout the amount the player obtained.

Meanwhile, whenever the unit game is completed, the game mode determination 91*i* determines the gaming mode of the next unit game. The game mode determination 91*i* changes the normal mode into the chance mode when a trigger event occurs in the rearranged symbols. On the other hands, the game mode determination 91*i* changes the chance mode into the normal mode when an exit condition is satisfied. The exit condition may be either a case that a counter of the game counter 91*d* reaches the certain limit or a case that a winning combination including three or more specific symbols is appeared in a free round. In the other cases, the game mode determination 91*i* maintains the previous gaming mode. Meanwhile, the game mode determination 91*i* can be implemented inside win determination 91*f*.

Gaming Operations

Hereinafter, gaming operations according to embodiments of the present invention are described in detail with reference to FIG. 14 to FIG. 44.

Normal Round

Figure 14:
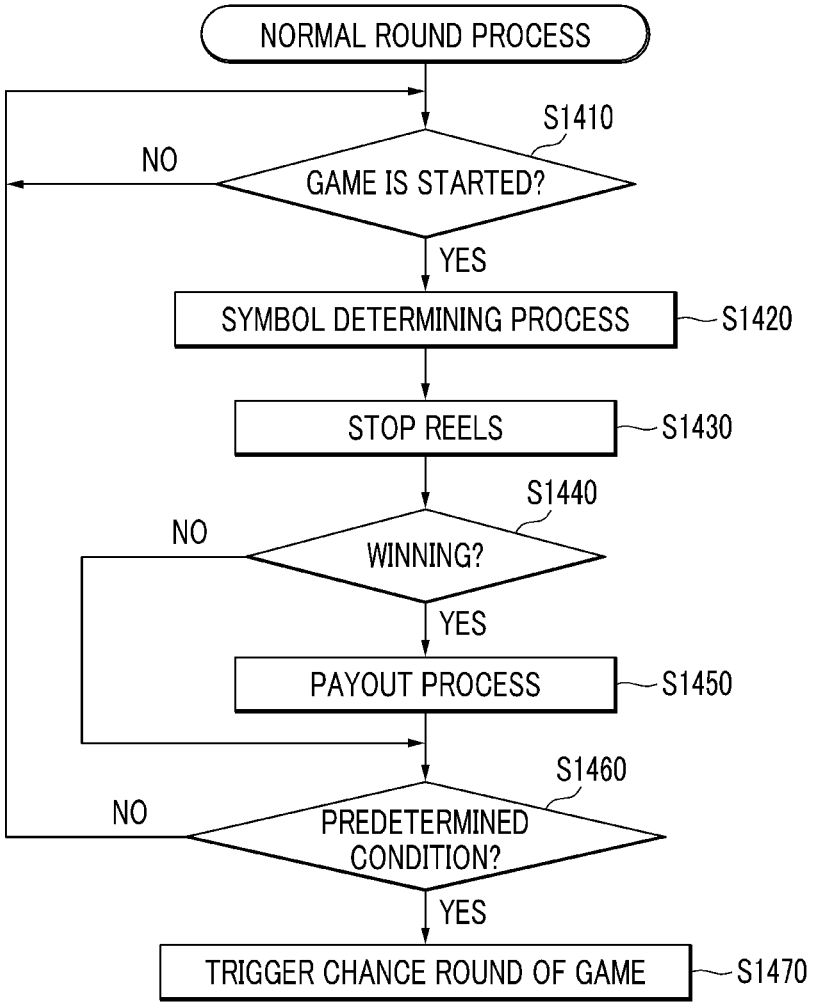
FIG. 14 is a flowchart of an exemplary normal round game process according to an embodiment of the present invention.

FIG. 14 is a flowchart of an exemplary normal round game process according to an embodiment of the present invention, and FIG. 15 is an exemplary symbol code determination table according to an embodiment of the present invention.

According to an embodiment of the present invention, a controller, i.e., a main CPU (91 of FIG. 11) of the gaming machine 1 performs a game process shown in FIG. 14 to execute a normal round of a game.

Referring to FIG. 14, after credits are bet by a player, the controller determines whether a normal round of a game is started by the player (S1410). The player may start the game by pressing a SPIN button (54 of FIG. 8). When the game is started, the controller executes a symbol determining process (S1420). In other words, the controller generates a random number for each of reels 31*a* to 31*e*, and determines positions where the reels 31*a* to 31*e* are to be stopped based on the generated random number and a symbol code determination table. Accordingly, symbols to be stopped on each payline are determined.

In one embodiment, a symbol code determination table for matching a code and a random number is stored in a memory of the gaming machine 1. The memory may be a RAM (93 of FIG. 11), a ROM (92 of FIG. 11), or other storage devices. In an example shown in FIG. 15, the symbol code determination table stores a plurality of codes and a range of random numbers corresponding to each of the codes, for each of the reels 31*a* to 31*e*. The range of random numbers corresponding to each code may determined by a probability of a winning combination for each symbol being satisfied. The probability corresponds to a weight of each symbol. The controller determines the code corresponding to the generated random number based on the symbol code determination table stored in the memory, and stops each of the reels 31*a* to 31*e* to appear the symbol corresponding to the determined code on each of the reels 31*a* to 31*e* (S1430). In this case, each of the reels 31*a* to 31*e* may be stopped such that the symbol corresponding to the determined code is appeared on a middle row of a display window 22.

The controller determines whether a combination of the symbols arranged on each pay line, i.e., a result of the game satisfies a winning combination (S1440). The winning combination is a combination where the combination of symbols arranged on the payline becomes a beneficial state for the player. The beneficial state is a state where credits corresponding to the winning combination are to be awarded the player. Various winning combinations are predefined for all symbols. For example, when at least three symbols of the same rank are continuously arranged from the first column on the pay line, the winning combination for the symbols is satisfied. The credits to be paid out may be varied according to a type of the symbol and/or the number of continuous symbols.

When the result of the game satisfies the winning combination (S1440: YES), the controller performs a payout process for awarding credits corresponding to the winning combination as a win (i.e., prize) (S1450). Further, the controller determines whether the result of the game satisfies a predetermined condition (S1460). The predetermined condition may be an appearance of "CHANCE" symbol on the display window 22. The "CHANCE" symbol may be appeared on only the third reel 31*c*. When the result of the game satisfies the predetermined condition (S1460: YES), the controller triggers a chance round of the game and executes a chance round process (S1470).

Next, exemplary screen images shown on a primary display 20 and a secondary display 70 in a normal round of a game according to an embodiment of the present invention are described with reference to FIG. 16 to FIG. 23. A controller of the gaming machine 1 may display the screen images on the primary display 20 and the secondary display 70.

Figure 16:
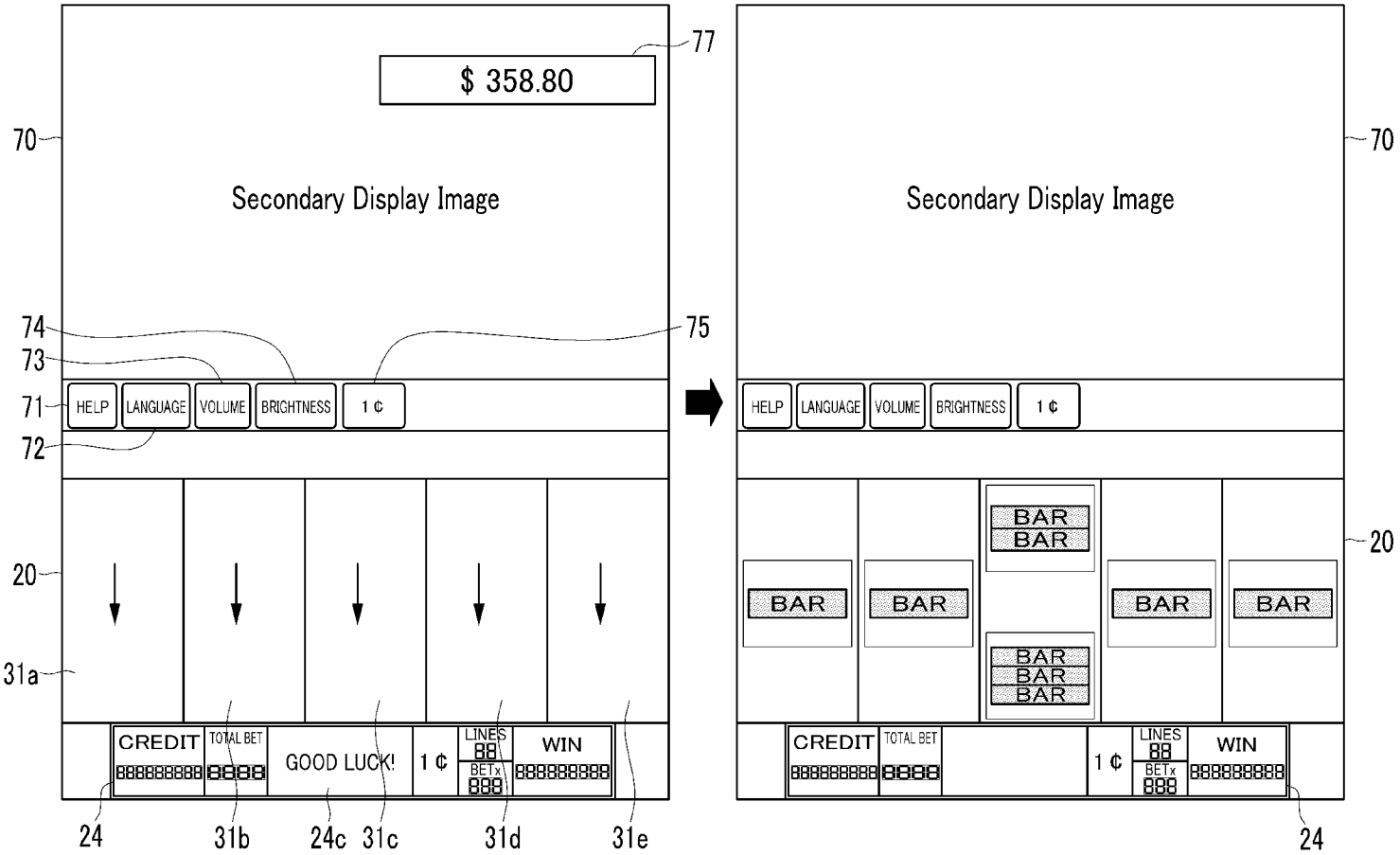
FIG. 16 is an exemplary screen image shown on a primary display and a secondary display in a normal round of a game according to an embodiment of the present invention.
Figure 17:
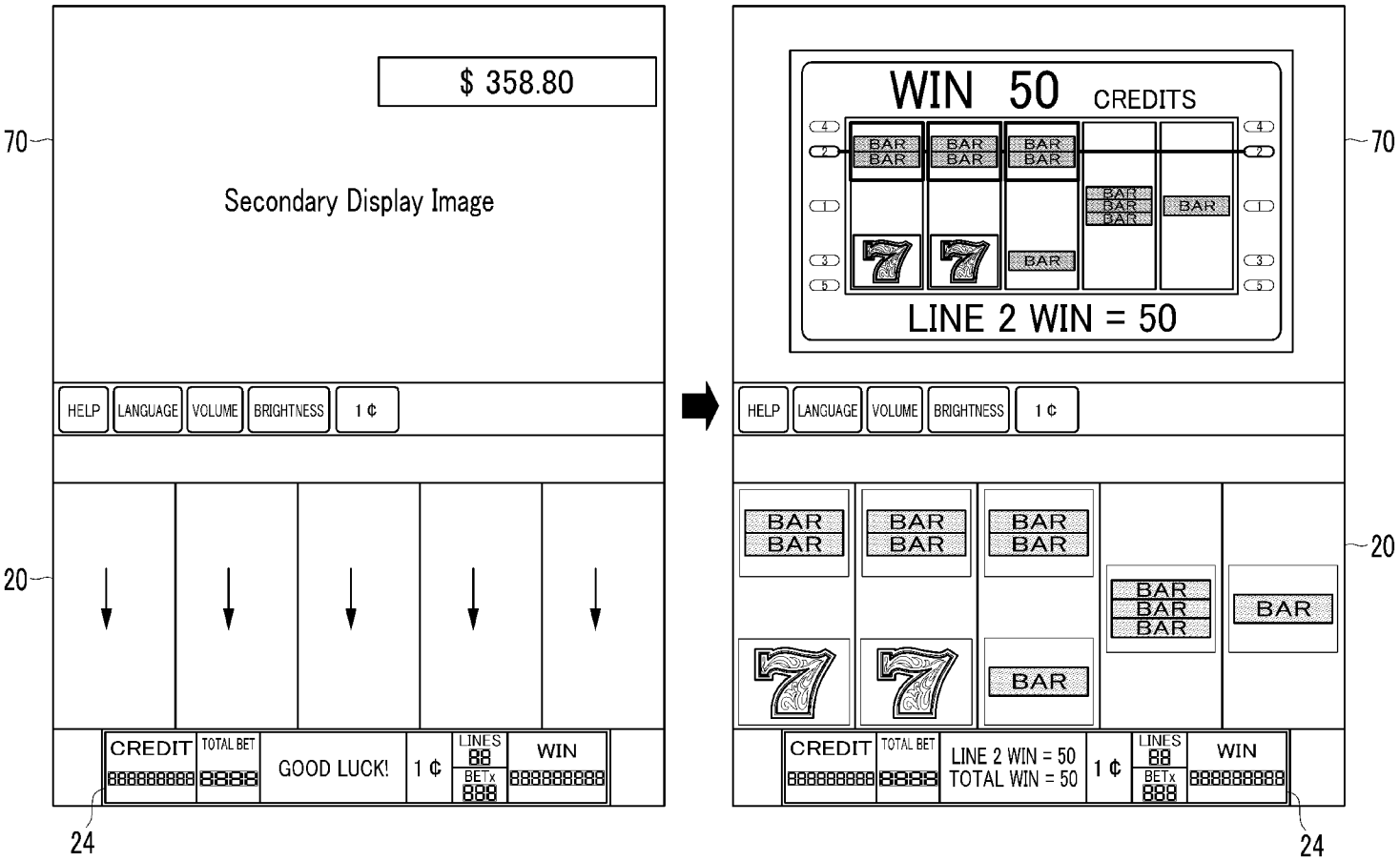
FIG. 17 is an exemplary screen image of a game result shown on a primary display and a secondary display in a normal round of a game according to an embodiment of the present invention.
Figure 18:
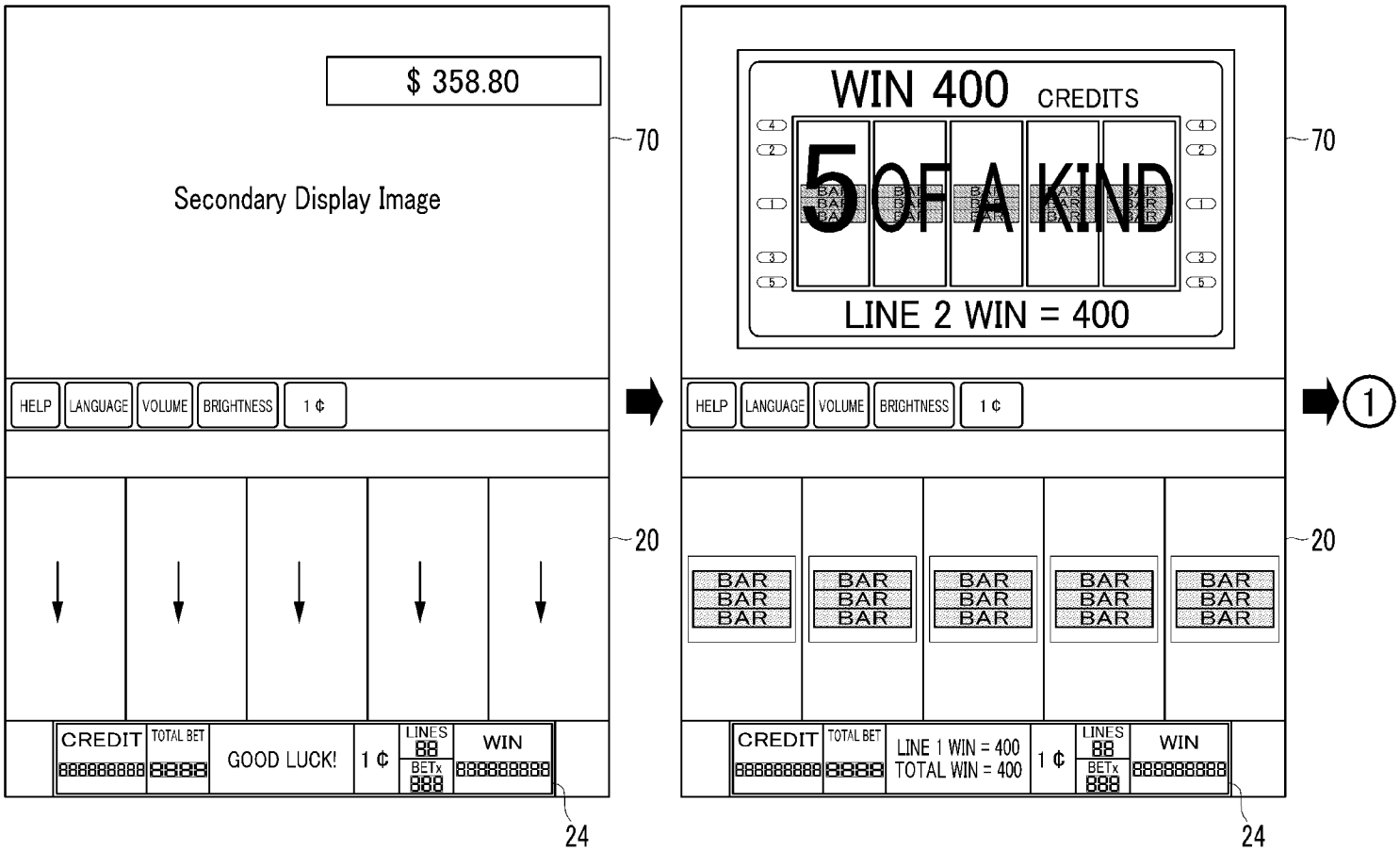
FIG. 18 is an exemplary screen image of five of a kind shown on a primary display and a secondary display in a normal round of a game according to an embodiment of the present invention.
Figure 19:
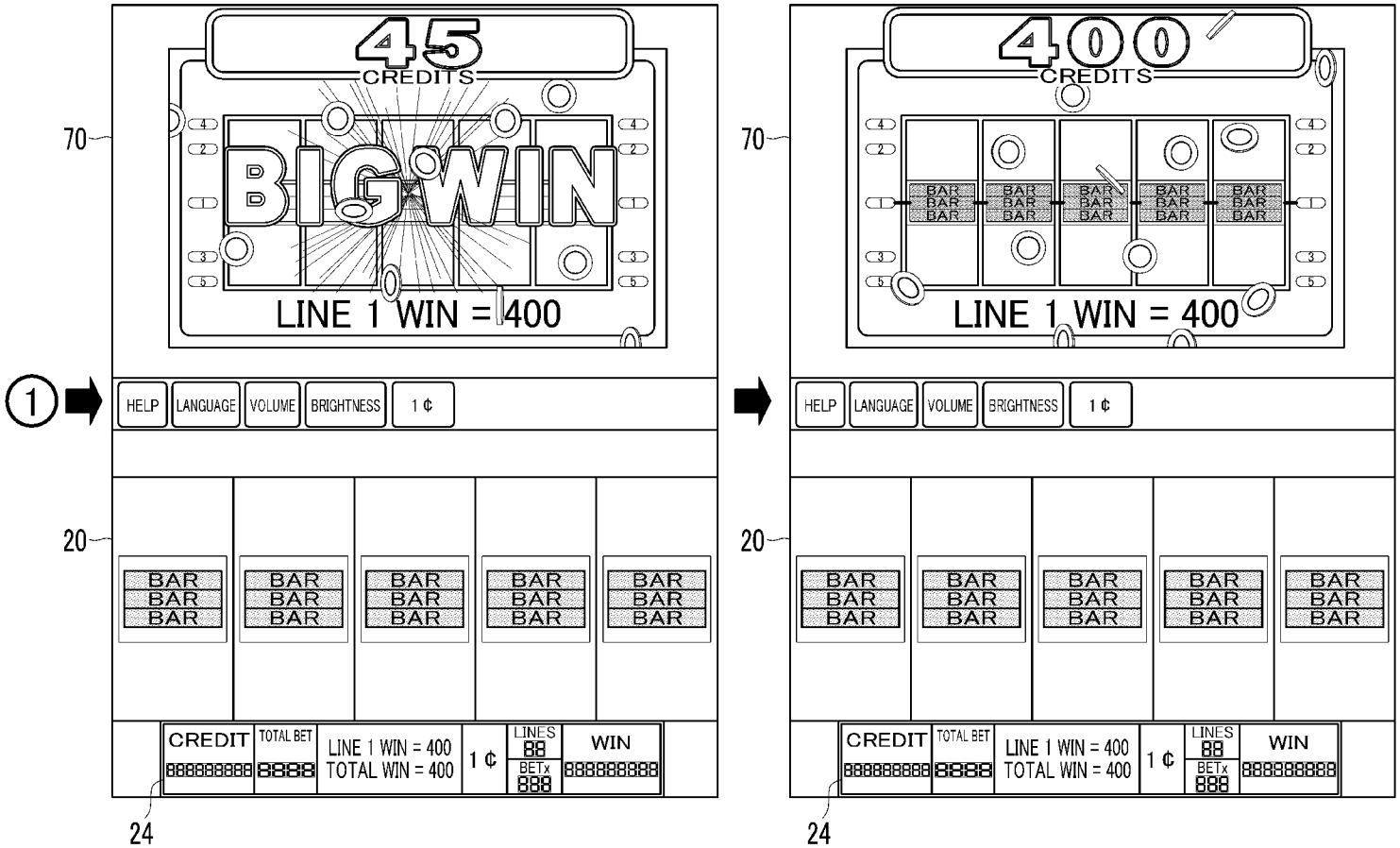
FIG. 19 is an exemplary screen image subsequent to the image shown in FIG. 18.
Figure 20:
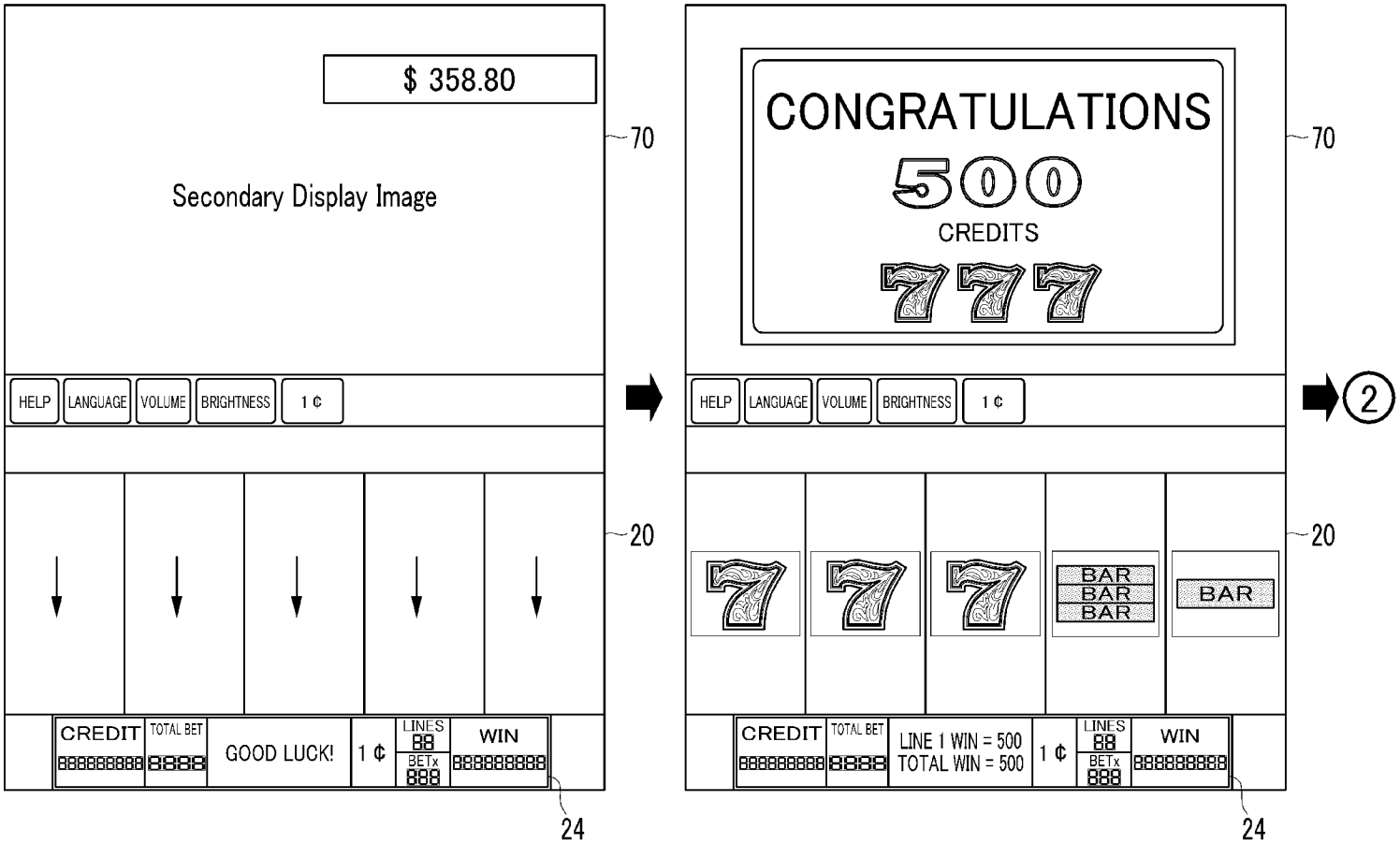
FIG. 20 is an exemplary screen image of a combination of 7 symbols shown on a primary display and a secondary display in a normal round of a game according to an embodiment of the present invention.
Figure 21:
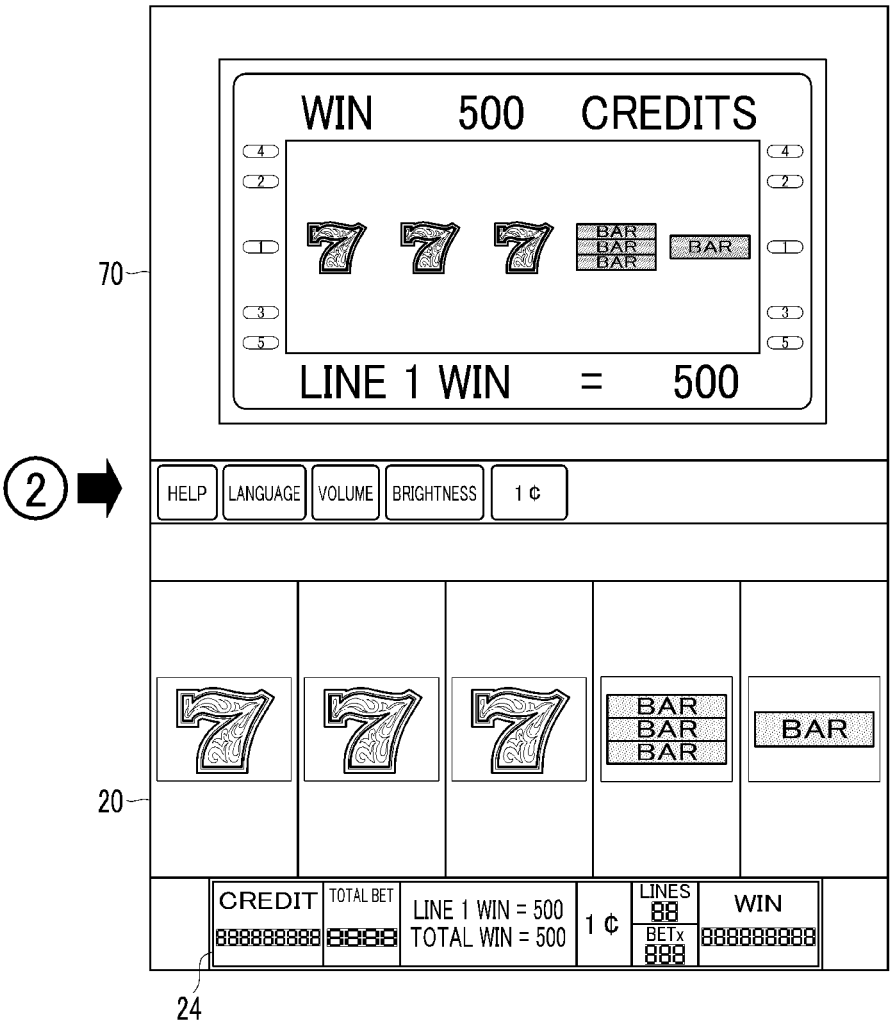
FIG. 21 is an exemplary screen image subsequent to the image shown in FIG. 20.
Figure 22:
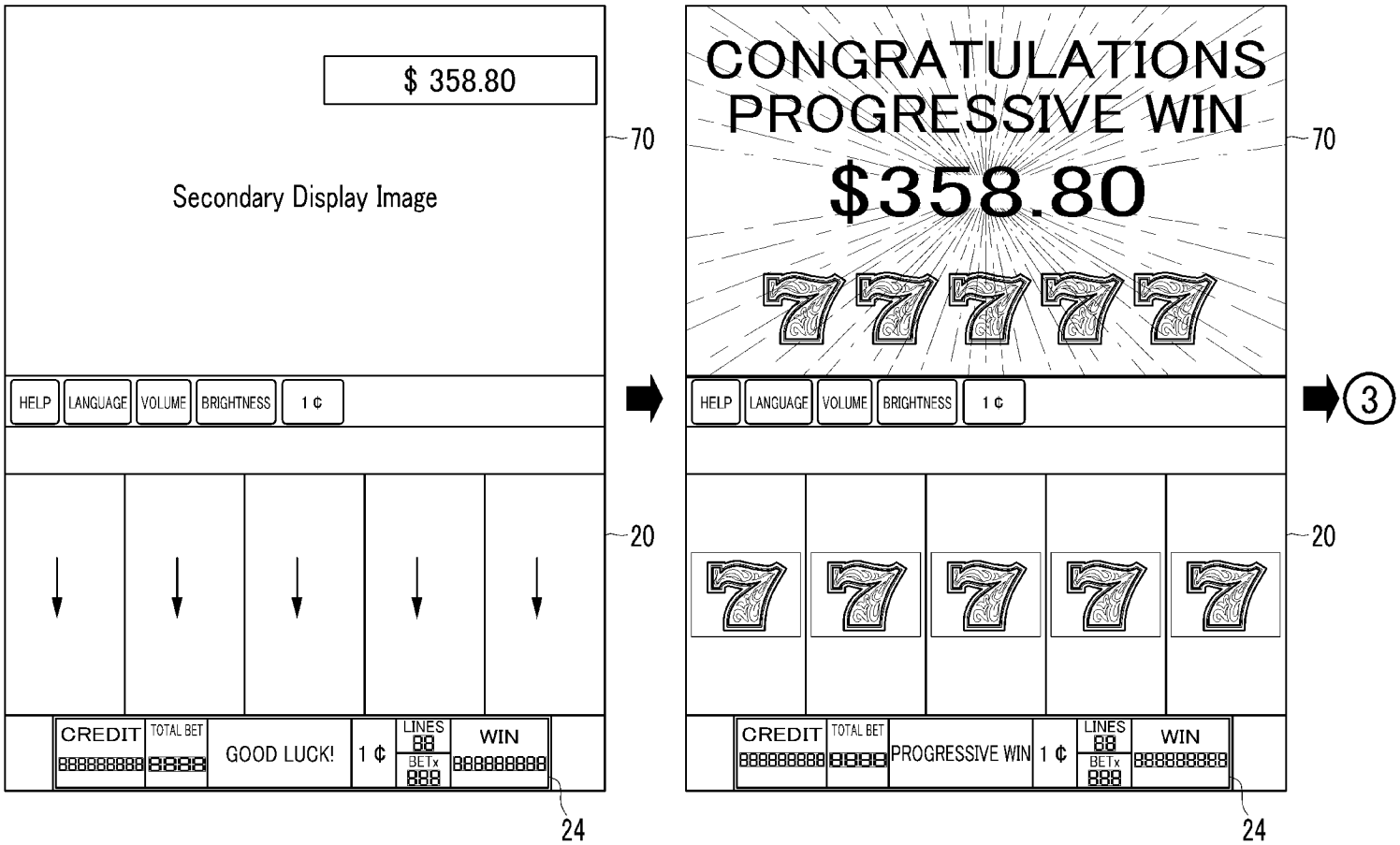
FIG. 22 is an exemplary screen image of a progressive jackpot shown on a primary display and a secondary display in a normal round of a game according to an embodiment of the present invention.
Figure 23:
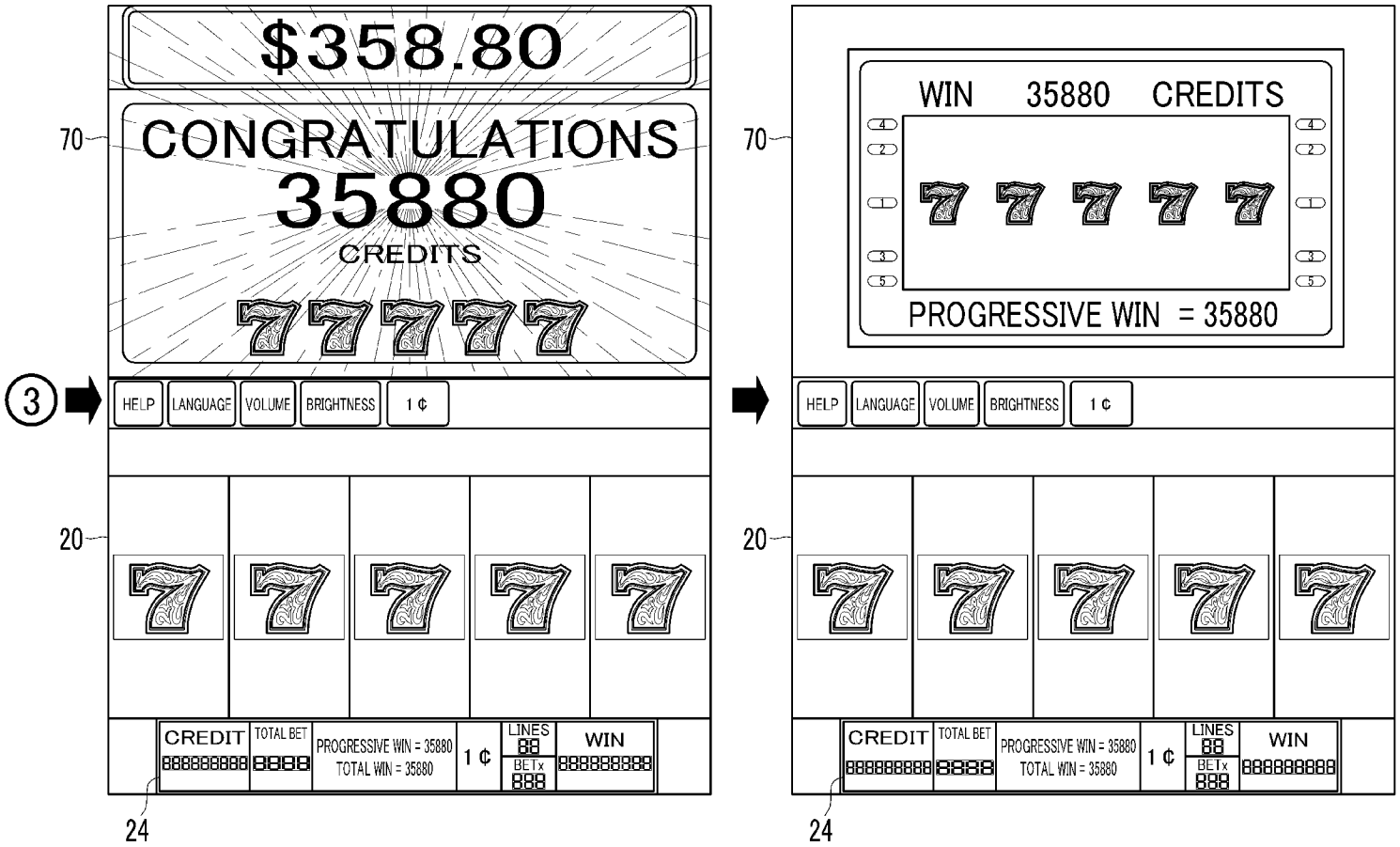
FIG. 23 is an exemplary screen image subsequent to the image shown in FIG. 22.

FIG. 16 is an exemplary screen image shown on a primary display and a secondary display in a normal round of a game according to an embodiment of the present invention, FIG. 17 is an exemplary screen image of a game result shown on a primary display and a secondary display in a normal round of a game according to an embodiment of the present invention, FIG. 18 and FIG. 19 are exemplary screen images of five of a kind shown on a primary display and a secondary display in a normal round of a game according to an embodiment of the present invention, FIG. 20 and FIG. 21 are exemplary screen images of a combination of 7 symbols shown on a primary display and a secondary display in a normal round of a game according to an embodiment of the present invention, and FIG. 22 and FIG. 23 are exemplary screen images of a progressive jackpot shown on a primary display and a secondary display in a normal round of a game according to an embodiment of the present invention.

Referring to FIG. 16, when a normal round of a game is executed, a plurality of reels 31*a* to 31*e* start to spin in a primary display 20. In this case, a display panel 24 of the primary display 20 may display a message such as "GOOD LUCK!" on a game message area 24*c*. After the reels 31*a* to 31*e* spin, the reels 31*a* to 31*e* are stopped according to the result of the symbol determining process, as shown in FIG. 16.

A secondary display 70 may display a secondary display image for representing a theme of a game. Various buttons 71 to 75 for setting a gaming machine 1 may be displayed on a lower part of the secondary display 70, and some of the buttons 71 to 75 may be operated by a player's touch. The various buttons 71 to 75 include, for example, a help button 71, a language button 72, a volume button 73, a brightness button 74, and a denomination button. The help button 71, if touched, displays help information on the secondary display 70. The language button 72, if touched, switches a language of the gaming machine 1 from one language to the other language. The volume button 73, if touched, increases or decreases a volume of a sound outputted from the gaming machine 1. The brightness button 74, if touched, increases or decreases a brightness of the secondary display 70. The denomination display section 75 displays a current denomination, for example, 1¢. When the gaming machine 1 supports a progressive jackpot, the secondary display 70 may further display an amount of the progressive jackpot on a progressive area 77. The progressive jackpot is a highest payout (i.e., a jackpot) for the gaming machine 1 where a value of the jackpot increases a small amount for every game played.

Referring FIG. 17, when the reels 31*a* to 31*e* are stopped according to the result of the symbol determining process, the result can satisfy a winning combination. In an example shown in FIG. 17, the winning combination is achieved by a combination of three "DOUBLE BAR" symbols arranged on the second payline. In this case, the secondary display 70 displays an image for symbols appeared on the display window 22, and an image representing the payline and a combination of symbols achieving the winning combination. Further, the secondary display 70 displays an image for notifying the payout (e.g., 50 credits) of the payline (e.g., LINE 2) achieving the winning combination, for example, as "WIN 50 CREDITS" and "LINE 2 WIN=50." Furthermore, the secondary display 70 displays an image for notifying total credits to be awarded by all paylines achieving the winning combination, for example, as "WIN 50 CREDITS." Moreover, the display panel 24 of the primary display 20 displays the payout of the payline achieving the winning combination (e.g., "LINE 2 WIN=50") and the total credits (e.g., "TOTAL WIN=50") on a game message area 24*c*.

Referring FIG. 18, when the reels 31*a* to 31*e* are stopped according to the result of the symbol determining process, the winning combination is achieved by a combination of five "TRIPPLE BAR" symbols arranged on the first payline. A combination of five symbols of the same rank is called "five of a kind." When five of a kind is achieved, the secondary display 70 displays an image of notifying five of a kind, for example, as "5 OF A KIND." Further, the display panel 24 displays a payout (e.g., 400 credits) of the payline (e.g., LINE 1) achieving the winning combination and the total credits on the game message area 24*c*, for example, as "LINE 1 WIN=400" and "TOTAL WIN=400."

Subsequently, the secondary display 70 displays an image for notifying the big win according to five of a kind, as shown in FIG. 19. The image for notifying the big win includes a message (e.g., "BIG WIN") for notifying the big win, a betting amount (e.g., 45 CREDITS), and a payout (e.g., "LINE 1 WIN=400") of the payline achieving the big win. Next, the secondary display 70 displays an image for symbols appeared on the display window 22, and the payline and a combination of symbols achieving the winning combination (i.e., the big win). Further, the secondary display 70 displays an image for notifying the payout (e.g., 400 credits) to be awarded.

Referring FIG. 20, when the reels 31*a* to 31*e* are stopped according to the result of the symbol determining process, the winning combination is achieved by a combination of "7" symbols arranged on the first payline. In an example in shown in FIG. 20, the combination of three "7" symbols is arranged on the first payline. When the combination of "7" symbols is arranged, the secondary display 70 displays an image for notifying an appearance of the combination of "7" symbols. The image further includes for a payout (e.g., 500 credits) according to the combination of "7" symbols and a congratulatory message (e.g., "CONGRATULATIONS") according to the combination of "7" symbols. Further, the display panel 24 displays a payout (e.g., 500 credits) of the payline (e.g., LINE 1) achieving the winning combination (e.g., "LINE 1 WIN=500") and the total credits (e.g., "TOTAL WIN=500") on the game message area 24*c*.

Subsequently, the secondary display 70 displays an image for symbols appeared on the display window 22, as shown in FIG. 21. Further, the secondary display 70 displays an image for notifying the payout (e.g., 500 credits) of the payline (e.g., LINE 1) achieving the winning combination, for example, as "WIN 500 CREDITS" and "LINE 1 WIN=500."

Referring FIG. 22, when the reels 31*a* to 31*e* are stopped according to the result of the symbol determining process, the winning combination is achieved by a combination of five "7" symbols arranged on the first payline. The combination of five "7" symbols corresponds to a progressive jackpot. Accordingly, the secondary display 70 displays an image for notifying the progressive jackpot according to the combination of five "7" symbols. The image further includes for a payout (e.g., $358.80), which is represented as a money, according to the combination of five "7" symbols and a congratulatory message (e.g., "CONGRATULATIONS PROGRESSIVE WIN") according to the progressive jackpot. Further, the display panel 24 displays a message (e.g., "PROGRESSIVE WIN") for notifying the progressive jackpot.

Subsequently, the secondary display 70 renders a screen shining brightly, and displays the payout according to the combination of five "7" symbols as credits (e.g., "35880 CREDITS"), as shown in FIG. 23. Further, the display panel 24 displays a payout of the payline achieving the winning combination (e.g., "PROGRESSIVE WIN=35880") and the total credits (e.g., "TOTAL WIN=35880") on the game message area 24*c*. Next, the secondary display 70 displays an image for symbols appeared on the display window 22. Further, the secondary display 70 displays an image for notifying the payout (e.g., 35880 credits) according to the progressive jackpot, for example, as "WIN 35880 CREDITS" and "PROGRESSIVE WIN=35880."

As described above, according to an embodiment of the present invention, various effects can be rendered by using the secondary display 70 and the display panel 24, according to the result of the symbol determining process, i.e., the result of the game.

Chance Round

Figure 24:
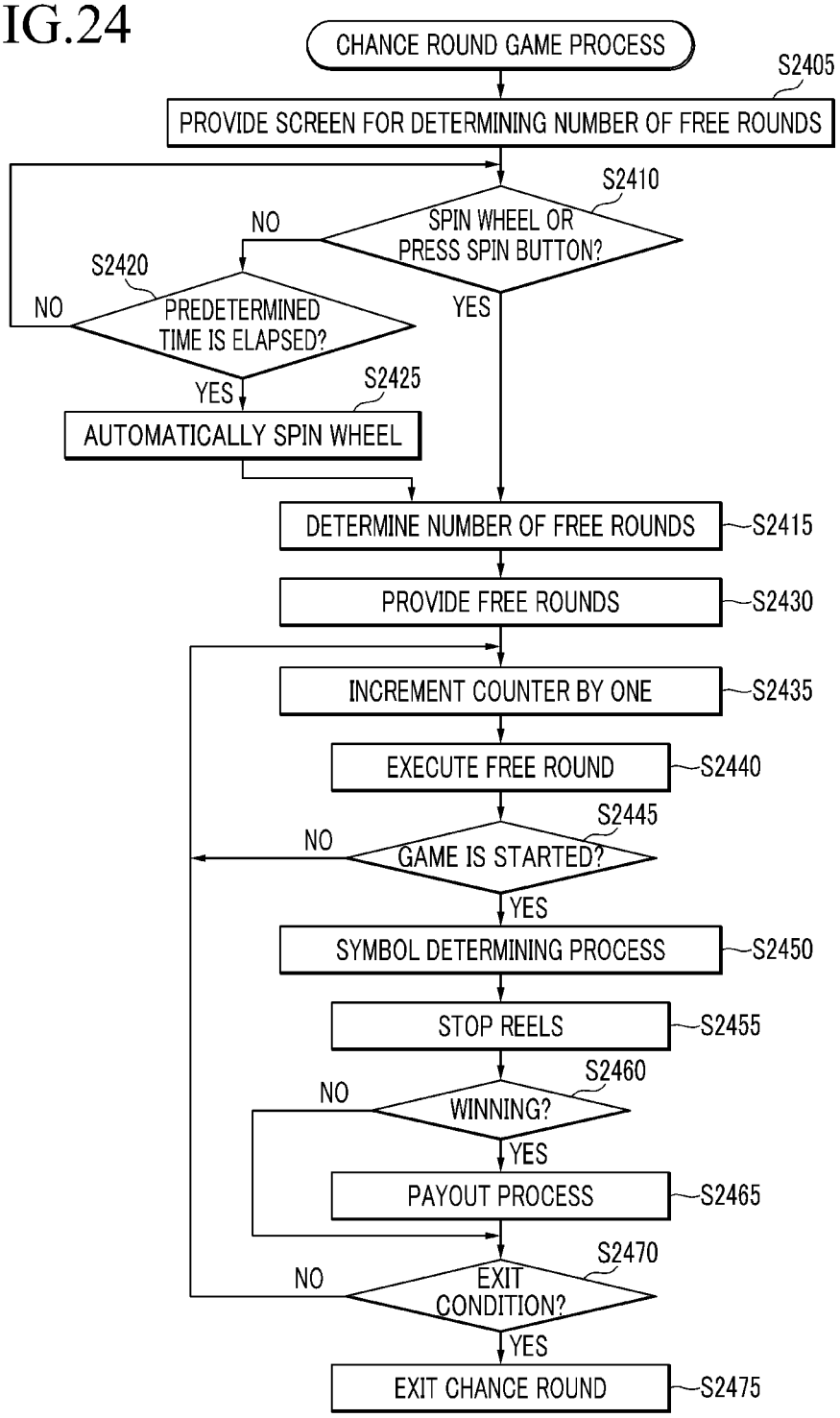
FIG. 24 is a flowchart of an exemplary chance round game process according to an embodiment of the present invention.
Figure 25:
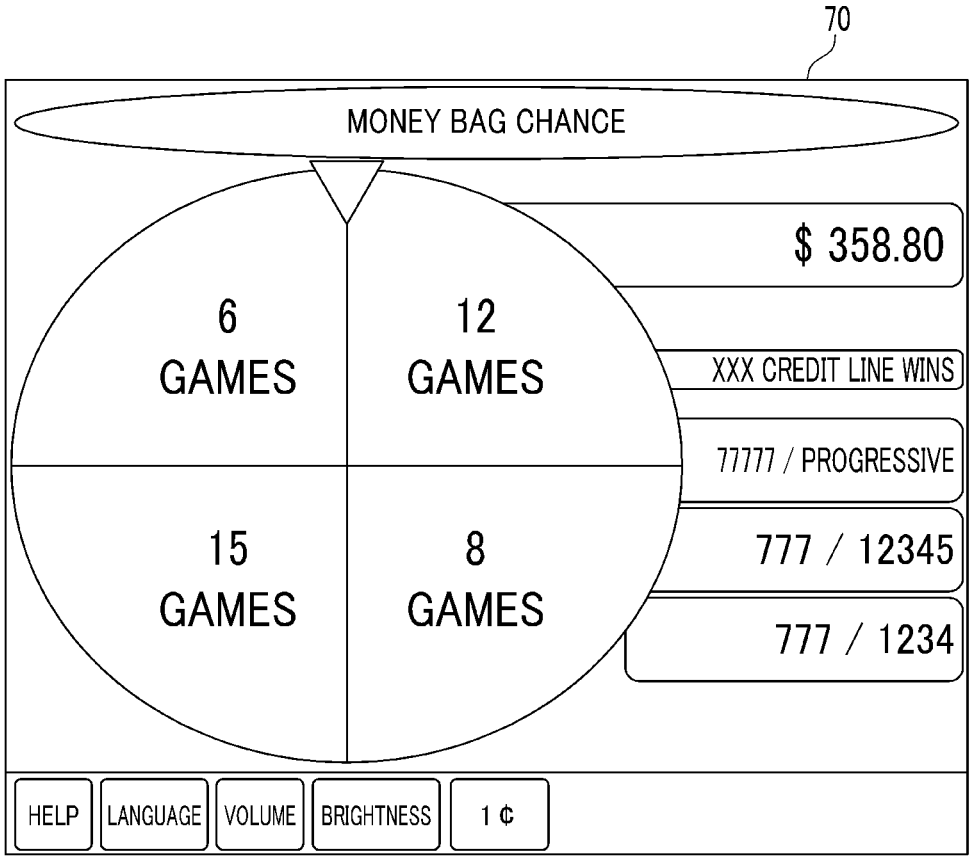
FIG. 25 is an exemplary screen image for determining a number of free rounds to be provided in a chance round according to an embodiment of the present invention.

FIG. 24 is a flowchart of an exemplary chance round game process according to an embodiment of the present invention, FIG. 25 is an exemplary screen image for determining a number of free rounds to be provided in a chance round according to an embodiment of the present invention, FIG. 26 is an exemplary symbol code determination table for a chance round according to an embodiment of the present invention, and FIG. 27 is an exemplary symbol code table for a chance round according to another embodiment of the present invention.

Referring to FIG. 14 again, a chance round of a game is triggered when a result of a normal round of the game satisfies a predetermined condition. When the chance round is triggered, a controller, i.e., a main CPU (91 of FIG. 11) of the gaming machine 1 performs a game process shown in FIG. 24 to execute the chance round of the game.

Referring to FIG. 24, the controller provides a screen for determining the number of free rounds to be provided in the chance round (S2405). The screen may be displayed on a secondary display 70. As shown in FIG. 25, the screen includes an image for a wheel having a plurality of options, and each of the plurality of options corresponds to the number of free rounds. The plurality of options, for example, includes an option for providing six free rounds (6 games), an option for providing eight free rounds (8 games), an option for providing twelve free rounds (12 games), and an option for providing fifteen free rounds (15 games). The secondary display 70 may further display an image for notifying the trigger of the chance round, for example as "MONEY BAG CHANCE." The secondary display 70 may further display an image for notifying payouts according to winning combinations. The winning combinations includes, for example, a combination of three "7" symbols, a combination of four "7" symbols, and a combination of five "7" symbols. The combination of five "7" symbols corresponds to the progressive jackpot.

The controller waits for an input of a player (S2410). When the player spins the wheel (S2410: YES), the controller determines the number of free rounds (S2415). The player may spin the wheel by moving a finger in a certain direction by touching the secondary display 70, or by pressing the SPIN button (54 of FIG. 8). Then, the secondary display 70 renders an effect that the wheel spins. The wheel may spin in either a clockwise direction or a counterclockwise direction according to a direction in which the player moves the finger. Further, the controller may randomly determine the number of free rounds. That is, the controller may generate a random number, and determine the number of free rounds based on the generated random number and a chance round determination table for matching the random number and the number of free rounds. The chance round determination table is stored in a memory of the gaming machine 1. The memory may be a RAM (93 of FIG. 11), a ROM (92 of FIG. 11), or other storage devices. In an example shown in FIG. 23, the chance round determination table stores a plurality of numbers and a range of random numbers corresponding to each of the numbers. The range of random numbers corresponding to each of the numbers may determined by a probability of each of the numbers being determined. The range of random numbers may be inversely proportional to the number of free rounds.

If there is no input of the player, the controller waits for the input of the player during a predetermined time. When there is no input of the player during the predetermined time (S2420: YES), the controller automatically spins the wheel (S2425) and determines the number of free rounds (S2415).

The controller provides the free rounds according to the determined number of free rounds (S2430). Next, the controller increments a counter for the chance round by one (S2435), and executes the free round (S2440). The controller determines whether the free round is started by the player (S2445). The player may start the free round by pressing a SPIN button (54 of FIG. 8) or the controller may automatically start the free round. When the free round is started, the controller executes a symbol determining process for the free round (S2450). In other words, the controller generates a random number for each of reels 31*a* to 31*e*, and determines positions where the reels 31*a* to 31*e* are to be stopped based on the generated random number and a symbol code determination table.

In one embodiment, a symbol code determination table for the free round may be the same as the symbol code determination table for the normal round.

In another embodiment, the symbol code determination table for the free round may be different from the symbol code determination table for the normal round, as shown in FIG. 26. In this case, a probability of a combination of a specific symbols being appeared in the symbol code determination table for the free round may be set higher than that in the symbol code determination table for the normal round. The specific symbols may be "7" symbols. For example, for the first reel 31*a*, a range (CL1B~CU1C, CL1N~CL1O, or CL1T~CL1U) of random numbers for the "7" symbol in FIG. 26 is wider than a range (NL1B~NU1C, NL1N~NL1O, NL1T~NL1U) of random numbers for the "7" symbol in FIG. 15. Alternatively, as shown in FIG. 27, the number of specific symbols may be increased in a symbol code table for the free round. That is, the number of "7" symbols in the symbol code table of FIG. 27 may be more than the number of "7" symbols in the symbol code table of FIG. 6. Furthermore, the probability of the combination of "7" symbols being appeared may be varied in a plurality of free rounds for the chance round.

The controller determines the code corresponding to the generated random number based on the symbol code determination table stored in the memory, and stops each of the reels 31*a* to 31*e* to appear the symbol corresponding to the determined code on each of the reels 31*a* to 31*e* (S2455). In this case, each of the reels 31*a* to 31*e* may be stopped such that the symbol corresponding to the determined code is appeared on a middle row of a display window 22. The controller determines whether a combination of the symbols arranged on each pay line, i.e., a result of the free round satisfies a winning combination (S2460).

When the result of the free round satisfies the winning combination (S2460: YES), the controller performs a payout process for awarding credits corresponding to the winning combination as a win (S2465). Further, the controller determines whether an exit condition of the chance round is satisfied (S2470). When the exit condition is satisfied (S2470: YES), the controller ends the chance round and returns to the normal round of the game (S2475). When the exit condition is not satisfied, the controller increments the counter by one and executes a next free round. That is, the controller repeats the process of the steps S2435 to S2470. The exit condition may be either a case that the counter reaches the determined number of free rounds or a case that a winning combination including three or more specific symbols, for example "7" symbols, is achieved in the free round.

Next, exemplary screen images shown on a primary display 20 and a secondary display 70 in a chance round of a game or at a time of a trigger of the chance round according to an embodiment of the present invention are described with reference to FIG. 28 to FIG. 37. A controller of the gaming machine 1 may display the screen images on the primary display 20 and the secondary display 70.

FIG. 28 to FIG. 32 are exemplary screen images shown on a primary display and a secondary display in a chance round of a game according to an embodiment of the present invention.

Figure 28:
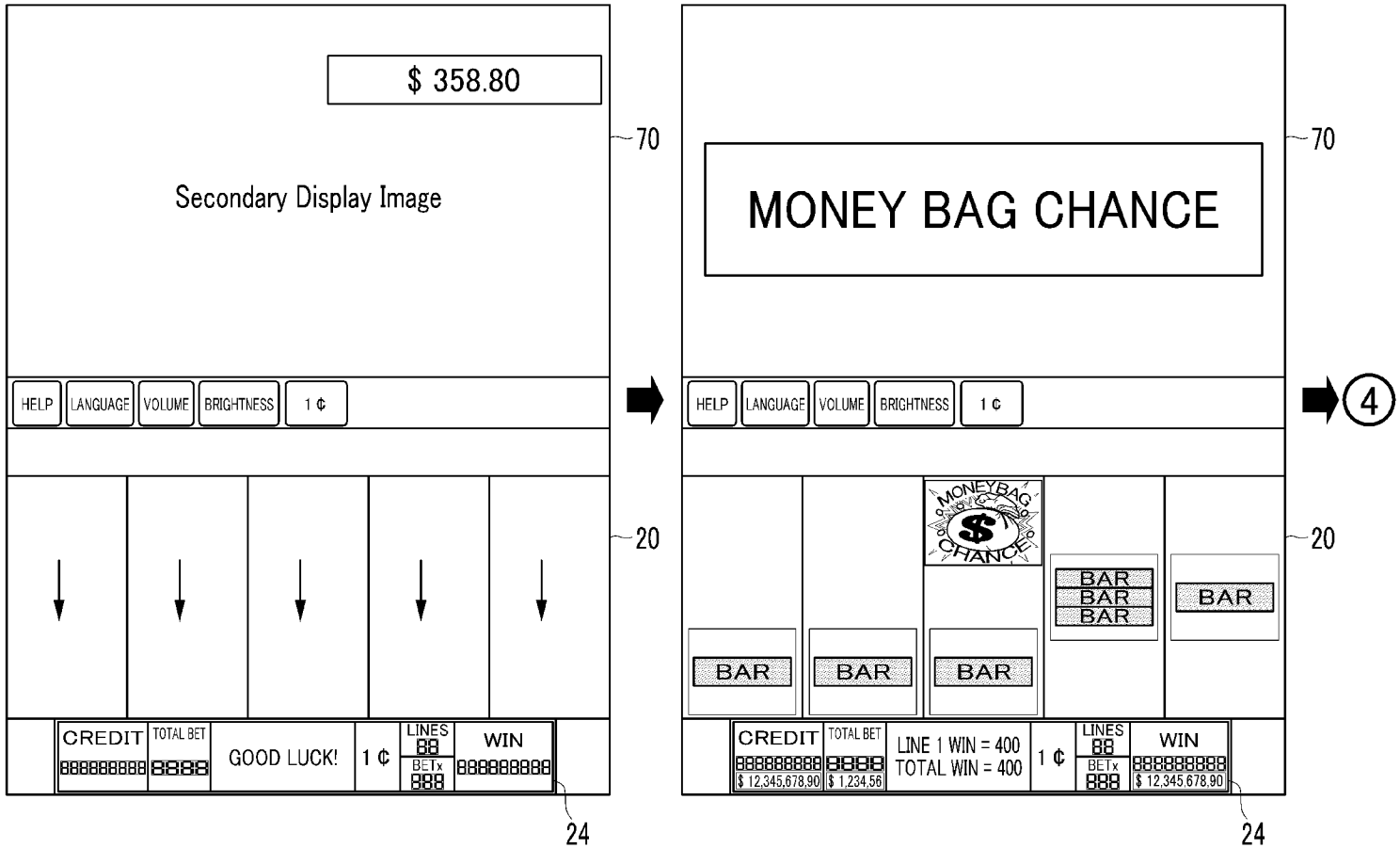
FIG. 28 is an exemplary screen image shown on a primary display and a secondary display in a chance round of a game according to an embodiment of the present invention.

Referring to FIG. 28, when a "CHANCE" symbol is appeared on a display window 22 in a normal round of a game, a chance round of the game is triggered. At this time, a secondary display 70 notifies a trigger of the chance round, for example as "MONEY BAG CHANCE." In this case, a display panel 24 of the primary display 20 may display a message for notifying the trigger of the chance round (e.g., "MONEY BAG CHANCE") on a game message area 24*c*.

Figure 29:
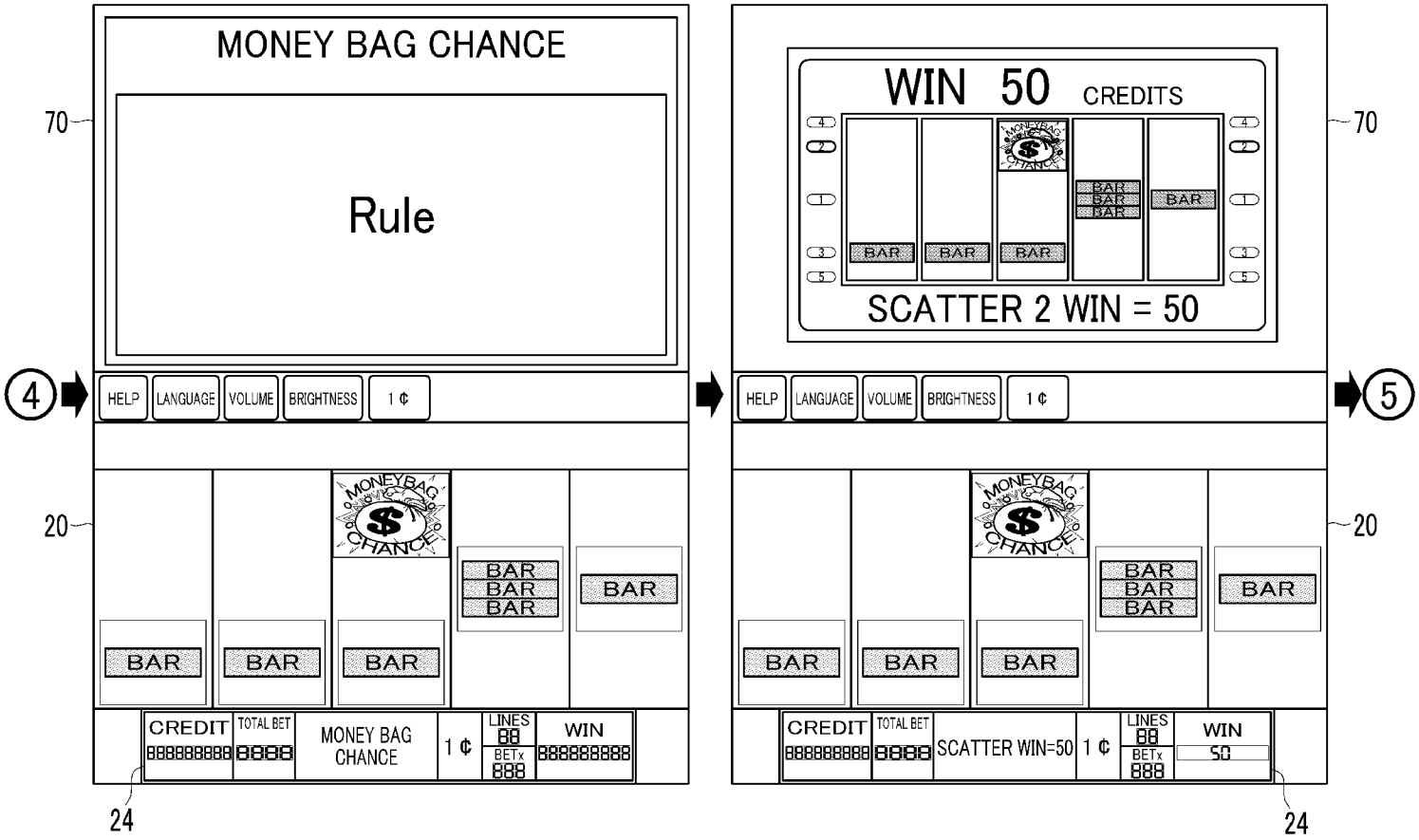
FIG. 29 is an exemplary screen image subsequent to the image shown in FIG. 28.

Next, the secondary display 70 displays a rule of the chance round as shown in FIG. 29. Subsequently, the secondary display 70 displays an image for symbols appeared on the display window 22, and an image representing a combination of symbols (i.e., the "CHANCE" symbol) achieving the winning combination. Further, the secondary display 70 displays an image for notifying the payout (e.g., 50 credits) according to the scatter symbol such as the "CHANCE" symbol, for example, as "WIN 50 CREDITS" and "SCATTER WIN=50." Moreover, the display panel 24 of the primary display 20 displays the payout according to the scatter symbol (e.g., "SCATTER WIN=50") on a game message area 24*c*.

Figure 30:
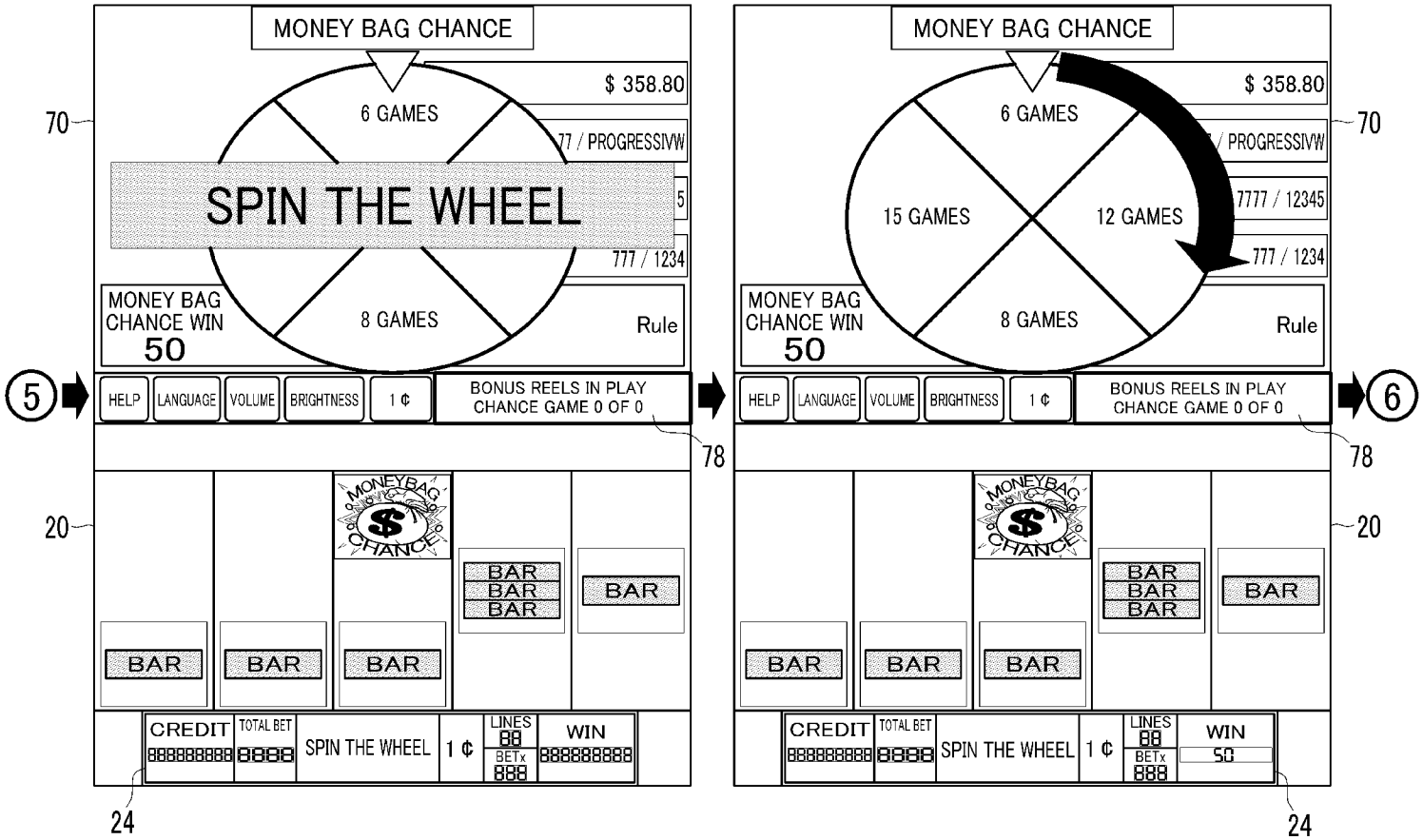
FIG. 30 is an exemplary screen image subsequent to the image shown in FIG. 29.

Next, the secondary display 70 displays a wheel having a plurality of options each corresponding to the number of free rounds, as shown in FIG. 30. The secondary display 70 displays a message (e.g., "SPIN THE WHEEL") for notifying the player to spin the wheel. Further, the display panel 24 displays the message (e.g., "SPIN THE WHEEL") for notifying the player to spin the wheel. Furthermore, the secondary display 70 displays a chance round counter 78 on a lower part. The chance round counter 78 indicates the total number of free rounds and the number of executed free rounds. Before the number of free rounds is determined, the chance round counter 78 displays the total number of free rounds and the number of executed free rounds as zero and zero, respectively. For example, the chance round counter 78 displays "BONUS REELS IN PLAY" and "CHANCE GAME 0 OF 0".

Figure 31:
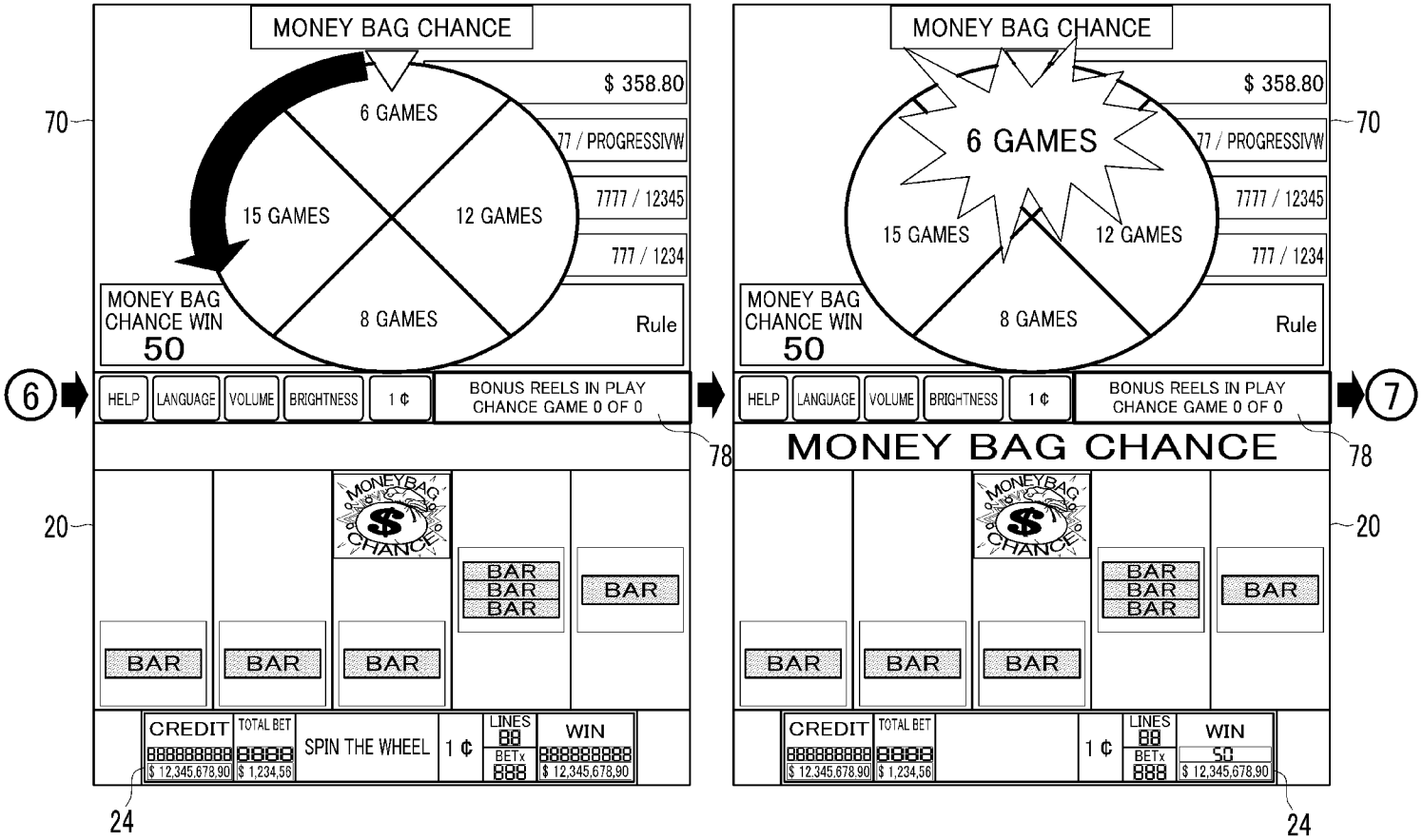
FIG. 31 is an exemplary screen image subsequent to the image shown in FIG. 30.

Subsequently, the secondary display 70 displays an image for indicating the player to spin the wheel in a clockwise direction as shown in FIG. 30. At this time, an image that a finger image is spinning in the clockwise direction along with the wheel may be displayed in order to indicate the player to move a finger in the clockwise direction with continuously touching a screen of the secondary display 70. Next, the secondary display 70 displays an image for indicating the player to spin the wheel in a counterclockwise direction as shown in FIG. 31. At this time, an image that the finger image is spinning in the counterclockwise direction along with the wheel may be displayed in order to indicate the player to move the finger in the counterclockwise direction with continuously touching the screen of the secondary display 70. When the player moves the finger in the clockwise or counterclockwise direction along with the wheel, the secondary display 70 displays an image that the wheel spins in the clockwise or counterclockwise direction. Further, the controller randomly determines the number of free rounds, and displays in the secondary display 70 an image that the wheel is stopped at a position corresponding to the determined number of free rounds. In an example shown in FIG. 31, the wheel is stopped at a position corresponding to six games of the free rounds.

Figure 32:
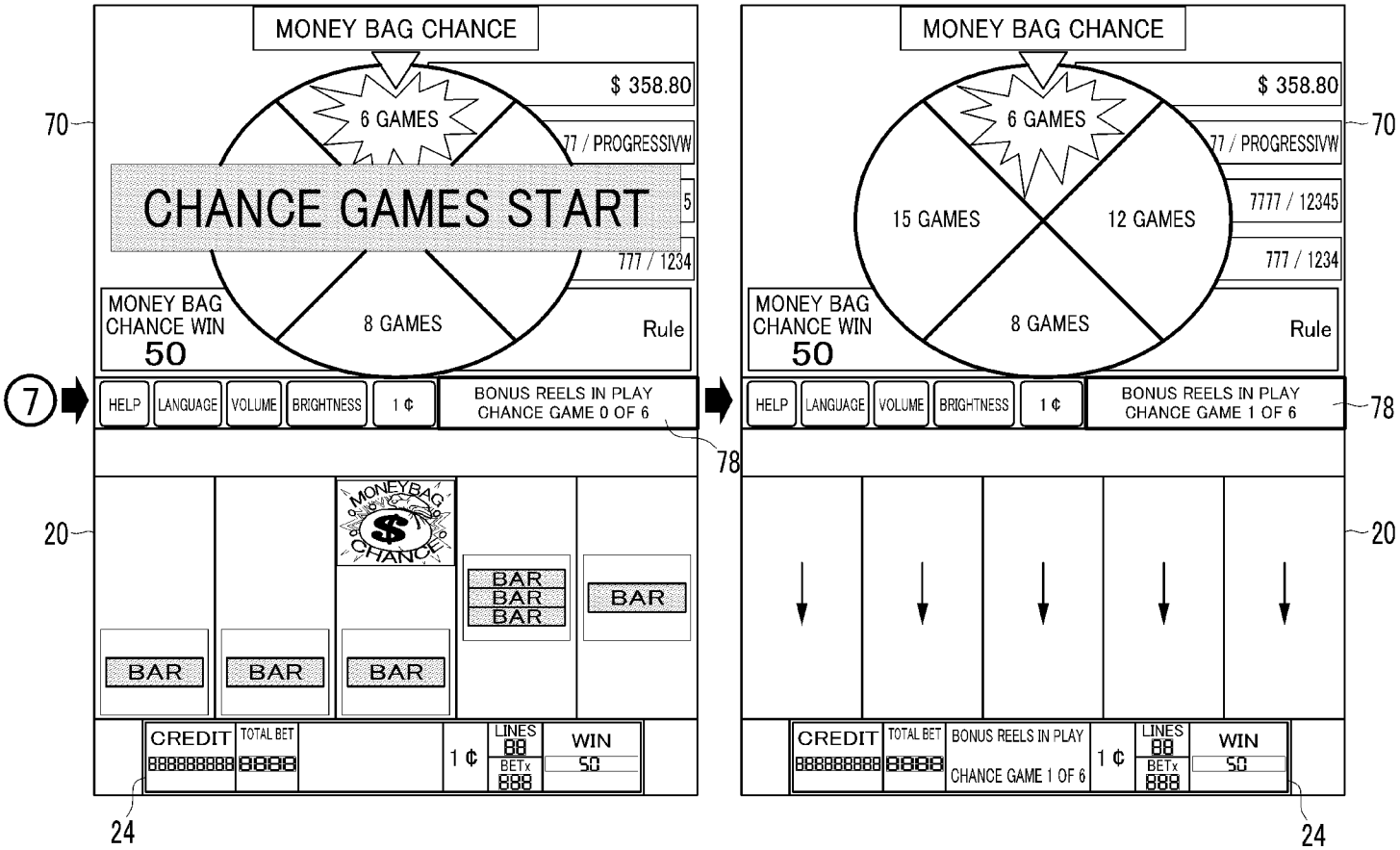
FIG. 32 is an exemplary screen image subsequent to the image shown in FIG. 31.

Subsequently, the secondary display 70 notifies a start of the chance round as shown in FIG. 32. For example, the secondary display 70 may display "CHANCE GAMES START." At this time, the secondary display 70 displays the determined numbers of free rounds in the chance round counter 78, for example as "CHANCE GAME 0 OF 6". Next, the free round is started, and the plurality of reels 31*a* to 31*e* spins. At this time, the chance round counter 78 increments the number of executed free rounds by one, for example as "CHANCE GAME 1 OF 6". Further, the display panel 24 of the primary display 20 displays the total number of free rounds and the number of executed free rounds. When the plurality of reels 31*a* to 31*e* are stopped according to the result of the symbol determining process, a payout is provided if a winning combination is achieved.

Figure 33:
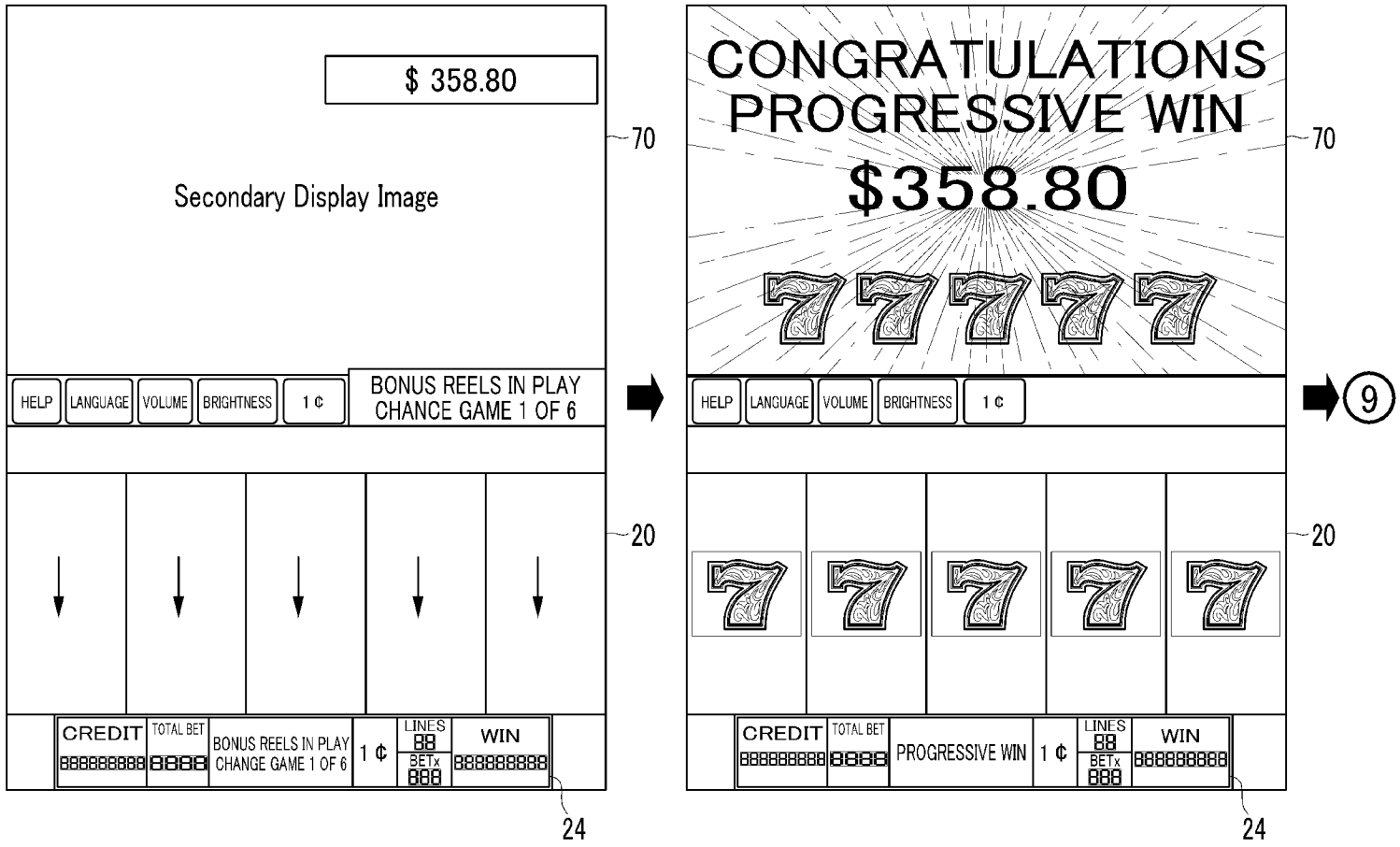
FIG. 33 is an exemplary screen image of a progressive jackpot shown on a primary display and a secondary display in a chance round of a game according to an embodiment of the present invention.
Figure 34:
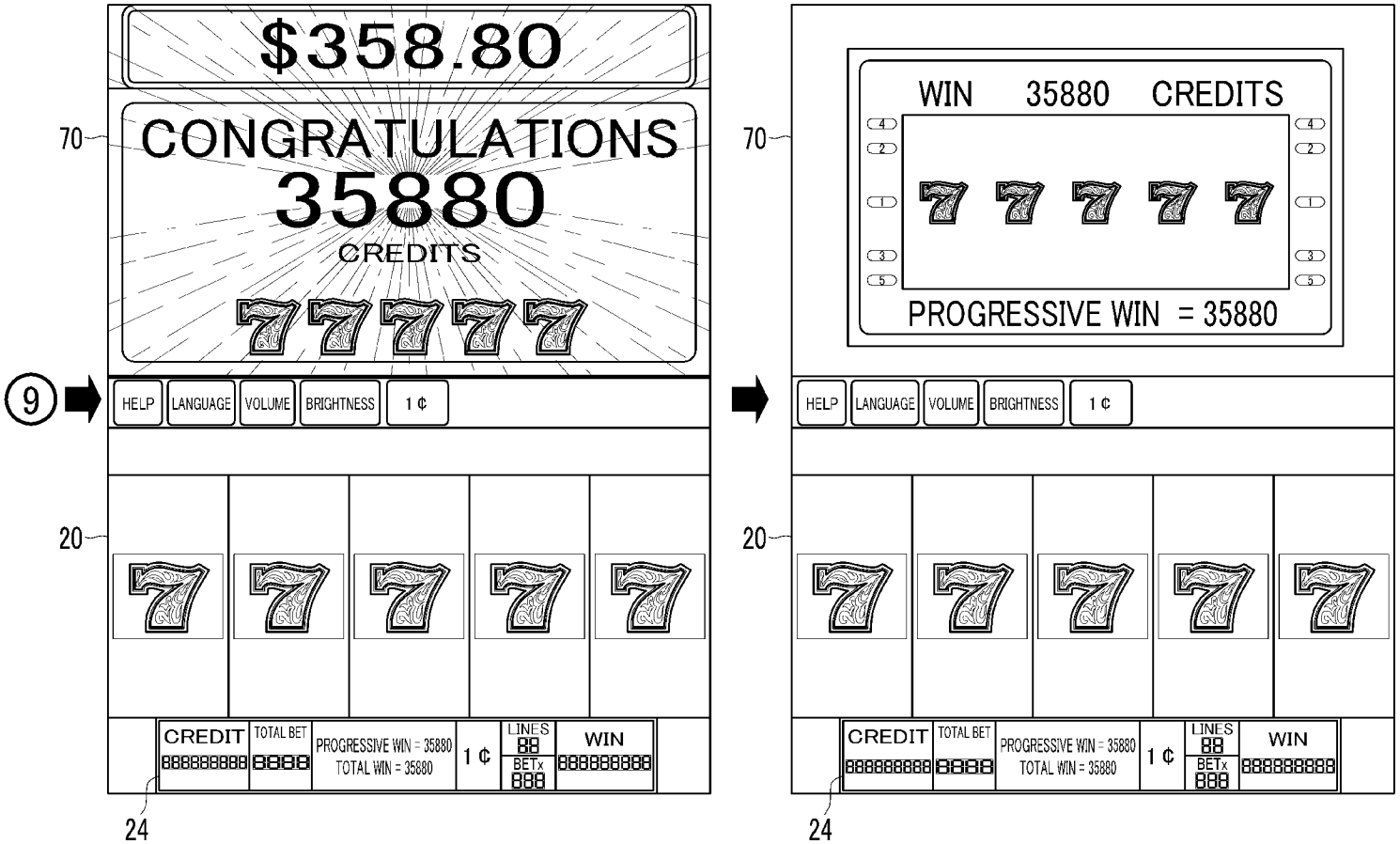
FIG. 34 is an exemplary screen image subsequent to the image shown in FIG. 33.

FIG. 33 and FIG. 34 are exemplary screen images of a progressive jackpot shown on a primary display and a secondary display in a chance round of a game according to an embodiment of the present invention.

Referring FIG. 33, when the reels 31*a* to 31*e* are stopped according to the result of the symbol determining process in a certain free round of the chance round, the winning combination is achieved by a combination of five "7" symbols arranged on the first payline. Accordingly, the secondary display 70 displays an image for notifying the progressive jackpot according to the combination of five "7" symbols. The image further includes for a payout (e.g., $358.80), which is represented as a money, according to the combination of five "7" symbols and a congratulatory message (e.g., "CONGRATULATIONS PROGRESSIVE WIN") according to the progressive jackpot. Further, the display panel 24 of the primary display 20 displays a message (e.g., "PROGRESSIVE WIN") for notifying the progressive jackpot.

Subsequently, the secondary display 70 renders a screen shining brightly, and displays the payout according to the combination of five "7" symbols as credits (e.g., "35880 CREDITS"), as shown in FIG. 34. Further, the display panel 24 displays a payout of the payline achieving the winning combination (e.g., "PROGRESSIVE WIN=35880") and the total credits (e.g., "TOTAL WIN=35880") on the game message area 24*c*. Next, the secondary display 70 displays an image for symbols appeared on the display window 22. Further, the secondary display 70 displays an image for notifying the payout (e.g., 35880 credits) according to the progressive jackpot, for example, as "WIN 35880 CREDITS" and "PROGRESSIVE WIN=35880."

Figure 35:
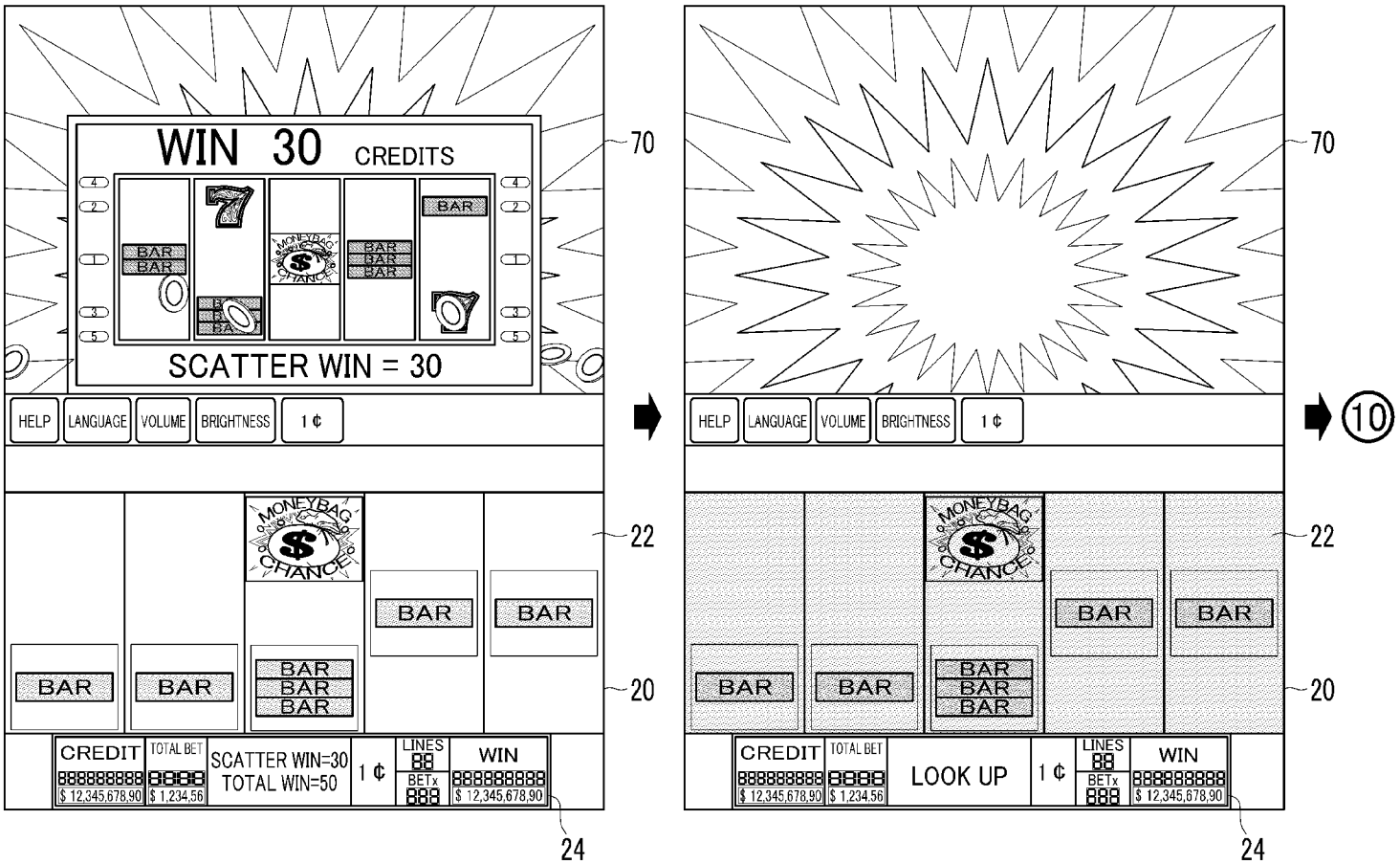
FIG. 35 is an exemplary screen image shown on a primary display and a secondary display when a chance round is triggered according to an embodiment of the present invention.
Figure 36:
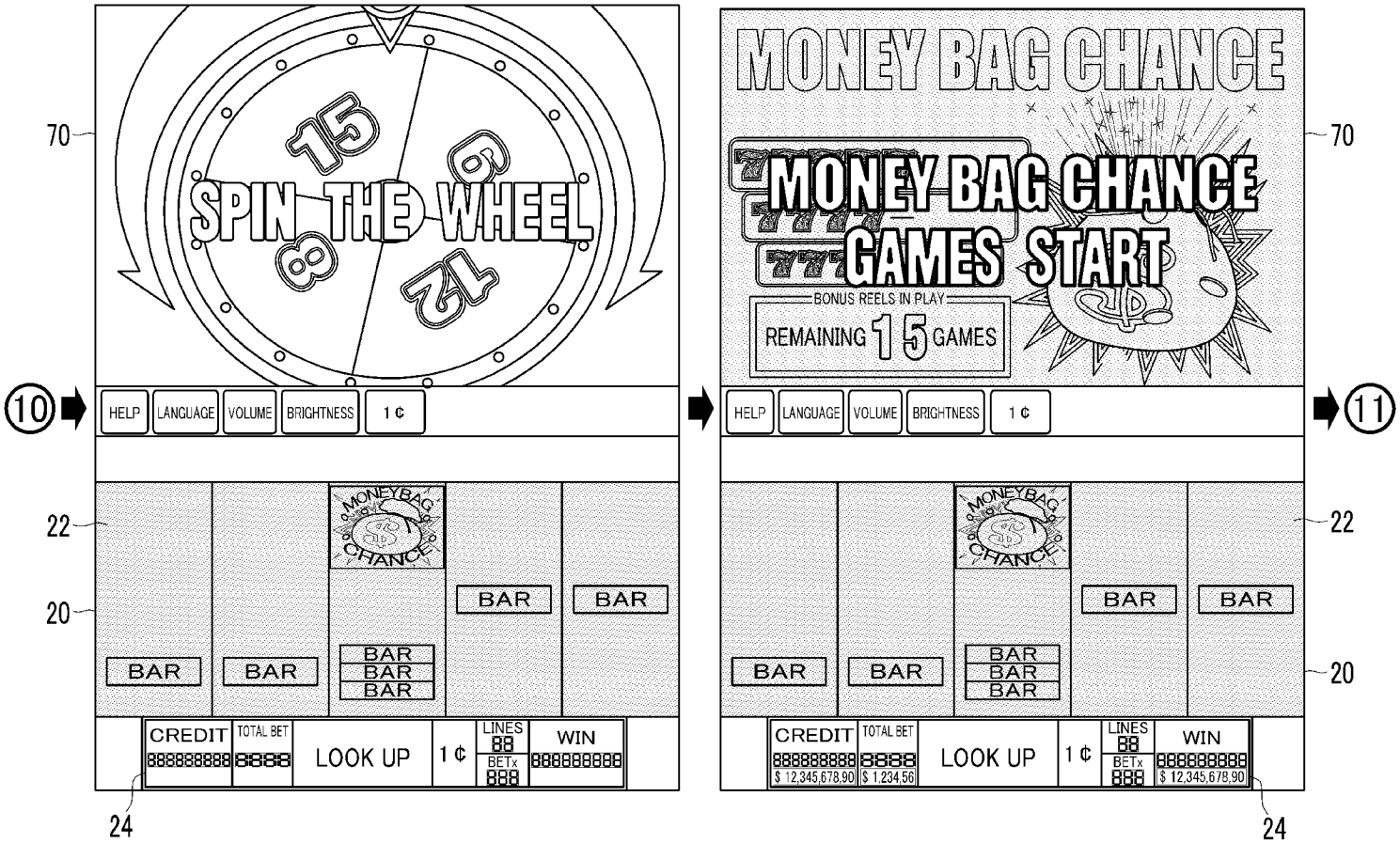
FIG. 36 is an exemplary screen image shown on a primary display and a secondary display after a chance round is started according to an embodiment of the present invention.
Figure 37:
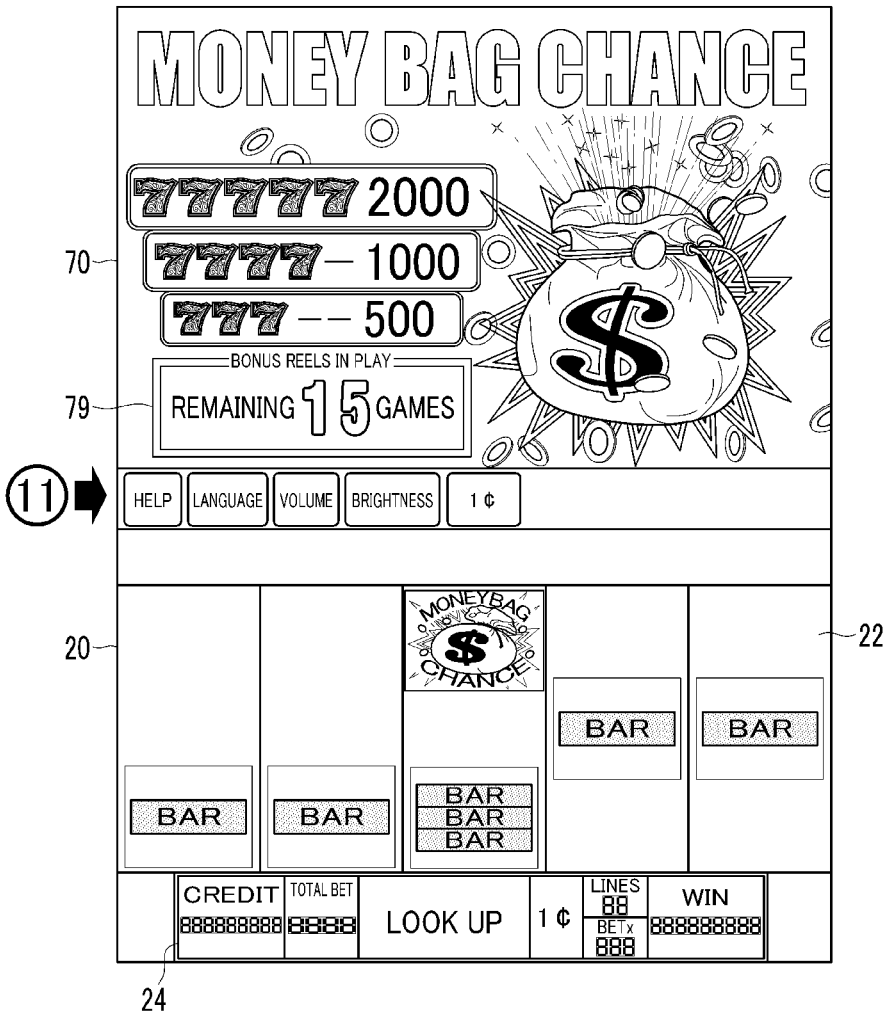
FIG. 37 is an exemplary screen image subsequent to the image shown in FIG. 36.

FIG. 35 is an exemplary screen image shown on a primary display and a secondary display when a chance round is triggered according to an embodiment of the present invention, and FIG. 36 and FIG. 37 are exemplary screen images shown on a primary display and a secondary display after a chance round is started according to an embodiment of the present invention.

Referring to FIG. 35, when a "CHANCE" symbol is appeared on a display window 22 in a normal round of a game, a chance round of the game is triggered. The secondary display 70 displays an image for symbols appeared on the display window 22, and an image representing a combination of symbols (i.e., the "CHANCE" symbol) achieving the winning combination. Further, the secondary display 70 displays an image for notifying the payout (e.g., 30 credits) according to the scatter symbol, for example, as "WIN 30 CREDITS" and "SCATTER WIN=30." Moreover, the display panel 24 of the primary display 20 displays the payout according to the scatter symbol (e.g., "SCATTER WIN=30") and a total payout (e.g., "TOTAL WIN=30") on a game message area 24*c*.

Subsequently, the display window 22 of the primary display 20 is darkened, and the secondary display 70 is shined brightly. The display window 22 may be darkened by backlight units (34 of FIG. 12) that are turned off by backlight drivers (34*t* of FIG. 12). At this time, the display panel 24 displays a message (e.g., "LOOK UP") for indicating the player to look up. Further, a speaker (17 of FIG. 11) of the gaming machine 1 may output a sound corresponding to "LOOK UP."

Next, while the display window 22 is darkened, the secondary display displays a wheel having a plurality of options each corresponding to the number of free rounds, as shown in FIG. 36. The secondary display 70 displays a message (e.g., "SPIN THE WHEEL") for notifying the player to spin the wheel. Further, the display panel 24 still displays the message (e.g., "LOOK UP") for indicating the player to look up. After the number of free rounds is determined by spinning of the wheel, the secondary display 70 notifies a start of the chance round. For example, the secondary display 70 may display "MONEY BAG CHANCE GAMES START." Further, the display panel 24 displays a message (e.g., "MONEG BAG CHANCE") for notifying the start of the chance round in the a game message area 24*c*.

Next, as shown in FIG. 37, the display window 22 of the primary display 20 is brightened again, and the secondary display 70 displays an image for the chance round. The image includes an image for representing a theme (e.g., "MONEY BAG"). Further, the secondary display 70 displays a chance round counter 79 for notifying the number of remaining free rounds. For example, the chance round counter 79 displays "REMAINING 15 GAMES". Furthermore, the secondary display 70 displays a payout for a combination of specific symbols. For example, the secondary display 70 displays a payout (500 credits) for a combination of three "7" symbols, a payout (1000 credits) for a combination of fourth "7" symbols, and a payout (2000 credits) for a combination of five "7" symbols.

Next, an operation of a wheel in a chance round is described with reference to FIG. 38 to FIG. 44. A controller of the gaming machine 1 may control the operation of the wheel.

Figure 38:
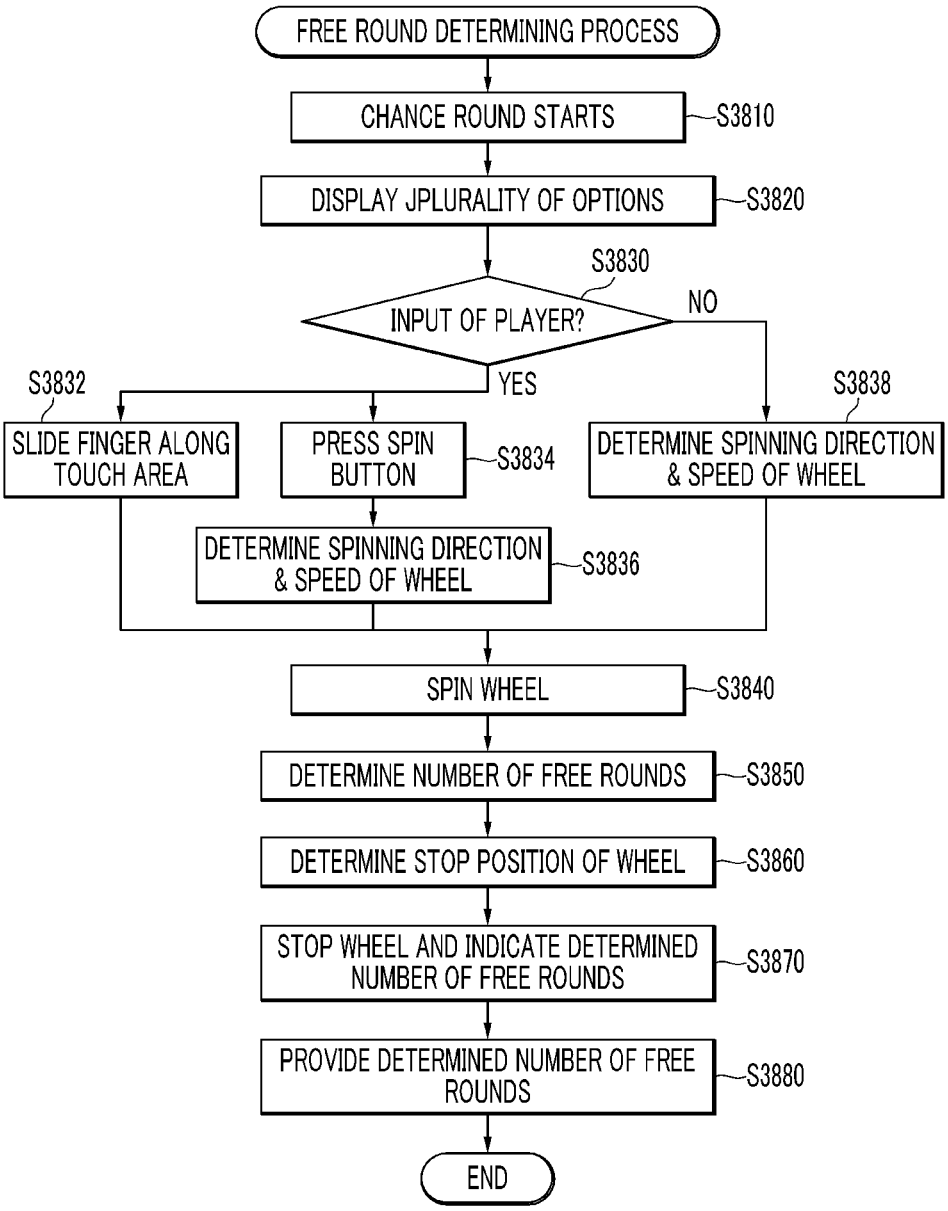
FIG. 38 is a flowchart of a free round determining process according to an embodiment of the present invention.
Figure 39:
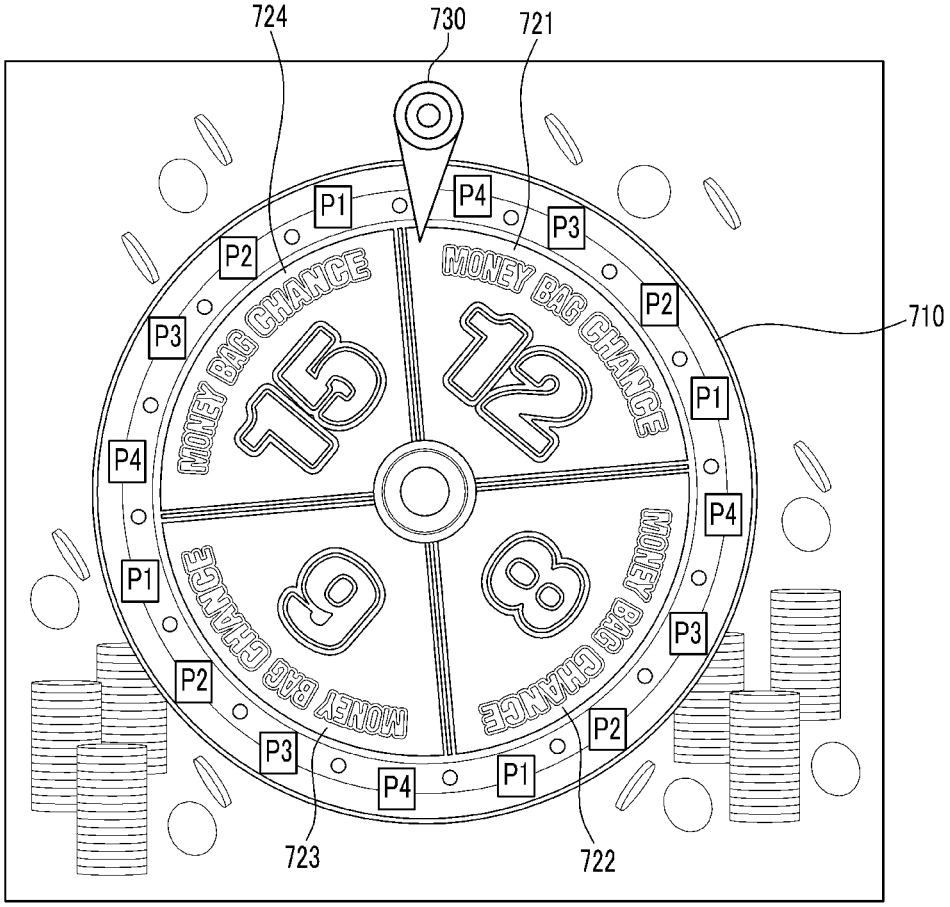
FIG. 39 is an exemplary screen image for the number of free rounds shown on a secondary display according to an embodiment of the present invention.
Figure 40:
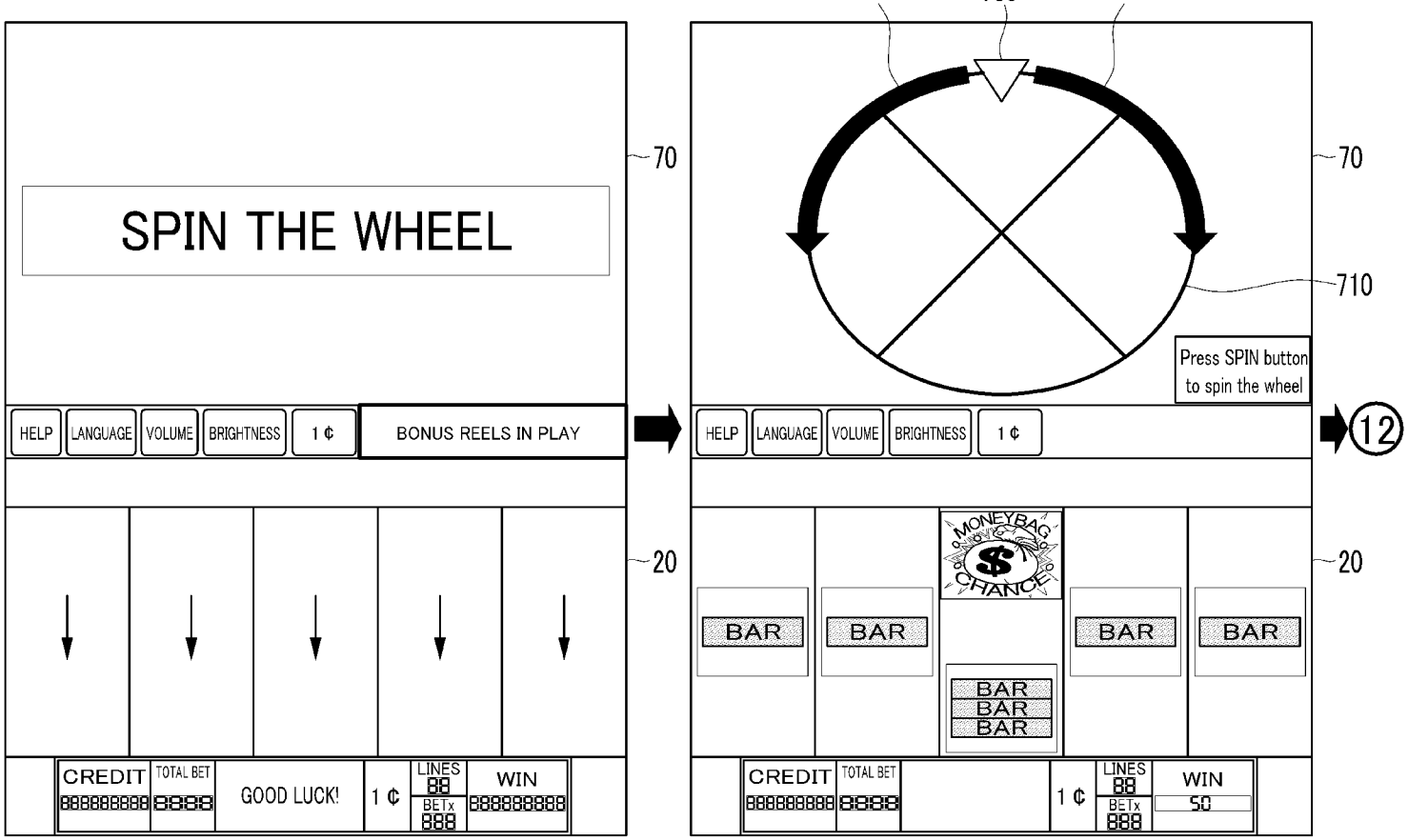
FIG. 40 is an exemplary screen image for spinning a wheel shown on a primary display and a secondary display according to an embodiment of the present invention.
Figure 41:
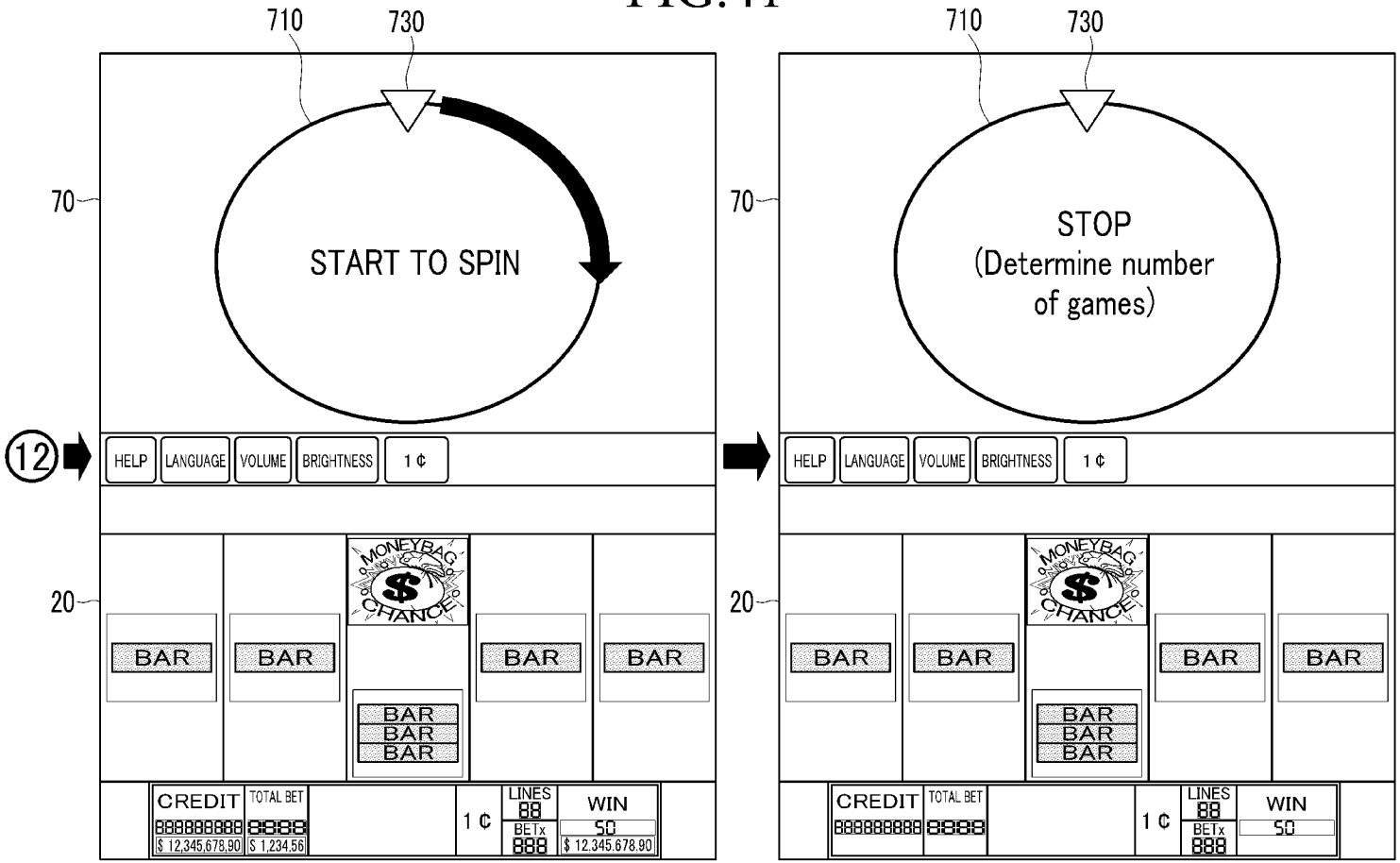
FIG. 41 is an exemplary screen image subsequent to the image shown in FIG. 40.

FIG. 38 is a flowchart of a free round determining process according to an embodiment of the present invention, FIG. 39 is an exemplary screen image for the number of free rounds shown on a secondary display according to an embodiment of the present invention, FIG. 40 and FIG. 41 are exemplary screen images for spinning a wheel shown on a primary display and a secondary display according to an embodiment of the present invention, FIG. 42 is an exemplary spinning speed table according to an embodiment of the present invention, FIG. 43 is an exemplary spin table according to an embodiment of the present invention, and FIG. 44 is an exemplary position determination table according to an embodiment of the present invention.

Referring to FIG. 38, when a chance round is started (S3810), a controller of the gaming machine 1 displays a plurality options for determining the number of free rounds in a secondary display 70 (S3820). As shown in FIG. 39, for determining the number of free rounds, a wheel 710 including a plurality of areas 721, 722, 723 and 724 that correspond to the plurality of options respectively is provided in the secondary display 70. The predetermined number of free rounds is allocated to each of the plurality of options. Each of the plurality of areas 721 to 724 includes a plurality of positions P1, P2, P3 and P4. The plurality of positions includes positions P1 and P4 that are adjacent to a boundary of two adjacent areas, and remaining positions P2 and P3. For example, the wheel 710 may include four areas 721 to 724, and each of the areas 721 to 724 may include four positions P1 to P4. In the four positions P1 to P4, two positions P1 and P4 may be adjacent to the boundary of the adjacent areas. When the wheel 710 is stopped after spinning, an indicator 730 of the wheel 710 indicates any one position of any one area. The predetermined number of free rounds that is allocated to the area indicated by the indicator 730 is determined as the number of free rounds for the chance round.

Referring to FIG. 40, the secondary display 70 further displays touch areas 741 and 742 for indicating to the player to spin the wheel 710. One touch area 741 indicates the player to spin wheel 710 in a clockwise direction, and the other touch area 742 indicates the player to spin wheel 710 in a counterclockwise direction. Accordingly, the player can touch a finger on a screen of the secondary display 70 and slide the finger along any one of the touch areas 741 and 742, thereby spinning the wheel 710.

Referring to FIG. 38 again, the controller waits for an input of the player (S3830). When the player touches the finger on the screen of the secondary display 70 and slides the finger along any one of the touch areas 741 and 742 (S3832), the controller renders in the secondary display 70 an effect that the wheel 710 spins in the clockwise or counterclockwise direction as shown in FIG. 41 (S3840). The spinning direction may be determined by the sliding direction of the player. That is, when the player slides the finger along the touch area 741, the wheel 710 spins in the clockwise direction. When the player slides the finger along the touch area 742, the wheel 710 spins in the counterclockwise direction. Further, the controller may determine a speed at which the wheel 710 spins based on a speed at which the player slides the finger with touching the screen of the secondary display 70. The speed at which the wheel 710 spins may be proportional to the speed at which the player slides the finger. Accordingly, the player can feel like he or she spins a real wheel to select the number of free rounds. As a result, the gaming machine can continuously attract the players' attention.

When the player presses a SPIN button 54 (S3834), the controller randomly determines the direction in which the wheel 710 spins and the speed at which the wheel 710 spins (S3836), the controller renders an effect that the wheel 710 spins according to the determined direction and speed (S3840). When there is no input of the player during a predetermined time (S3830: NO), the controller randomly determines the direction in which the wheel 710 spins and the speed at which the wheel 710 spins (S3838), the controller renders an effect that the wheel 710 spins according to the determined direction and speed (S3840).

Next, the controller randomly determines the number of free rounds for the chance round (S3850). For determining the number of free rounds, the gaming machine 1 may store a plurality of spin tables in a memory. The memory may be a RAM (93 of FIG. 11), a ROM (92 of FIG. 11), or other storage devices. Each of the plurality of spin tables may correspond to any one of a plurality of spinning speeds of the wheel 710 as shown in FIG. 42. Accordingly, the controller may select any one of the plurality of spin tables based on the determined spinning speed of the wheel 710. The plurality of spinning speeds may include a low speed, a middle speed, and a high speed. In this case, when two or more spin tables correspond to one spinning speed, any one spin table may be randomly determined from among the two or more spin tables. Each spin table matches the number of free rounds and a random number. Accordingly, the controller may generate a random number, and determine the number of free rounds based on the random number and the selected spin table. In an example shown in FIG. 43, each spin table stores a plurality of numbers and a range of random numbers corresponding to each of the numbers. The range of random numbers corresponding to each number may be determined based on a weight of each number shown in FIG. 43. The weight of each number corresponds to a probability of each number being determined. The weight may be inversely proportional to the number of free rounds. That is, the maximum number of free rounds may be determined with the lowest probability.

Subsequently, the controller randomly determines a position at which the wheel 710 is to be stopped (S3860). The controller may determine any one position from among a plurality of positions of an area corresponding to the determined number of free rounds. In this case, the controller may determine any one position based on a position determination table stored in the memory of the gaming machine 1. The position determination table matches the position and a random number. Accordingly, the controller may generate a random number, and determine the position based on the random number and the position determination table. In an example shown in FIG. 44, the position determination table stores a plurality of positions P1 to P4 and a range of random numbers corresponding to each of the positions P1 to P4. The range of random numbers corresponding to each position may be determined based on a weight of each position. The weight of each position corresponds to a probability of each position being determined. The weights of the positions P1 and P4 adjacent to the boundary of the adjacent areas may be higher than the weights of the other positions P2 and P3. In the example shown in FIG. 44, the weights of the positions P1 and P4 adjacent to the boundary of the adjacent areas are 40, and the weights of the other positions P2 and P3 are 10. The higher weights of the positions P1 and P4 adjacent to the boundary of the adjacent areas can boost the player's expectation that the area having more free rounds can be selected among the adjacent areas.

The controller renders in the secondary display 70 an effect that the wheel 710 is stopped for the indicator 730 to indicate the determined position of the area corresponding to the determined number of free rounds (S3870). The controller provides the determined number of free rounds and notifies the player of the same (S3880).

On the other hand, in the step S3840, the wheel 710 may start to spin when the player takes off his or her finger from the screen of the secondary display 70. Further, when a period during which the player slides the finger with touching the screen of the secondary display 70 exceeds a first predetermined time, the wheel 710 may start to spin even though the player does not take off the finger from the screen. The first predetermined time may be, for example, 8 seconds. Furthermore, when the player touches the finger on the screen during a period that is shorter than a second predetermined time, the wheel 710 does not start to spin even though the player takes off the finger from the screen.

As described above, according to an embodiment of the present invention, the gaming machine 1 can provide the wheel which can spin in the clockwise or the counterclockwise by the touch of the player or whose spinning speed can be varied by the touch of the player, thereby allow the player to feel like he or she spins the real wheel. Further, the gaming machine 1 can stop the wheel at a position near to the boundary of the adjacent areas with the high probability, thereby boosting the player's expectation that the area having more free rounds can be selected. As a result, the player can be continuously interested in the game.

Next, a display panel 24 of a primary display 20 in a gaming machine 1 according to an embodiment of the present invention is described with reference to FIG. 45 to FIG. 58.

FIG. 45 to FIG. 58 shows exemplary screen images shown in a display panel of a primary display according to an embodiment of the present invention. A controller of the gaming machine 1 may display the screen images on the display panel 24 of the primary display 20.

Figure 45:
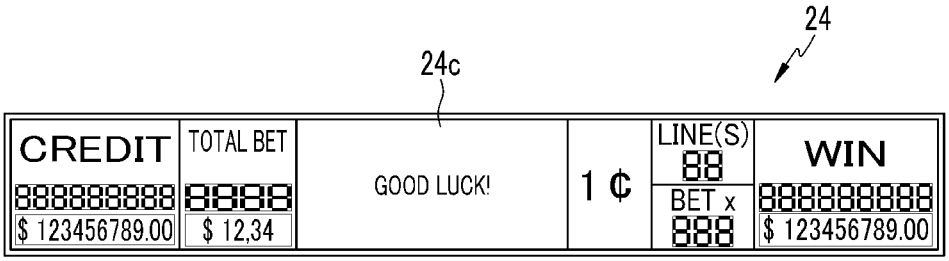
FIG. 45 to FIG. 58 shows exemplary screen images shown in a display panel of a primary display according to an embodiment of the present invention.

Referring to FIG. 45, a game message area 24*c* of a display panel 24 displays a message such as "GOOD LUCK!" when a plurality of reels 31*a* to 31*e* start to spin.

Figure 46:
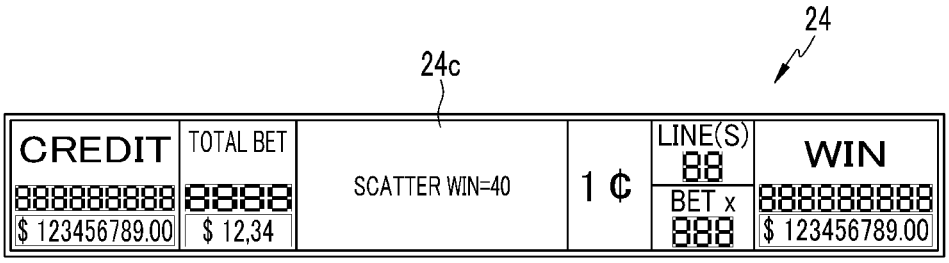

Referring to FIG. 46, the game message area 24*c* of the display panel 24 displays a message (e.g., "SCATTER WIN=40") for notifying a scatter win and a payout (e.g., 40 credits) according to the scatter win when a result of a game is a payout according to a scatter symbol.

Figure 47:
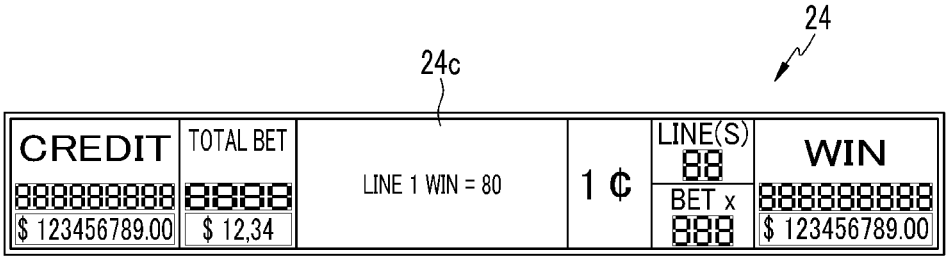

Referring to FIG. 47, the game message area 24*c* of the display panel 24 displays a message (e.g., "LINE 1 WIN=80") for notifying a payline (e.g., line 1) achieving a winning combination and a payout (e.g., 80 credits) according to the winning combination when the result of the game satisfies the winning combination.

Figure 48:
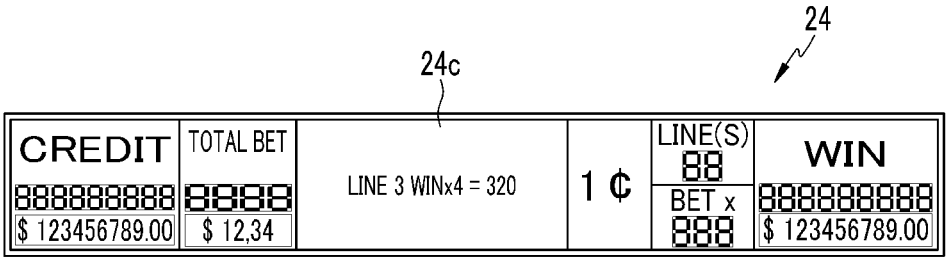

Referring to FIG. 48, the game message area 24*c* of the display panel 24 displays a message (e.g., "LINE 3 WIN×4=320") for notifying a payline (e.g., line 3) achieving a winning combination, a multiplier (e.g., BET×4) determined by a total bet, and a payout (e.g., 320 credits) according to the winning combination when the result of the game satisfies the winning combination.

Figure 49:
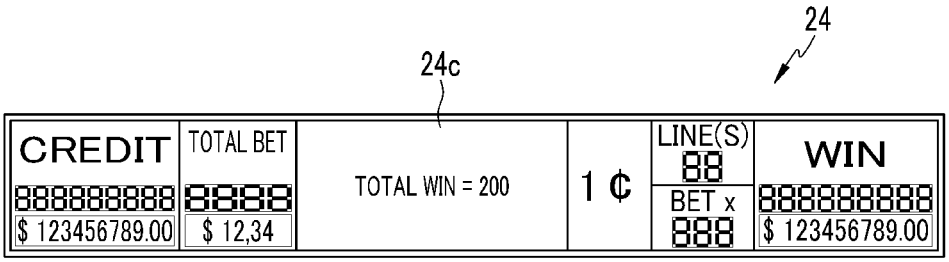

Referring to FIG. 49, the game message area 24*c* of the display panel 24 displays a message (e.g., "TOTAL WIN=200") for notifying total credits (e.g., 200 credits) to be awarded by all paylines achieving a winning combination after displaying a payout according to each payline.

Figure 50:
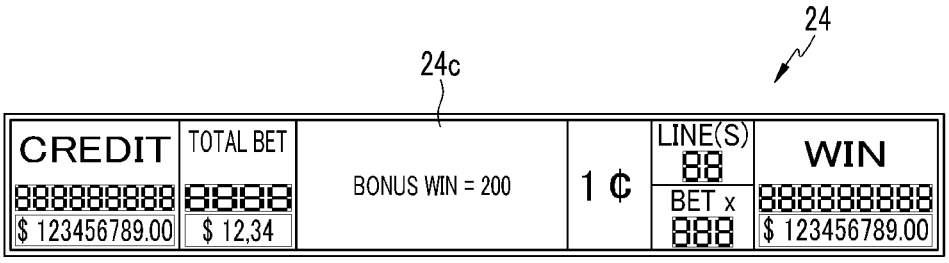

Referring to FIG. 50, the game message area 24*c* of the display panel 24 displays a message (e.g., "BONUS WIN=200") for notifying a payout according to a combination of "BONUS" symbols when a winning combination is the combination of "BONUS" symbols.

Figure 51:
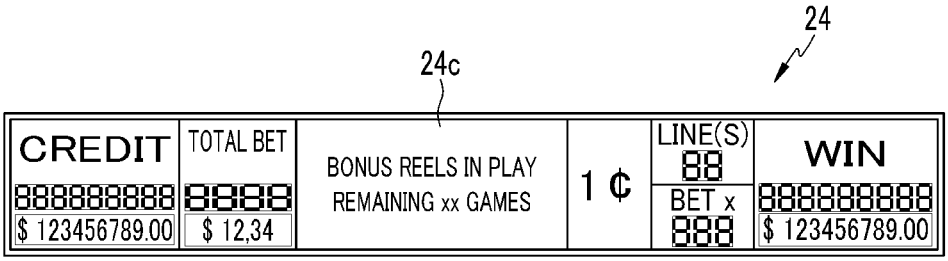

Referring to FIG. 51, the game message area 24*c* of the display panel 24 displays a message (e.g., "BONUS REELS IN PLAY" and "REMAINING xx GAMES") for notifying an execution of a chance round and remaining number of free rounds when the chance round is executed.

Figure 52:
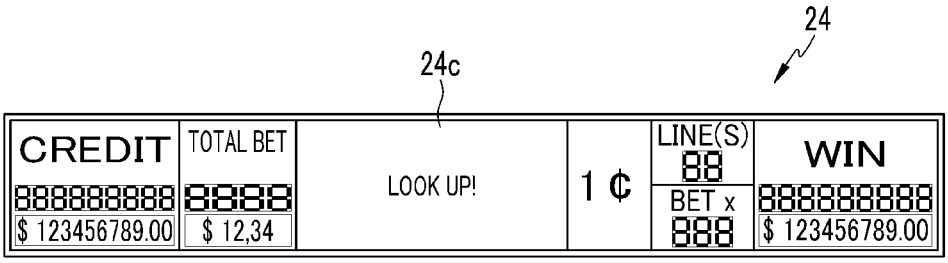

Referring to FIG. 52, the game message area 24*c* of the display panel 24 displays a message (e.g., "LOOK UP!") for indicating the player to look up when a rendering effect is rendered in a secondary display 70.

Figure 53:
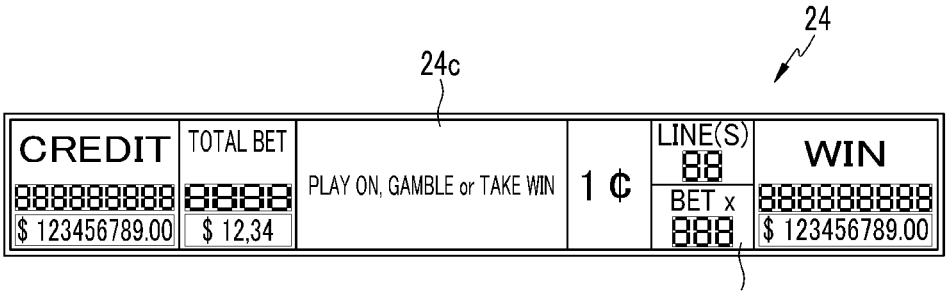

Referring to FIG. 53, the game message area 24*c* of the display panel 24 displays a message (e.g., "PLAY ON, GAMBLE or TAKE WIN") for indicating the player to continuously play the game or take a payout when the payout is provided to the player.

Figure 54:
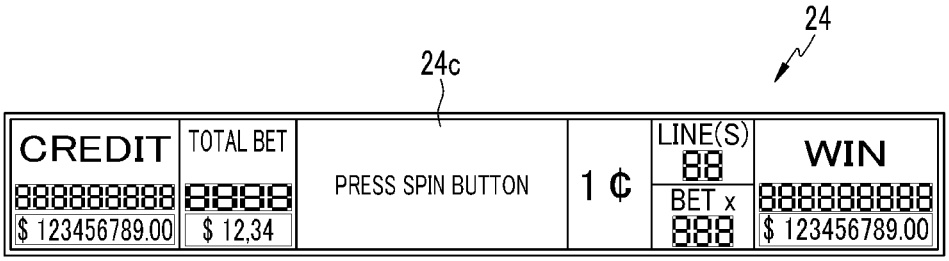

Referring to FIG. 54, the game message area 24*c* of the display panel 24 displays a message (e.g., "PRESS SPIN BUTTON") for indicating the player to press a SPIN button 54 when a gaming machine 1 waits for an input of the player.

Figure 55:
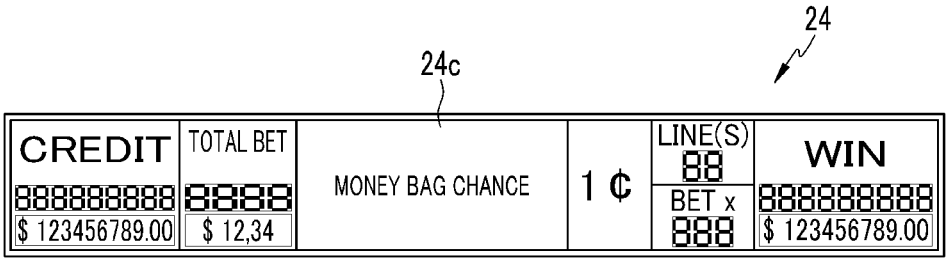

Referring to FIG. 55, the game message area 24*c* of the display panel 24 displays a message (e.g., "MONEY BAC CHANCE") for notifying a trigger of a chance round when the chance round of the game is triggered.

Figure 56:
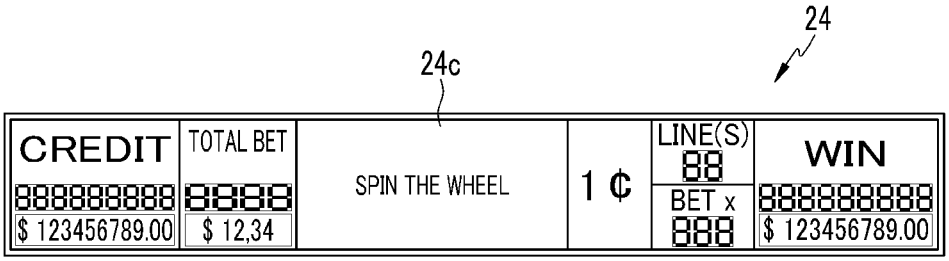

Referring to FIG. 56, the game message area 24*c* of the display panel 24 displays a message (e.g., "SPIN THE WHEEL") for indicating the player to spin a wheel on a secondary display 70 when a gaming machine 1 determines the number of free rounds in the chance round.

Figure 57:
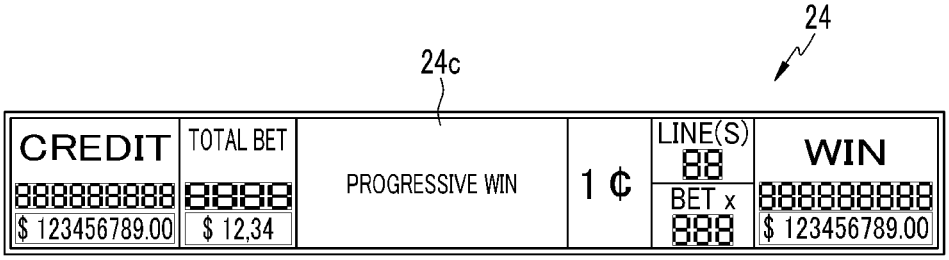

Referring to FIG. 57, the game message area 24*c* of the display panel 24 displays a message (e.g., "PROGRESSIVE WIN") for notifying a progressive jackpot when the result of the game is a combination of five "7" symbols.

Figure 58:
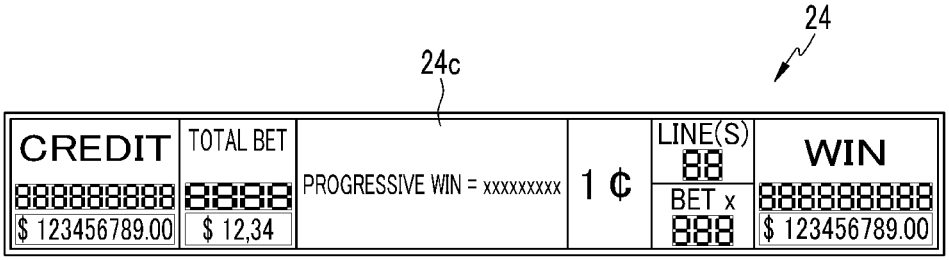

Referring to FIG. 58, the game message area 24*c* of the display panel 24 displays a message (e.g., "PROGRESSIVE WIN=xxxxxxx") for notifying a payout according to the progressive jackpot when the result of the game is the combination of five "7" symbols.

Embodiments of the present invention can also be embodied as a computer readable program on a computer-readable recording medium. The computer readable recording medium is any data storage device that can store data that can be read thereafter by a computer. Examples of the computer readable recording medium include ROMs, RAMs, CD-ROMs, magnetic tapes, floppy disks, and optical data storage devices. The computer readable recording medium can also be distributed over a network coupled computer system so that the computer readable code is stored and executed in a distributed fashion.

While this invention has been described in connection with what is presently considered to be practical embodiments, it is to be understood that the invention is not limited to the disclosed embodiments, but, on the contrary, is intended to cover various modifications and equivalent arrangements included within the spirit and scope of the appended claims.

What is claimed is:

1. A slot machine, comprising:

a first display including a plurality of reels, each of the plurality of reels including a plurality of symbols;

a second display including a touch screen panel;

at least one entry configured to receive a first physical item associated with a monetary value for providing credits to be bet by a player;

an award payout mechanism by which a second physical item associated with a monetary value can be paid out to the player or credited to current credits of the player as an outcome of a game;

a memory configured to store a plurality of spin table; and a controller configured to, as a result of the player having bet credits, execute a normal round of the game to spin the reels, trigger a chance round of the game when a result of the normal round satisfies a predetermined condition, display a wheel and a plurality of touch areas on the second display, the wheel including a plurality of areas and each of the plurality of areas corresponding to a predetermined number of free rounds, when any one of the touch areas is touched and slid by a player, spin the wheel in a direction corresponding to the slid touch area, randomly determine a number of free rounds, stop the wheel at a position of an area that corresponds to the determined number of free rounds among the plurality of areas, provide free rounds having the determined number, add credits corresponding to results of the free rounds to the current credits of the player by the award payout mechanism, and pay out the credits of the current credits as the second physical item by the award payout mechanism, wherein the controller is further configured to spin the wheel at a spinning speed that corresponds to a speed that is slid by the player among a plurality of spinning speeds, wherein each of the plurality of spin table corresponds to any one of the plurality of spinning speeds and includes a plurality of numbers for the free rounds, and wherein the controller is further configured to select a spin table that corresponds to the spinning speed of the wheel among the plurality of spinning speeds, and to randomly determine any one number from among the plurality of numbers included in the selected spin table.

2. The slot machine of claim 1, wherein each of the plurality of areas includes a plurality of positions, wherein the controller is further configured to randomly determine any one position from among the plurality of positions included in the area that corresponds to the determined number of free rounds, and to stop the wheel for an indicator to indicate the determined position.

3. The slot machine of claim 2, wherein two adjacent areas among the plurality of areas have different numbers for free rounds, and wherein the controller is further configured to determine a position that is nearest to a boundary of the two adjacent areas with a highest probability.

4. The slot machine of claim 1, wherein the controller is further configured to automatically spin the wheel when a spin button is pressed by the player or an input of the player is not input.

5. The slot machine of claim 4, wherein the controller is further configured to randomly determine a direction in which the wheel spins and a spinning speed of the wheel when automatically spinning the wheel.

6. The slot machine of claim 1, wherein the controller is further configured to start to spin the wheel when the touch of the player is taken off from the second display.

7. The slot machine of claim 1, wherein the controller is further configured to execute each free round of the game, and end the chance round and return to the normal round when a result of the free round includes a combination of specific symbols whose number being greater than or equal to a predetermined number or a number of executed free rounds is the determined number.

8. A slot machine, comprising:

a first display including a plurality of reels, each of the plurality of reels including a plurality of symbols;

a second display including a touch screen panel;

at least one entry configured to receive a first physical item associated with a monetary value for providing credits to be bet by a player;

an award payout mechanism by which a second physical item with a monetary value can be paid out to the player or credited to current credits of the player as an outcome of a game; and a controller configured to, as a result of the player having bet credits, execute a normal round of the game to spin the reels, trigger a chance round of the game when a result of the normal round satisfies a predetermined condition, display a wheel and a plurality of touch areas on the second display, the wheel including a plurality of areas and each of the plurality of areas corresponding to a predetermined number of free rounds, when any one of the touch areas is touched and slid by a player, spin the wheel in a direction corresponding to the slid touch area, randomly determine a number of free rounds, stop the wheel at a position of an area that corresponds to the determined number of free rounds among the plurality of areas, provide free rounds having the determined number, add credits corresponding to results of the free rounds to the current credits of the player by the award payout mechanism, and pay out the credits of the current credits as the second physical item by the award payout mechanism, wherein the controller is further configured to start to spin the wheel when a period during which the wheel is touched and slid by the player exceeds a predetermined time.

9. A gaming method by a controller of a slot machine including a first display including a plurality of reels, a second display including a touch screen panel, at least one entry configured to receive a first physical item associated with a monetary value for providing credits to be bet by a player, and an award payout mechanism by which a second physical item with a monetary value can be paid out to the player or credited to current credits of the player as an outcome of a game, each of the plurality of reels including a plurality of symbols, the method comprising, as a result of the player having bet credits:

executing a normal round of the game to spin the reels;

triggering a chance round of the game when a result of the normal round satisfies a predetermined condition;

displaying a wheel and a plurality of touch areas on the second display, the wheel including a plurality of areas and each of the plurality of areas corresponding to a predetermined number of free rounds;

when any one of the touch areas is touched and slid by a player, spinning the wheel in a direction corresponding to the slid touch area;

randomly determining a number of free rounds;

stopping the wheel at a position of an area that corresponds to the determined number of free rounds among the plurality of areas;

providing free rounds having the determined number;

adding credits corresponding to results of the free rounds to the current credits of the player by the award payout mechanism; and paying out the credits of the current credits as the second physical item by the award payout mechanism, wherein spinning the wheel includes spinning the wheel at a spinning speed that corresponds to a speed that is slid by the player among a plurality of spinning speeds, wherein the slot machine further includes a memory configured to store a plurality of spin table, wherein each of the plurality of spin table corresponds to any one of the plurality of spinning speeds and includes a plurality of numbers for the free rounds, and wherein determining the number of free rounds includes selecting a spin table that corresponds to the spinning speed of the wheel among the plurality of spinning speeds, and randomly determining any one number from among the plurality of numbers included in the selected spin table.

10. The method of claim 9, wherein each of the plurality of areas includes a plurality of positions, wherein stopping the wheel includes randomly determining any one position from among the plurality of positions included in the area that corresponds to the determined number of free rounds, and stopping the wheel for an indicator to indicate the determined position.

11. The method of claim 10, wherein two adjacent areas among the plurality of areas have different numbers for free rounds, and wherein determining the any one position includes determining a position that is nearest to a boundary of the two adjacent areas with a highest probability.

12. The method of claim 9, further comprising automatically spinning the wheel when a spin button is pressed by the player or an input of the player is not input.

13. The method of claim 12, further comprising randomly determining a direction in which the wheel spins and a spinning speed of the wheel when automatically spinning the wheel.

14. The method of claim 9, wherein spinning the wheel includes starting to spin the wheel when the touch of the player is taken off from the second display.

15. The method of claim 9, further comprising:

executing each free round of the game; and ending the chance round and returning to the normal round when a result of the free round includes a combination of specific symbols whose number being greater than or equal to a predetermined number or a number of executed free rounds is the determined number.

16. A gaming method by a controller of a slot machine including a first display including a plurality of reels, a second display including a touch screen panel, at least one entry configured to receive a first physical item associated with a monetary value for providing credits to be bet by a player, and an award payout mechanism by which the first physical item with a monetary value can be paid out to the player or credited to current credits of the player as an outcome of a game, each of the plurality of reels including a plurality of symbols, the method comprising, as a result of the player having bet credits:

executing a normal round of the game to spin the reels;

triggering a chance round of the game when a result of the normal round satisfies a predetermined condition;

displaying a wheel and a plurality of touch areas on the second display, the wheel including a plurality of areas and each of the plurality of areas corresponding to a predetermined number of free rounds;

when any one of the touch areas is touched and slid by a player, spinning the wheel in a direction corresponding to the slid touch area;

randomly determining a number of free rounds;

stopping the wheel at a position of an area that corresponds to the determined number of free rounds among the plurality of areas;

providing free rounds having the determined number;

adding credits corresponding to results of the free rounds to the current credits of the player by the award payout mechanism; and paying out the credits of the current credits as the second physical item by the award payout mechanism by the award payout mechanism, wherein spinning the wheel includes starting to spin the wheel when a period during which the wheel is touched and slid by the player exceeds a predetermined time.

* * * * *